US009230489B2

(12) United States Patent
Yamazaki et al.

(10) Patent No.: US 9,230,489 B2
(45) Date of Patent: Jan. 5, 2016

(54) LIQUID CRYSTAL DISPLAY DEVICE AND METHOD FOR DRIVING LIQUID CRYSTAL DISPLAY DEVICE

(75) Inventors: Shunpei Yamazaki, Tokyo (JP); Yoshiharu Hirakata, Kanagawa (JP); Jun Koyama, Kanagawa (JP)

(73) Assignee: Semiconductor Energy Laboratory Co., Ltd., Atsugi-shi, Kanagawa-ken (JP)

( * ) Notice: Subject to any disclaimer, the term of this patent is extended or adjusted under 35 U.S.C. 154(b) by 492 days.

(21) Appl. No.: 13/167,045

(22) Filed: Jun. 23, 2011

(65) Prior Publication Data

US 2012/0002133 A1 Jan. 5, 2012

(30) Foreign Application Priority Data

Jul. 2, 2010 (JP) ..... 2010-152411

(51) Int. Cl.
*G09G 3/36* (2006.01)
*G09G 3/34* (2006.01)

(52) U.S. Cl.
CPC ..... *G09G 3/342* (2013.01); *G09G 3/3648* (2013.01); *G09G 3/3677* (2013.01); *G09G 2310/0235* (2013.01)

(58) Field of Classification Search
CPC ..... G09G 3/342; G09G 3/3648; G09G 2310/0235
USPC ..... 345/88
See application file for complete search history.

(56) References Cited

U.S. PATENT DOCUMENTS 6,448,951 B1 * 9/2002 Sakaguchi et al. ..... 345/88
6,590,553 B1 7/2003 Kimura et al.
6,597,348 B1 7/2003 Yamazaki et al.

(Continued)

FOREIGN PATENT DOCUMENTS

CN 101297347 10/2008
CN 101303839 A 11/2008

(Continued)

OTHER PUBLICATIONS

International Search Report (Application No. PCT/JP2011/063855) Dated Sep. 20, 2011.

(Continued)

*Primary Examiner* — Aneeta Yodichkas
*Assistant Examiner* — Joseph Fox
(74) *Attorney, Agent, or Firm* — Eric J. Robinson; Robinson Intellectual Property Law Office, P.C.

(57) ABSTRACT

An object of the invention is to suppress degradation in image quality of a liquid crystal display device which performs display by field sequential method and to reduce power consumption of a backlight. The highest brightness of a first color light in a pixel region is detected. Gamma correction is performed so that transmittance of a pixel of the region displaying the highest brightness of the first color light is set to maximum and transmittance of other pixel of the region is decreased in accordance with lowering of the first color light intensity, and the region is irradiated with the highest brightness of the first color light. Similarly, a second color light is irradiated in another region concurrently with irradiation of the first color, whereby input of an image signal and lighting of the backlight are performed simultaneously in every region of the pixel portion.

15 Claims, 24 Drawing Sheets

(56) References Cited

U.S. PATENT DOCUMENTS

| | | | | |
|---|---|---|---|---|
| 6,801,220 | B2 | 10/2004 | Greier et al. | |
| 6,853,384 | B2 | 2/2005 | Miyata et al. | |
| 6,873,311 | B2 | 3/2005 | Yoshihara et al. | |
| 6,882,012 | B2 | 4/2005 | Yamazaki et al. | |
| 6,903,731 | B2 | 6/2005 | Inukai | |
| 7,113,164 | B1 | 9/2006 | Kurihara | |
| 7,145,536 | B1 | 12/2006 | Yamazaki et al. | |
| 7,193,593 | B2 | 3/2007 | Koyama et al. | |
| 7,224,339 | B2 | 5/2007 | Koyama et al. | |
| 7,268,756 | B2 | 9/2007 | Koyama et al. | |
| 7,312,777 | B2 | 12/2007 | Miyata et al. | |
| 7,317,438 | B2 | 1/2008 | Yamazaki et al. | |
| 7,362,304 | B2 | 4/2008 | Takatori et al. | |
| 7,385,579 | B2 | 6/2008 | Satake | |
| 7,403,177 | B2 | 7/2008 | Tanada et al. | |
| 7,425,937 | B2 | 9/2008 | Inukai | |
| 7,564,443 | B2 | 7/2009 | Takatori et al. | |
| 7,702,705 | B2 | 4/2010 | Suzuki | |
| 7,755,594 | B2 | 7/2010 | Yoshihara et al. | |
| 7,773,066 | B2 | 8/2010 | Yamazaki et al. | |
| 7,791,074 | B2 | 9/2010 | Iwasaki | |
| 7,791,571 | B2 | 9/2010 | Ohtani et al. | |
| 7,812,809 | B2 * | 10/2010 | Choi et al. | 345/102 |
| 7,830,358 | B2 * | 11/2010 | Seetzen | 345/102 |
| 7,834,830 | B2 | 11/2010 | Yamazaki et al. | |
| 7,855,770 | B2 | 12/2010 | Egi et al. | |
| 7,935,582 | B2 | 5/2011 | Iwasaki | |
| 7,941,471 | B2 | 5/2011 | Katz et al. | |
| 7,956,361 | B2 | 6/2011 | Iwasaki | |
| 8,094,143 | B2 | 1/2012 | Kamada et al. | |
| 8,139,020 | B2 | 3/2012 | Ohshima | |
| 8,139,022 | B2 | 3/2012 | Ohshima | |
| 8,154,024 | B2 | 4/2012 | Iwasaki | |
| 8,502,762 | B2 | 8/2013 | Kamada et al. | |
| 8,537,086 | B2 | 9/2013 | Koyama et al. | |
| 8,564,629 | B2 | 10/2013 | Toyotaka et al. | |
| 2002/0000960 | A1 | 1/2002 | Yoshihara et al. | |
| 2002/0044140 | A1 | 4/2002 | Inukai | |
| 2002/0075249 | A1 | 6/2002 | Kubota et al. | |
| 2004/0056831 | A1 | 3/2004 | Takatori et al. | |
| 2004/0113906 | A1 | 6/2004 | Lew et al. | |
| 2004/0257324 | A1 | 12/2004 | Hsu | |
| 2005/0012097 | A1 | 1/2005 | Yamazaki | |
| 2005/0078079 | A1 * | 4/2005 | Hashimoto | 345/100 |
| 2007/0139354 | A1 | 6/2007 | Kim et al. | |
| 2007/0216616 | A1 | 9/2007 | Stessen et al. | |
| 2007/0279359 | A1 | 12/2007 | Yoshida et al. | |
| 2007/0279374 | A1 | 12/2007 | Kimura et al. | |
| 2008/0158140 | A1 | 7/2008 | Takatori et al. | |
| 2008/0238336 | A1 | 10/2008 | Peng et al. | |
| 2008/0278432 | A1 * | 11/2008 | Ohshima | 345/102 |
| 2009/0028460 | A1 | 1/2009 | Jung et al. | |
| 2009/0167670 | A1 | 7/2009 | Peng et al. | |
| 2009/0219243 | A1 | 9/2009 | Chen | |
| 2009/0237004 | A1 | 9/2009 | Ploquin et al. | |
| 2009/0321737 | A1 | 12/2009 | Isa et al. | |
| 2010/0039440 | A1 | 2/2010 | Tanaka et al. | |
| 2010/0090938 | A1 | 4/2010 | Kamada et al. | |
| 2010/0148177 | A1 | 6/2010 | Koyama et al. | |
| 2010/0149084 | A1 | 6/2010 | Chida | |
| 2010/0156777 | A1 * | 6/2010 | Kang et al. | 345/102 |
| 2010/0182282 | A1 | 7/2010 | Kurokawa et al. | |
| 2010/0235418 | A1 | 9/2010 | Dong | |
| 2010/0321420 | A1 | 12/2010 | Ohtani et al. | |
| 2011/0001725 | A1 | 1/2011 | Kurokawa | |
| 2011/0025729 | A1 | 2/2011 | Yamazaki et al. | |
| 2011/0051034 | A1 | 3/2011 | Egi et al. | |
| 2011/0157216 | A1 | 6/2011 | Yamazaki et al. | |
| 2011/0157253 | A1 | 6/2011 | Yamazaki et al. | |
| 2011/0248970 | A1 | 10/2011 | Koyama et al. | |
| 2011/0248978 | A1 | 10/2011 | Koyama et al. | |
| 2011/0249037 | A1 | 10/2011 | Koyama et al. | |
| 2011/0310132 | A1 | 12/2011 | Kurokawa et al. | |
| 2011/0316818 | A1 | 12/2011 | Koyama et al. | |
| 2012/0002132 | A1 | 1/2012 | Yamazaki et al. | |

FOREIGN PATENT DOCUMENTS

| | | | |
|---|---|---|---|
| CN | 101419786 | A | 4/2009 |
| EP | 1990796 | A | 11/2008 |
| EP | 2113904 | A | 11/2009 |
| EP | 2154673 | A | 2/2010 |
| EP | 2339639 | A | 6/2011 |
| EP | 2816607 | A | 12/2014 |
| JP | 06-222330 | A | 8/1994 |
| JP | 11-337904 | A | 12/1999 |
| JP | 2000-275605 | A | 10/2000 |
| JP | 2002-062518 | A | 2/2002 |
| JP | 2004-233555 | A | 8/2004 |
| JP | 2005-316092 | A | 11/2005 |
| JP | 2006-047594 | | 2/2006 |
| JP | 2006-220685 | A | 8/2006 |
| JP | 2007-103918 | A | 4/2007 |
| JP | 2007-114628 | A | 5/2007 |
| JP | 2007-264211 | A | 10/2007 |
| JP | 2009-042405 | | 2/2009 |
| JP | 2009-042652 | | 2/2009 |
| JP | 2009-042652 | A | 2/2009 |
| KR | 2008-0063286 | A | 7/2008 |
| KR | 2008-0099116 | A | 11/2008 |
| TW | 511050 | | 11/2002 |
| TW | 567462 | | 12/2003 |
| TW | I251199 | | 3/2006 |
| WO | WO-02/059685 | | 8/2002 |
| WO | WO-2007/029844 | | 3/2007 |
| WO | WO-2007/049489 | | 5/2007 |

OTHER PUBLICATIONS

Written Opinion (Application No. PCT/JP2011/063855) Dated Sep. 20, 2011.

Baron.P et al., "36.4: Can Motion Compensation Eliminate Color Breakup of Moving Objects in Field-Sequential Color Displays?, ", SID Digest '96 : SID International Symposium Digest of Technical Papers, 1996, vol. 27, pp. 843-846.

Kurita.T et al., "Evaluation and Improvement of Picture Quality for Moving Images on Field-sequential Color Displays,", IDW '00 : Proceedings of the 17th International Display Workshops, 2000, pp. 69-72.

Taira.K et al., "A15" Field-Sequential Display without Color Break-Up using an AFLC Color Shutter,", IDW '00 : Proceedings of the 17th International Display Workshops, 2000, pp. 73-76..

Jarvenpaa.T, "7.2: Measuring Color Breakup of Stationary Images in Field-Sequential-Color Displays,", SID Digest '04 : SID International Symposium Digest of Technical Papers, 2004, vol. 35, pp. 82-85.

Chinese Office Action (Application No. 201180032159.6) Dated Mar. 12, 2015.

Taiwanese Office Action (Application No. 100122819) Dated Oct. 15, 2015.

* cited by examiner

LIQUID CRYSTAL DISPLAY DEVICE AND METHOD FOR DRIVING LIQUID CRYSTAL DISPLAY DEVICE

TECHNICAL FIELD

The present invention relates to a method for driving a liquid crystal display device. In particular, the present invention relates to a field-sequential driving method of a liquid crystal display device.

BACKGROUND ART

A color filter method and a field sequential method are known as display methods for liquid crystal display devices. In a liquid crystal display device in which images are displayed by a color filter method, a plurality of subpixels each having a color filter that only transmits light with a wavelength of a given color (e.g., red (R), green (G), or blue (B)) are provided in each pixel. A desired color is produced in such a manner that transmission of white light is controlled in each subpixel and a plurality of colors are mixed in each pixel. On the other hand, in a liquid crystal display device in which images are displayed by a field sequential method, a plurality of light sources that emit lights of different colors (e.g., red (R), green (G), and blue (B)) are provided. A desired color is expressed in such a manner that the plurality of light sources that emit lights of different colors repeatedly blinks and transmission of light of each color is controlled in each pixel. In other words, according to the color filter method, a desired color is realized with division of the area of one pixel into plural areas for respective lights of colors; according to the field-sequential method, a desired color is realized with division of the display period into plural display periods for respective lights of colors.

The liquid crystal display device in which images are displayed by a field sequential method has the following advantages over the liquid crystal display device in which images are displayed by a color filter method. First, in the liquid crystal display device employing a field sequential method, it is not necessary to provide subpixels in a pixel. Thus, the aperture ratio can be improved or the number of pixels can be increased. In addition, in the liquid crystal display device employing a field sequential method, it is not necessary to provide a color filter. That is, loss of light due to light absorption in the color filter does not occur. Therefore, transmittance can be improved and power consumption can be reduced.

Patent Document 1 discloses a liquid crystal display device in which images are displayed by a field sequential method. Specifically, Patent Document 1 discloses a liquid crystal display device in which pixels each include a transistor for controlling input of an image signal, a signal storage capacitor for holding the image signal, and a transistor for controlling transfer of electric charge from the signal storage capacitor to a display pixel capacitor. In the liquid crystal display device having this structure, input of an image signal to the signal storage capacitor and display corresponding to electric charge held in the display pixel capacitor can be performed at the same time.

Patent Document 2 discloses a liquid crystal display device in which power consumed by a light source of a backlight (also referred to as a backlight source) can be reduced. Specifically, Patent Document 2 discloses a liquid crystal display device which includes a maximum value detection circuit which detects each of maximum values of color tones for R, G, and B in one screen (one field) and a backlight source which emits light of colors of R, G, and B in accordance with image signals so that the light of the emission colors does not overlap with each other.

In the above liquid crystal display device, a pixel for displaying a color tone having the highest brightness detected by the maximum value detection circuit has the highest aperture ratio (or the highest liquid crystal deflection angle), and display for this pixel is performed by control of brightness of the backlight source in accordance with the detected color tone having the highest brightness. Further, the aperture ratio (of liquid crystal deflection angle) of another pixel for displaying another color tone is controlled in accordance with a difference with the color tone having the highest brightness. In one screen (one field), the backlight source is operated in accordance with brightness of the color tone having the highest brightness of each of colors of R, G, and B, whereby power consumption can be reduced.

REFERENCE

[Patent Document 1] Japanese Published Patent Application No. 2009-042405

[Patent Document 2] Japanese Published Patent Application No. 2006-047594

DISCLOSURE OF INVENTION

As described above, in the field-sequential liquid crystal display device, color information is time-divided. Thus, display viewed by a user might be changed (deviated) from display based on original display data (such a phenomenon is also referred to as color break or color breakup) due to lack of given display data which is caused by block of display in a short time (e.g., eye blinking of the user).

In a liquid crystal display device expressing color tones by control of transmission of light emitted from a backlight source with use of an image signal, energy emitted from the backlight source is wasted. Thus, the liquid crystal display device disclosed in Patent Document 2 in which the pixels and the backlight source are operated in accordance with brightness of the color tones having the highest brightness for each of R, G, and B in one screen (one field), has a certain level of effect in a reduction in power consumption. However, in the case where in even one pixel in one screen (one field), the maximum value detection circuit detects a color tone which corresponds to the maximum luminance of the backlight source, the backlight source needs to emit light with the maximum luminance regardless of color tones in the other regions in the one screen. As a result, in such a case, power consumption cannot be reduced. In other words, the effect is produced only when the color tone which needs the maximum luminance of light from the backlight is not detected in the whole screen.

An object of one embodiment of the present invention is to suppress degradation in image quality of a field-sequential liquid crystal display device and reduce power consumption of a backlight, effectively.

In order to achieve the above object, the present inventors focus on frequency of an image signal input to a liquid crystal display device driven by a field sequential method, and on light transmittance of a pixel for displaying a color tone having the highest brightness in each frame. Pixels and backlights arranged in matrix are divided into a plurality of regions in the row direction and an image signal is input, whereby an input frequency of the image signal to each pixel is increased. In addition, a signal of a color tone having the highest brightness is detected from the image signal for expressing a first color displayed on one region, and gamma correction of the image signal is performed so that transmittance of a pixel for displaying the signal is set to a maximum and transmittance of pixels with a lower color tone than the pixel for displaying the signal is decreased in accordance with lowering of the color tone. Then, in the one region light of the first color may be emitted with use of the backlight, so that display corresponding to the original image signal is performed on the pixel. Further, by a method similar to the method performed in the one region, gamma correction of the image signal is performed for another region, and by control of the backlight, in the other region light of another color is emitted concurrently with light emission of the first color in the one region. As described above, the pixel portion is divided into a plurality of regions, and in each region, gamma correction in accordance with the detected image signal of a color tone having the highest brightness and control of the backlight are performed, whereby display is performed by changing color sequentially to display colors different between regions.

In other words, one embodiment of the present invention is a method for driving a liquid crystal display device including pixels arranged in a matrix of m rows by n columns (m and n are natural numbers greater or than equal to 4) and a backlight panel provided behind the pixels. The driving method includes the following steps in an input period of a first color image signal for controlling transmittance of light of a first color for pixels provided in first to A-th rows of the matrix (A is a natural number less than or equal to m/2) and a second color image signal for controlling transmittance of light of a second color for pixels provided in (A+1)-th to 2A-th rows of the matrix. One step consists in treating and outputting the first color image signal for controlling transmittance of light of the first color to the pixels of the first to B-th rows (B is a natural number less than or equal to A/2). The treatment is performed by detecting a first color maximal image signal of a first color tone having the highest brightness from the first color image signal for controlling transmittance of light of the first color of the first to B-th rows with use of a maximum value detection circuit, and by applying gamma correction to the first color image signal so that transmittance of a first pixel for displaying the first color maximal image signal is set to maximum and transmittances of pixels for displaying color tones lower than the first color tone having the highest brightness are decreased in accordance with lowering of the lower color tones. Another step consists in treating and outputting the second color image signal for controlling transmittance of light of the second color to the pixels provided in (A+1)-th to (A+B)-th rows. The treatment is performed by detecting a second color maximal image signal of a second color tone having the highest brightness from the image signal for controlling transmittance of light of the second color input to the pixels of the (A+1)-th to (A+B)-th rows with use of a maximum value detection circuit, and by applying gamma correction to the second color image signal so that transmittance of a second pixel for displaying the second color maximal image signal is set to maximum and transmittances of pixels for displaying color tones lower than the second color tone having the highest brightness are decreased in accordance with lowering of the lower color tones. Then, a step of the driving method following the above steps comprises light emission by the backlight panel for the pixels of the first to B-th rows with light of the first color with an intensity such that a color tone corresponding to the first image signal is displayed by the first pixel, concurrently with light emission by the backlight panel for the pixels in the (A+1)-th to (A+B)-th rows with light of the second color with an intensity such that a color tone corresponding to the second image signal is displayed by the second pixel.

According to the above one embodiment of the present invention, pixels arranged in matrix of m rows by n columns are divided into regions, and a liquid crystal panel is driven by applying a field-sequential method to each region. Further, gamma correction is performed so that transmittance of a liquid crystal element for displaying a color tone having the highest brightness in each region is set to maximum, and light intensity of the backlight is controlled. Thus, image display in which color break is suppressed and quality is increased can be achieved, and in addition, power consumption of the liquid crystal display device can be reduced effectively.

One embodiment of the present invention is a method for driving a liquid crystal display device including pixels arranged in a matrix of m rows by n columns (m and n are natural numbers greater or than equal to 4) and a backlight panel provided behind the pixels. The driving method includes the following steps in an input period of a first color image signal for controlling transmittance of light of a first color of pixels provided in first to A-th rows of the matrix (A is a natural number less than or equal to m/2) and a second color image signal for controlling transmittance of light of a second color of pixels provided in (A+1)-th to 2A-th rows of the matrix. One step consists in treating and outputting the image signal for controlling transmittance of light of the first color to a first region which is one of p (p is a natural number greater than or equal to 2) regions into which the pixels of the first to A-th rows are divided. The treatment is performed by detecting a first image signal of a first color tone having the highest brightness from the image signal for controlling transmittance of light of the first color with use of a maximum value detection circuit, and by applying gamma correction to the first color image signal so that transmittance of a first pixel for displaying the first image signal is set to maximum and transmittances of pixels for displaying color tones lower than the first color tone having the highest brightness are decreased in accordance with lowering of the lower color tones. Another step consists in treating and outputting the image signal for controlling transmittance of light of the second color to a second region which is one of q (q is a natural number greater than or equal to 2) regions in which the pixels in the (A+1)-th to 2A-th rows are divided. The treatment is performed by detecting a second image signal of a second color tone having the highest brightness from the image signal for controlling transmittance of light of the second color with use of the maximum value detection circuit, and by applying gamma correction to the second color image signal so that transmittance of a second pixel for displaying the second image signal is set to maximum and transmittances of pixels for displaying color tones lower than the second color tone having the highest brightness are decreased in accordance with lowering of the lower color tones. Then, a step of the driving method following the above steps consists in emitting light of the first color in the pixels of the p regions so as to display a color tone corresponding to the first image signal in the first pixel having the highest transmittance in the first region with use of a first pulse width modulation circuit connected to light sources lighting the p regions independently, at a duty ratio lower than or equal to $1/(p-1)$, and emitting light of the second color in the pixels of the q regions so as to display a color tone corresponding to the second image signal in the second pixel having the highest transmittance in the second region with use of a second pulse width modulation circuit connected to light sources lighting the q regions independently, at a duty ratio lower than or equal to $1/(q-1)$.

According to the above one embodiment of the present invention, a plurality of pixels arranged in a matrix of m rows by n columns are divided into a plurality of regions, and a liquid crystal panel including the plurality of regions is driven by a field-sequential method. Further, gamma correction is performed so that transmittance of a liquid crystal element for displaying a color tone having the highest brightness in each region is set to maximum, and light intensity of the backlight is controlled. Thus, image display in which color break is suppressed and quality is increased can be achieved, and in addition, power consumption of the liquid crystal display device can be reduced effectively.

Moreover, the liquid crystal display device including a plurality of pixels arranged in matrix of m rows by n columns (m and n are natural numbers greater than or equal to 4) and a backlight provided behind the plurality of pixels can be driven with a small number of power supply circuits; thus, the number of components of the liquid crystal display device can be reduced.

Further, one embodiment of the present invention is a method for driving the liquid crystal display device including a backlight in which an LED (Light Emitting Diode) is employed as a light source.

According to the one embodiment of the present invention, an LED with high response to an input signal and high emission efficiency is employed as a light source of the backlight. Thus, the color break and power consumption can be reduced.

Further, one embodiment of the present invention is a method for driving the liquid crystal display device including a backlight which is turned on and off with a frequency higher than or equal to 100 Hz and lower than or equal to 10 GHz.

According to the one embodiment, the liquid crystal display device can be driven at high speed so that light emitted from the light source used for the backlight is not recognized by human eyes. Thus, a cause of eye strain such as a flicker can be reduced.

According to the liquid crystal display device which is one embodiment of the present invention, input of an image signal and lighting of a backlight are not performed sequentially in the whole pixel portion, but can be performed sequentially in every given region of the pixel portion, simultaneously in every region. Thus, the frequency of input of an image signal to each pixel of the liquid crystal display device can be increased. As a result, display degradation caused in the liquid crystal display device such as color break can be suppressed, and the quality of an image can be improved. In addition, an image signal of a color tone having the highest brightness included in the image signals is detected every given region in the pixel portion, whereby the intensity of light from the backlight source can be controlled precisely. As a result, power consumption of the liquid crystal display device can be reduced effectively.

BEST MODE FOR CARRYING OUT THE INVENTION

Figure 1A:
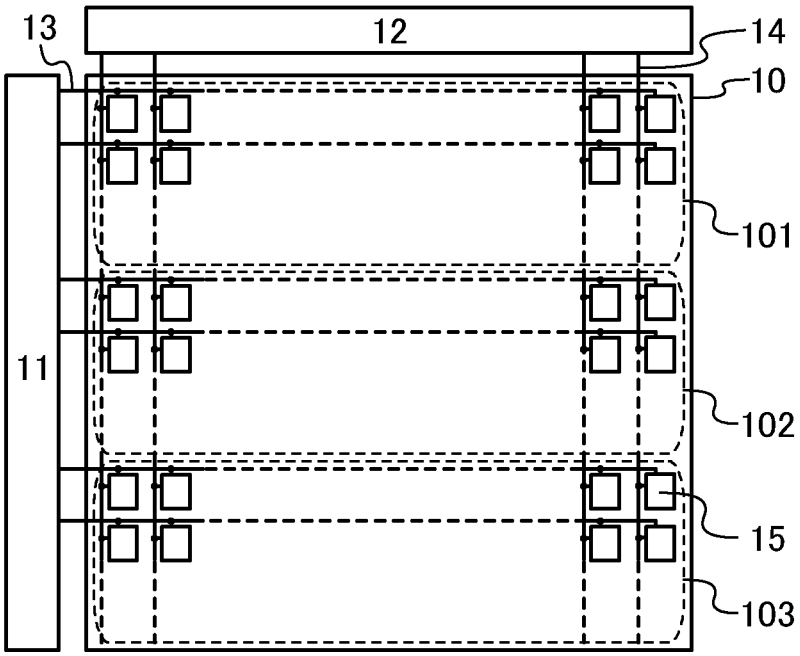
FIG. 1A illustrates a structural example of a liquid crystal display device.

Embodiments will be described in detail with reference to the accompanying drawings. Note that the present invention is not limited to the following description, and it will be easily understood by those skilled in the art that various changes and modifications can be made without departing from the spirit and scope of the invention. Therefore, the present invention should not be construed as being limited to the description in the following embodiments. Note that in the structures of the invention described below, the same portions or portions having similar functions are denoted by the same reference numerals in different drawings, and description of such portions is not repeated.

(Embodiment 1)

In this embodiment, a liquid crystal display device which is one embodiment of the present invention will be described with reference to FIGS. 1A and 1B, FIGS. 2A to 2C, FIGS. 3A to 3D, FIGS. 4A and 4B, FIGS. 5A and 5B, and FIG. 6.

<Structural Example of Liquid Crystal Display Device>

FIG. 1A illustrates a structural example of a liquid crystal display device. The liquid crystal display device illustrated in FIG. 1A includes a pixel portion 10, a scan line driver circuit 11, a signal line driver circuit 12, m scan lines 13 arranged in parallel or in substantially parallel to each other, whose potentials are controlled by the scan line driver circuit 11, and n signal lines 14 arranged in parallel or substantially in parallel to each other, and whose potentials are controlled by the signal line driver circuit 12. The pixel portion 10 is divided into three regions (regions 101 to 103), and each region includes a plurality of pixels arranged in a matrix. Each scan lines 13 is electrically connected to n pixels in each row, among the plurality of pixels arranged in matrix of m rows by n columns in the pixel portion 10. In addition, each signal line 14 is electrically connected to m pixels in each column, among the plurality of pixels arranged in the matrix of the m rows by the n columns.

Figure 1B:
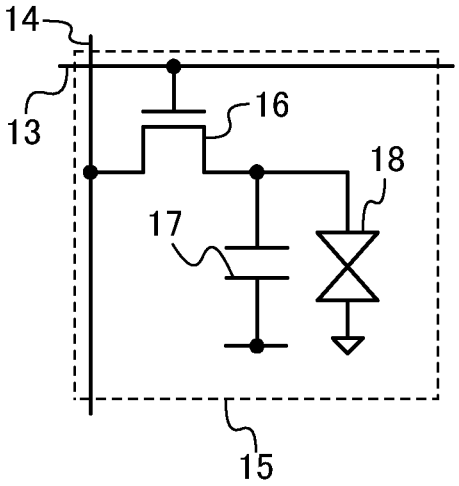
FIG. 1B illustrates a configuration example of a pixel.

FIG. 1B illustrates an example of a circuit configuration of a pixel 15 included in the liquid crystal display device illustrated in FIG. 1A. The pixel 15 in FIG. 1B includes a transistor 16, a capacitor 17, and a liquid crystal element 18. A gate of the transistor 16 is electrically connected to the scan line 13. One of a source and a drain of the transistor 16 is electrically connected to the signal line 14. One electrode of the capacitor 17 is electrically connected to the other of the source and the drain of the transistor 16. The other electrode of the capacitor 17 is electrically connected to a wiring (also referred to as a capacitor line) that supplies a capacitor potential. One electrode (also referred to as a pixel electrode) of the liquid crystal element 18 is electrically connected to the other of the source and the drain of the transistor 16 and the one electrode of the capacitor 17. The other electrode (also referred to as a counter electrode) of the liquid crystal element 18 is electrically connected to a wiring that supplies a counter potential. The transistor 16 is an n-channel transistor. The capacitor potential and the counter potential can be the same potential.

<Structural Example of Scan Line Driver Circuit 11>

Figure 2A:
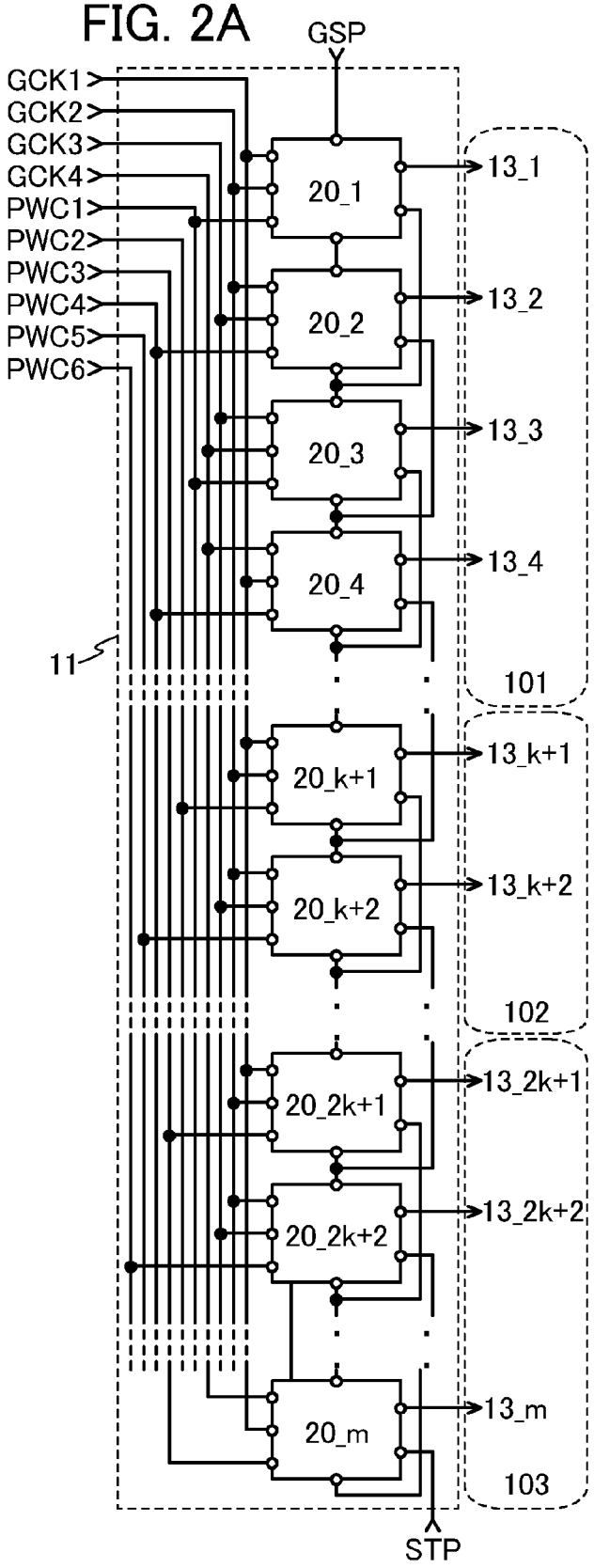
FIG. 2A illustrates a configuration example of a scan line driver circuit.

FIG. 2A illustrates a structural example of the scan line driver circuit 11 included in the liquid crystal display device in FIG. 1A. The scan line driver circuit 11 shown in FIG. 2A includes: wirings for supplying first to fourth clock signals (GCK1 to GCK4) for the scan line driver circuit; wirings for supplying first to sixth pulse-width clock signals (PWC1 to PWC6); and a first pulse output circuit 20_1 which is electrically connected to the scan line 13 in the first row to a m-th pulse output circuit 20_*m* which is electrically connected to the scan line 13 in the m-th row. In this example, the first pulse output circuit 20_1 to the k-th pulse output circuit 20_*k* (k is less than m/2 and a multiples of 4) are electrically connected to the scan lines 13 provided in the region 101; the (k+1)-th pulse output circuit 20_(k+1) to the 2k-th pulse output circuit 20_2k are electrically connected to the scan lines 13 provided in the region 102; and the (2k+1)-th pulse output circuit 20_(2k+1) to the m-th pulse output circuit 20_*m* are electrically connected to the scan lines 13 provided in the region 103. The first pulse output circuit 20_1 to the m-th pulse output circuit 20_*m* are configured to shift a shift pulse sequentially per shift period in response to a start pulse (GSP) for the scan line driver circuit which is input into the first pulse output circuit 20_1. Further, a plurality of shift pulses can be shifted in the first pulse output circuit 20_1 to the m-th pulse output circuit 20_*m* concurrently. That is, even in a period in which a shift pulse is shifted in the first pulse output circuit 20_1 to the m-th pulse output circuit 20_*m*, the start pulse (GSP) can be input to the first pulse output circuit 20_1.

Figure 2B:
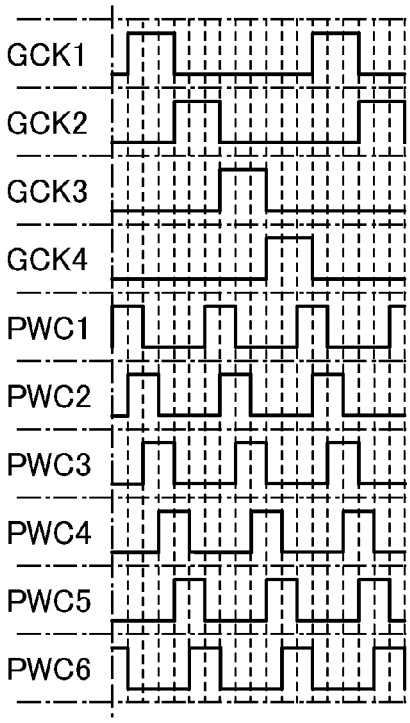
FIG. 2B is a timing chart showing an example of signals for the scan line driver circuit.

FIG. 2B illustrates an example of specific waveforms of the above-described signals. The first clock signal (GCK1) in FIG. 2B periodically repeats a high-level potential (high power supply potential (Vdd)) and a low-level potential (low power supply potential (Vss)), and has a duty ratio of 1/4. Further, the second scan line driver circuit clock signal (GCK2) is shifted from the first scan line driver circuit clock signal (GCK1) by ¼ of its cycle, the third scan line driver circuit clock signal (GCK3) is shifted from the first scan line driver circuit clock signal (GCK1) by ½ of its cycle, and the fourth scan line driver circuit clock signal (GCK4) is shifted from the first scan line driver circuit clock signal (GCK1) by ¾ of its cycle. The first pulse-width control signal (PWC1) periodically repeats the high-level potential (high power supply potential (Vdd)) and the low-level potential (low power supply potential (Vss)), and has a duty ratio of 1/3. The second pulse-width control signal (PWC2) is a signal whose phase is deviated by ⅙ period from the first pulse-width control signal (PWC1); the third pulse-width control signal (PWC3) is a signal whose phase is deviated by ⅓ period from the first pulse-width control signal (PWC1); the fourth pulse-width control signal (PWC4) is a signal whose phase is deviated by ½ period from the first pulse-width control signal (PWC1); the fifth pulse-width control signal (PWC5) is a signal whose phase is deviated by ⅔ period from the first pulse-width control signal (PWC1); and the sixth pulse-width control signal (PWC6) is a signal whose phase is deviated by ⅚ period from the first pulse-width control signal (PWC1). In this example, the ratio of the pulse width of each of the first clock signal (GCK1) to the fourth clock signal (GCK4) to the pulse width of each of the first pulse-width control signal (PWC1) to the sixth pulse-width control signal (PWC6) is 3:2.

In the above-described liquid crystal display device, the same configuration can be applied to the first to m-th pulse output circuits 20_1 to 20_*m*. Note that electrical connections of a plurality of terminals included in the pulse output circuit differ depending on the pulse output circuits. Specific connection relation will be described with reference to FIGS. 2A and 2C.

Each of the first to m-th pulse output circuits 20_1 to 20_*m* has terminals 21 to 27. The terminals 21 to 24 and the terminal 26 are input terminals; the terminals 25 and 27 are output terminals.

First, the terminal 21 is described. The terminal 21 of the first pulse output circuit 20_1 is electrically connected to a wiring for supplying the start signal (GSP). The terminals 21 of the second to m-th pulse output circuits 20_2 to 20_*m* are electrically connected to respective terminals 27 of their previous-stage pulse output circuits.

Next, the terminal 22 is described. The terminal 22 of the (4a-3)-th pulse output circuit (a is a natural number equal to or less than m/4) is electrically connected to the wiring for supplying the first clock signal (GCK1). The terminal 22 of the (4a-2)-th pulse output circuit is electrically connected to the wiring for supplying the second clock signal (GCK2). The terminal 22 of the (4a−1)-th pulse output circuit is electrically connected to the wiring for supplying the third clock signal (GCK3). The terminal 22 of the 4a-th pulse output circuit is electrically connected to the wiring for supplying the fourth clock signal (GCK4).

Then, the terminal 23 is described. The terminal 23 of the (4a-3)-th pulse output circuit is electrically connected to the wiring for supplying the second clock signal (GCK2). The terminal 23 of the (4a-2)-th pulse output circuit is electrically connected to the wiring for supplying the third clock signal (GCK3). The terminal 23 of the (4a−1)-th pulse output circuit is electrically connected to the wiring for supplying the fourth clock signal (GCK4). The terminal 23 of the 4a-th pulse output circuit is electrically connected to the wiring for supplying the first clock signal (GCK1).

Next, the terminal 24 is described. The terminal 24 of the (2b−1)-th pulse output circuit (b is a natural number equal to or less than k/2) is electrically connected to the wiring for supplying the first pulse-width control signal (PWC1). The terminal 24 of the 2b-th pulse output circuit is electrically connected to the wiring for supplying the fourth pulse-width control signal (PWC4). The terminal 24 of the (2c−1)-th pulse output circuit (c is a natural number equal to or greater than k/2+1 and equal to or less than k) is electrically connected to the wiring for supplying the second pulse-width control signal (PWC2). The terminal 24 of the 2c-th pulse output circuit is electrically connected to the wiring for supplying the fifth pulse-width control signal (PWC5). The terminal 24 of the (2d−1)-th pulse output circuit (d is a natural number equal to or greater than k+1 and equal to or less than m/2) is electrically connected to the wiring for supplying the third pulse-width control signal (PWC3). The terminal 24 of the 2d-th pulse output circuit is electrically connected to the wiring for supplying the sixth pulse-width control signal (PWC6).

Then, the terminal 25 is described. The terminal 25 in the x-th pulse output circuit (x is a natural number that is m or less) is electrically connected to the scan line 13_*x* in the x-th row.

Next, the terminal 26 is described. The terminal 26 of the y-th pulse output circuit (y is a natural number equal to and less than m−1) is electrically connected to the terminal 27 of the (y+1)-th pulse output circuit. The terminal 26 of the m-th pulse output circuit is electrically connected to a wiring for supplying a stop signal (STP) for the m-th pulse output circuit. In the case where a (m+1)-th pulse output circuit is provided, the stop signal (STP) for the m-th pulse output circuit corresponds to a signal output from the terminal 27 of the (m+1)-th pulse output circuit. Specifically, the stop signal (STP) for the m-th pulse output circuit can be supplied to the m-th pulse output circuit by the (m+1)-th pulse output circuit provided as a dummy circuit or by inputting the signal directly from the outside.

The connection relation of the terminal 27 in each of the pulse output circuits has been described above. Therefore, the above description is to be referred to.

<Structural Example of Pulse Output Circuit>

Figure 2C:
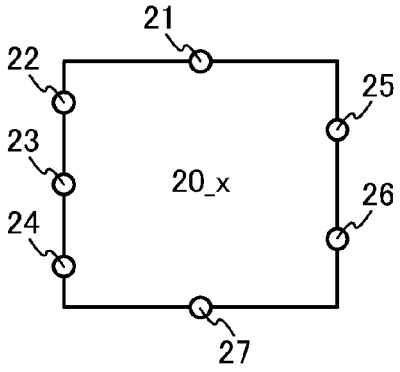
FIG. 2C illustrates a configuration example of a pulse output circuit.
Figure 3A:
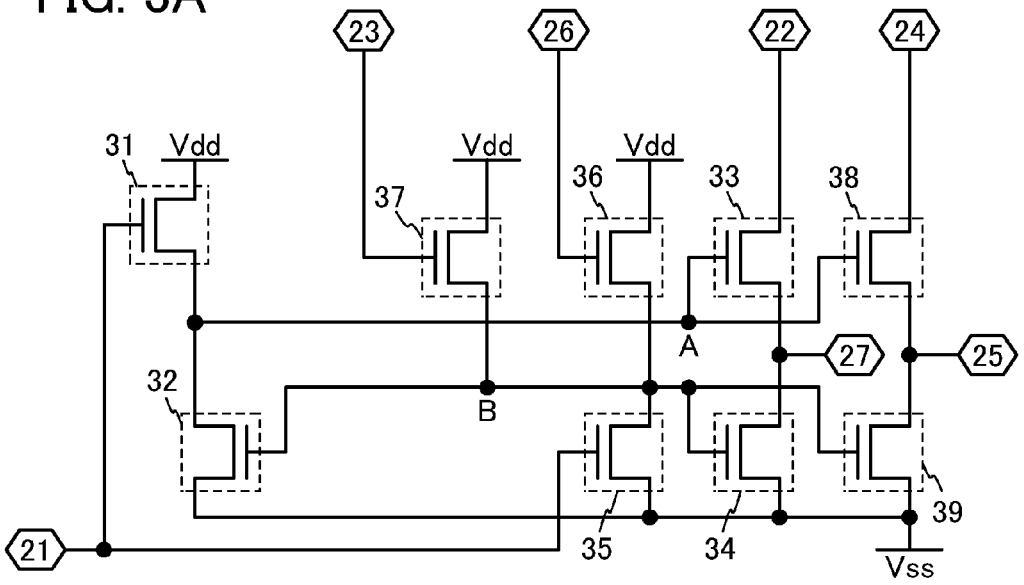
FIG. 3A is a circuit diagram illustrating an example of a pulse output circuit.

FIG. 3A illustrates an example of the configuration of the pulse output circuit illustrated in FIGS. 2A and 2C. A pulse output circuit illustrated in FIG. 3A includes transistors 31 to 39.

One of a source and a drain of the transistor 31 is electrically connected to a wiring that supplies the high power supply potential (Vdd) (hereinafter also referred to as a high power supply potential line). A gate of the transistor 31 is electrically connected to the terminal 21.

One of a source and a drain of the transistor 32 is electrically connected to a wiring that supplies the low power supply potential (Vss) (hereinafter also referred to as a low power supply potential line). The other of the source and the drain of the transistor 32 is electrically connected to the other of the source and the drain of the transistor 31.

One of a source and a drain of the transistor 33 is electrically connected to the terminal 22, the other of the source and the drain of the transistor 33 is electrically connected to the terminal 27, and a gate of the transistor 33 is electrically connected to the other of the source and the drain of the transistor 31 and the other of the source and the drain of the transistor 32.

One of a source and a drain of the transistor 34 is electrically connected to the low power supply potential line, the other of the source and the drain of the transistor 34 is electrically connected to the terminal 27, and a gate of the transistor 34 is electrically connected to a gate of the transistor 32.

One of a source and a drain of the transistor 35 is electrically connected to the low power supply potential line. The other of the source and the drain of the transistor 35 is electrically connected to the gate of the transistor 32 and the gate of the transistor 34. A gate of the transistor 35 is electrically connected to the terminal 21.

One of a source and a drain of the transistor 36 is electrically connected to the high power supply potential line, the other of the source and the drain of the transistor 36 is electrically connected to the gate of the transistor 32, the gate of the transistor 34, and the other of the source and the drain of the transistor 35. A gate of the transistor 36 is electrically connected to the terminal 26. Note that it is possible to employ a structure in which one of the source and the drain of the transistor 36 is electrically connected to a wiring that supplies a power supply potential (Vcc) which is higher than the low power supply potential (Vss) and lower than the high power supply potential (Vdd).

One of a source and a drain of the transistor 37 is electrically connected to the high power supply potential line, the other of the source and the drain of the transistor 37 is electrically connected to the gate of the transistor 32, the gate of the transistor 34, the other of the source and the drain of the transistor 35, and the other of the source and the drain of the transistor 36. A gate of the transistor 37 is electrically connected to the terminal 23. Note that it is possible to employ a structure in which one of the source and the drain of the transistor 37 is electrically connected to a wiring that supplies the power supply potential (Vcc).

One of a source and a drain of the transistor 38 is electrically connected to the terminal 24, the other of the source and the drain of the transistor 38 is electrically connected to the terminal 25, and a gate of the transistor 38 is electrically connected to the other of the source and the drain of the transistor 31, the other of the source and the drain of the transistor 32, and the gate of the transistor 33.

One of a source and a drain of the transistor 39 is electrically connected to the low power supply potential line, the other of the source and the drain of the transistor 39 is electrically connected to the terminal 25, and a gate of the transistor 39 is electrically connected to the gate of the transistor 32, the gate of the transistor 34, the other of the source and the drain of the transistor 35, the other of the source and the drain of the transistor 36, and the other of the source and the drain of the transistor 37.

In the following description, a node where the other of the source and the drain of the transistor 31, the other of the source and the drain of the transistor 32, the gate of the transistor 33, and the gate of the transistor 38 are electrically connected to each other is referred to as a node A; a node where the gate of the transistor 32, the gate of the transistor 34, the other of the source and the drain of the transistor 35, the other of the source and the drain of the transistor 36, the other of the source and the drain of the transistor 37, and the gate of the transistor 39 are electrically connected to each other is referred to as a node B.

<Operation Example of Pulse Output Circuit>

Figure 3B:
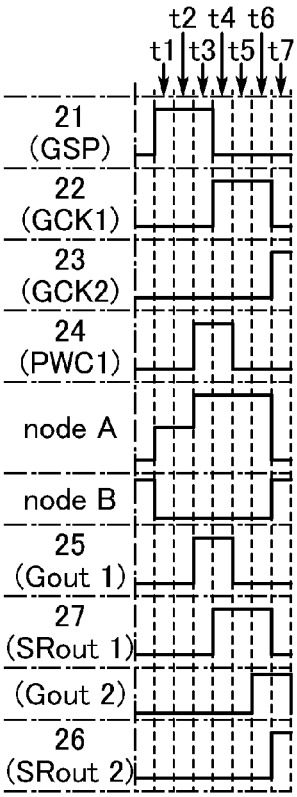
FIGS. 3B to 3D are timing charts each showing an operation example of the pulse output circuit.
Figure 3C:
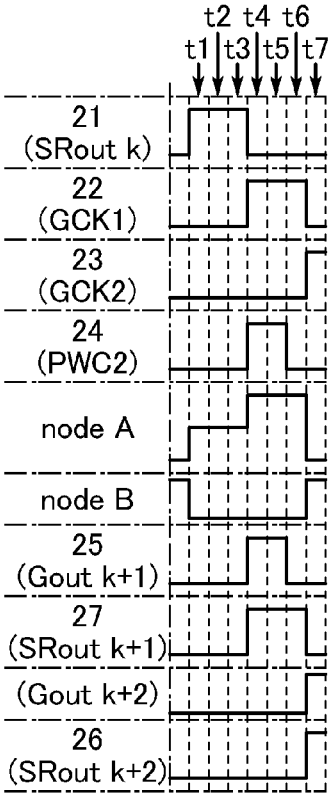
Figure 3D:
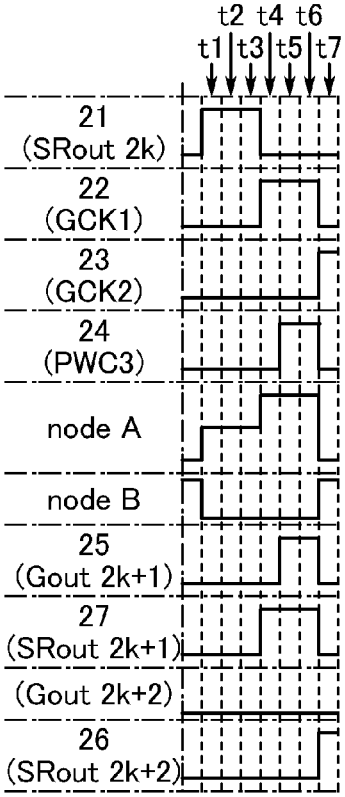

An operation example of the above-described pulse output circuit will be described using FIGS. 3B to 3D. Described in this example is an operation example in the case where timing of inputting the start pulse (GSP) for a scan line driver circuit to the terminal 21 of the first pulse output circuit 20_1 is controlled so that shift pulses are output from the terminals 27 of the first pulse output circuit 20_1, the (k+1)-th pulse output circuit 20_(k+1), and the (2k+1)-th pulse output circuit 20_(2k+1) at the same timing. Specifically, FIG. 3B illustrates potentials of signals input to each terminal in the first pulse output circuit 20_1, and potentials of the node A and the node B when the scan line driver circuit start pulse (GSP) is input. FIG. 3C illustrates potentials of signals input to each terminal in the (k+1)-th pulse output circuit 20_(k+1), and the potentials of the node A and the node B when a high-level potential is input from the k-th pulse output circuit 20_*k*. FIG. 3D illustrates potentials of signals input to each terminal in the (2k+1)-th pulse output circuit 20_(2k+1), and the potentials of the node A and the node B when a high-level potential is input from the 2k-th pulse output circuit 20_2k. In FIGS. 3B to 3D, the signals which are input to the terminals are each provided in parentheses. In addition, the signal (Gout 2, Gout k+1, Gout 2k+2) which is output from the terminal 25 of the subsequent-stage pulse output circuit (the second pulse output circuit 20_2, the (k+2)-th pulse output circuit 20_(k+2), the (2k+2)-th pulse output circuit 20 (2k+2)), and the output signal of the terminal 27 of the subsequent-stage pulse output circuit (SRout 2: input signal of the terminal 26 of the first pulse output circuit 20_1, SRout k+2: input signal of the terminal 26 of the (k+1)-th pulse output circuit 20_(k+1), SRout 2k+2: input signal of the terminal 26 of the (2k+1)-th pulse output circuit 20 (2k+1)) are also shown. Note that in FIGS. 3B to 3D, "Gout" represents an output signal from the pulse output circuit to a scan line, and "SRout" represents an output signal from the pulse output circuit to the subsequent-stage pulse output circuit.

First, using FIG. 3B, the case where the high-level potential is input as the start pulse (GSP) for a scan line driver circuit to the first pulse output circuit 20_1 is described below.

In a period t1, the high-level potential (high power supply potential (Vdd)) is input to the terminal 21. Thus, the transistors 31 and 35 are turned on. As a result, the potential of the node A is increased to a high-level potential (a potential that is decreased from the high power supply potential (Vdd) by the threshold voltage of the transistor 31), and the potential of the node B is decreased to the low power supply potential (Vss), so that the transistors 33 and 38 are turned on and the transistors 32, 34, and 39 are turned off. Thus, in the period t1, a signal output from the terminal 27 is a signal input to the terminal 22, and a signal output from the terminal 25 is a signal input to the terminal 24. In this example, in the period t1, both the signal input to the terminal 22 and the signal input to the terminal 24 are the low power supply potential (Vss). Accordingly, in the period t1, the first pulse output circuit 20_1 outputs a low-level potential (low power supply potential (Vss)) to the terminal 21 of the second pulse output circuit 20_2 and the scan line in the first row in the pixel portion.

In a period t2, the levels of the signals input to the terminals are the same as in the period t1. Therefore, the potentials of the signals output from the terminals 25 and 27 are also not changed: the low-level potentials (low power supply potentials (Vss)) are output.

In a period t3, a high-level potential (high power supply potential (Vdd)) is input to the terminal 24. Note that the potential of the node A (potential of the source of the transistor 31) is increased to a high-level potential (potential which is decreased from the high power supply potential (Vdd) by the threshold voltage of the transistor 31) in the period t1. Therefore, the transistor 31 is off. The input of the high-level potential (high power supply potential (Vdd)) to the terminal 24 causes a further increase of the potential of the node A (the potential of the gate of the transistor 38) by capacitive coupling of the source and the gate of the transistor 38 (bootstrapping). Owing to the bootstrapping, the potential of the signal output from the terminal 25 is not decreased from the high-level potential (high power supply potential (Vdd)) input to the terminal 24. Accordingly, in the period t3, the first pulse output circuit 20_1 outputs a high-level potential (high power supply potential (Vdd)=a selection signal) to the scan line in the first row in the pixel portion.

In a period t4, a high-level potential (high power supply potential (Vdd)) is input to the terminal 22. As a result, since the potential of the node A has been increased by the bootstrapping, the potential of the signal output from the terminal 27 is not decreased from the high-level potential (high power supply potential (Vdd)) input to the terminal 22. Accordingly, in the period t4, the terminal 27 outputs the high-level potential (high power supply potential (Vdd)) which is input to the terminal 22. That is, the first pulse output circuit 20_1 outputs a high-level potential (high power supply potential (Vdd)=a shift pulse) to the terminal 21 of the second pulse output circuit 20_2. In the period t4 also, the signal input to the terminal 24 is kept at the high-level potential (high power supply potential (Vdd)), so that the signal output to the scan line in the first row in the pixel portion from the first pulse output circuit 20_1 is kept at the high-level potential (high power supply potential (Vdd)=the selection signal). Further, a low-level potential (low power supply potential (Vss)) is input to the terminal 21 to turn off the transistor 35, which does not directly influence the output signals of the first pulse output circuit in the period t4.

In a period t5, a low-level potential (low power supply potential (Vss)) is input to the terminal 24. In that period, the transistor 38 keeps to be on. Accordingly, in the period t5, the first pulse output circuit 20_1 outputs a low-level potential (low power supply potential (Vss)) to the scan line in the first row in the pixel portion.

In a period t6, the levels of the signals input to the terminals are the same as in the period t5. Therefore, the potentials of the signals output from the terminals 25 and 27 are also not changed: the low-level potential (low power supply potentials (Vss)) is output from the terminal 25 and the high-level potential (high power supply potential (Vdd)=the shift pulse) is output from the terminal 27.

In a period t7, the high-level potential (high power supply potential (Vdd)) is input to the terminal 23. Thus, the transistor 37 is turned on. As a result, the potential of the node B is increased to a high-level potential (a potential that is decreased from the high power supply potential (Vdd) by the threshold voltage of the transistor 37), so that the transistors 32, 34, and 39 are turned on. The potential of the node A is decreased to the low-level potential (low power supply potential (Vss)) accordingly, so that the transistors 33 and 38 are turned off. Thus, in the period t7, both of the signals output from the terminals 25 and 27 are the low power supply potential (Vss). That is, in the period t7, the first pulse output circuit 20_1 outputs the low power supply potential (Vss) to the terminal 21 of the second pulse output circuit 20_2 and the scan line in the first row in the pixel portion.

Next, using FIG. 3C, the case where a high-level potential is input as a shift pulse from the k-th pulse output circuit 20_*k* to the terminal 21 of the (k+1)-th pulse output circuit 20_(k+1) is described below.

In a period t1 and a period t2, the operation of the (k+1)-th pulse output circuit 20_(k+1) is performed in a manner similar to that of the first pulse output circuit 20_1. Therefore, the above description is to be referred to.

In a period t3, the levels of the signals input to the terminals are the same as in the period t2. Therefore, the potentials of the signals output from the terminals 25 and 27 are also not changed: the low-level potentials (low power supply potentials (Vss)) are output.

In a period t4, high-level potentials (high power supply potentials (Vdd)) are input to the terminals 22 and 24. Note that the potential of the node A (potential of the source of the transistor 31) is increased to a high-level potential (potential which is decreased from the high power supply potential (Vdd) by the threshold voltage of the transistor 31) in the period t1. Therefore, the transistor 31 is off in the period t1. The input of the high-level potentials (high power supply potentials (Vdd)) to the terminals 22 and 24 causes a further increase of the potential of the node A (the potential of the gate of the transistor 33 and the gate of the transistor 38) by capacitive coupling of the source and the gate of the transistor 33 and the source and the gate of the transistor 38 (bootstrapping). Owing to the bootstrapping, the potentials of the signals output from the terminals 25 and 27 are not decreased from the high-level potentials (high power supply potentials (Vdd)) input to the terminals 22 and 24, respectively. Thus, in the period t4, the (k+1)-th pulse output circuit 20_(k+1) outputs the high-level potential (high power supply potential (Vdd)=selection signal, shift pulse) to the scan line provided in the (k+1)-th row in the pixel portion and the terminal 21 in the (k+2)-th pulse output circuit 20_(k+2).

In a period t5, the levels of the signals input to the terminals are the same as in the period t4. Therefore, the potentials of the signals output from the terminals 25 and 27 are also not changed: the high-level potentials (high power supply potentials (Vdd)=the selection signal and the shift pulse) are output.

In a period t6, a low-level potential (low power supply potential (Vss)) is input to the terminal 24. In that period, the transistor 38 keeps being on. Therefore, in the period t6, a signal output from the (k+1)-th pulse output circuit 20_(k+1) to the scan line provided in the (k+1)-th row in the pixel portion is the low-level potential (low power supply potential (Vss)).

In a period t7, the high-level potential (high power supply potential (Vdd)) is input to the terminal 23. Thus, the transistor 37 is turned on. As a result, the potential of the node B is increased to a high-level potential (a potential that is decreased from the high power supply potential (Vdd) by the threshold voltage of the transistor 37), so that the transistors 32, 34, and 39 are turned on. The potential of the node A is decreased to the low-level potential (low power supply potential (Vss)) accordingly, so that the transistors 33 and 38 are turned off. Thus, in the period t7, both of the signals output from the terminals 25 and 27 are the low power supply potential (Vss). That is, in the period t7, the (k+1)-th pulse output circuit 20_(k+1) outputs the low power supply potential (Vss) to the terminal 21 of the (k+2)-th pulse output circuit 20_(k+2) and the scan line in the (k+1)-th row in the pixel portion.

Next, using FIG. 3D, the case where a high-level potential is input as a shift pulse from the 2k-th pulse output circuit 20_2k to the terminal 21 in the (2k+1)-th pulse output circuit 20_(2k+1) is described below.

In periods t1 to t3, the operation of the (2k+1)-th pulse output circuit 20_(2k+1) is performed in a manner similar to that of the (k+1)-th pulse output circuit 20_(k+1). Therefore, the above description is to be referred to.

In a period t4, a high-level potential (high power supply potential (Vdd)) is input to the terminal 22. Note that the potential of the node A (potential of the source of the transistor 31) is increased to a high-level potential (potential which is decreased from the high power supply potential (Vdd)) by the threshold voltage of the transistor 31) in the period t1. Therefore, the transistor 31 is off in the period t1. The input of the high-level potential (high power supply potential (Vdd)) to the terminal 22 causes a further increase of the potential of the node A (the potential of the gate of the transistor 33) by capacitive coupling of the source and the gate of the transistor 33 (bootstrapping). Owing to the bootstrapping, the potential of the signal output from the terminal 27 is not decreased from the high-level potentials (high power supply potential (Vdd)) input to the terminal 22. Accordingly, in the period t4, the (2k+1)-th pulse output circuit 20_(2k+1) outputs a high-level potential (high power supply potential (Vdd)=shift pulse) to the terminal 21 of the (2k+2)-th pulse output circuit 20_(2k+2). Further, a low-level potential (low power supply potential (Vss)) is input to the terminal 21 to turn off the transistor 35, which does not directly influence the output signals of the (2k+1)-th pulse output circuit 20_(2k+1) in the period t4.

In a period t5, a high-level potential (high power supply potential (Vdd)) is input to the terminal 24. As a result, since the potential of the node A has been increased by the bootstrapping, the potential of the signal output from the terminal 25 is not decreased from the high-level potential (high power supply potential (Vdd)) input to the terminal 24. Therefore, in the period t5, the high-level potential (high power supply potential (Vdd)) to be input to the terminal 22 is output from the terminal 25. In other words, the (2k+1)-th pulse output circuit 20_(2k+1) outputs the high-level potential (high power supply potential (Vdd)=selection signal) to the scan line provided in the (2k+1)-th row in the pixel portion. In the period t5 also, the signal input to the terminal 22 is kept at the high-level potential (high power supply potential (Vdd)), so that the signal output from the (2k+1)-th pulse output circuit 20_(2k+1) to the output terminal 21 of the (2k+2)-th pulse output circuit 20_(2k+2) is kept at the high-level potential (high power supply potential (Vdd)=shift pulse).

In a period t6, the levels of the signals input to the terminals are the same as in the period t5. Therefore, the potentials of the signals output from the terminals 25 and 27 are also not changed: the high-level potentials (high power supply potentials (Vdd)=the selection signal and the shift pulse) are output.

In a period t7, the high-level potential (high power supply potential (Vdd)) is input to the terminal 23. Thus, the transistor 37 is turned on. As a result, the potential of the node B is increased to a high-level potential (a potential that is decreased from the high power supply potential (Vdd) by the threshold voltage of the transistor 37), so that the transistors 32, 34, and 39 are turned on. The potential of the node A is decreased to the low-level potential (low power supply potential (Vss)) accordingly, so that the transistors 33 and 38 are turned off. Thus, in the period t7, both of the signals output from the terminals 25 and 27 are the low power supply potential (Vss). That is, in the period t7, the (k+1)-th pulse output circuit 20_(k+1) outputs the low power supply potential (Vss) to the terminal 21 of the (k+2)-th pulse output circuit 20_(k+2) and the scan line in the (k+1)-th row in the pixel portion.

As illustrated in FIGS. 3B to 3D, the input timing of the start pulse (GSP) for the scan line driver circuit is controlled in the first to m-th pulse output circuits 20_1 to 20_*m*, whereby a plurality of shift pulses can be shifted concurrently. Specifically, after the start pulse (GSP) is input, another start pulse (GSP) is input at the same timing as the output of a shift pulse from the terminal 27 in the k-th pulse output circuit 20_*k*, whereby shift pulses can be output at the same timing from the first pulse output circuit 20_1 and (k+1)-th pulse output circuit 20_(k+1). Then, in a similar manner, another start pulse (GSP) can be further input, whereby shift pulses can be output from the first pulse output circuit 20_1, the (k+1)-th pulse output circuit 20_(k+1), and the (2k+1)-th pulse output circuit 20_(2k+1) at the same timing.

In addition, the first pulse output circuit 20_1, the (k+1)-th pulse output circuit 20_(k+1), and the (2k+1)-th pulse output circuit 20_(2k+1) can supply selection signals to respective scan lines at different timings in parallel to the above-described operation. That is, with the above scan line driver circuit, a plurality of shift pulses having specific periods can be shifted in parallel, and a plurality of pulse output circuits to which shift pulses are input at the same timing can supply selection signals to their respective scan lines at different timings.

<Structural Example of Signal Line Driver Circuit 12>

Figure 4A:
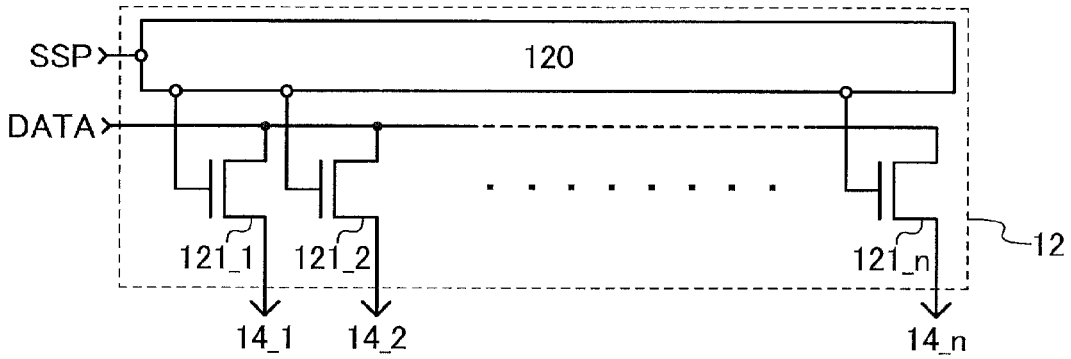
FIG. 4A illustrates a configuration example of a signal line driver circuit.

FIG. 4A illustrates a structural example of the signal line driver circuit 12 included in the liquid crystal display device in FIG. 1A. The signal line driver circuit 12 included in FIG. 4A includes a shift register 120 having first to n-th output terminals, a wiring for supplying an image signal (DATA), and transistors 121_1 to 121_*n*. One of a source and a drain of the transistor 121_1 is electrically connected to the wiring for supplying the image signal (DATA), the other of the source and the drain thereof is electrically connected to a signal line 14_1 in the first column in the pixel portion, and a gate thereof is electrically connected to a first output terminal of the shift register 120. One of a source and a drain of the transistor 121_*n* is electrically connected to the wiring for supplying the image signal (DATA), the other thereof is electrically connected to a signal line 14_*n* in the n-th column in the pixel portion, and a gate thereof is electrically connected to the n-th output terminal of the shift register 120. The shift register 120 outputs high-level potentials from the first to n-th output terminals sequentially every shift period in response to a start pulse for a signal line driver circuit (SSP). That is, the transistors 121_1 to 121_*n* are sequentially turned on every shift period.

Figure 4B:
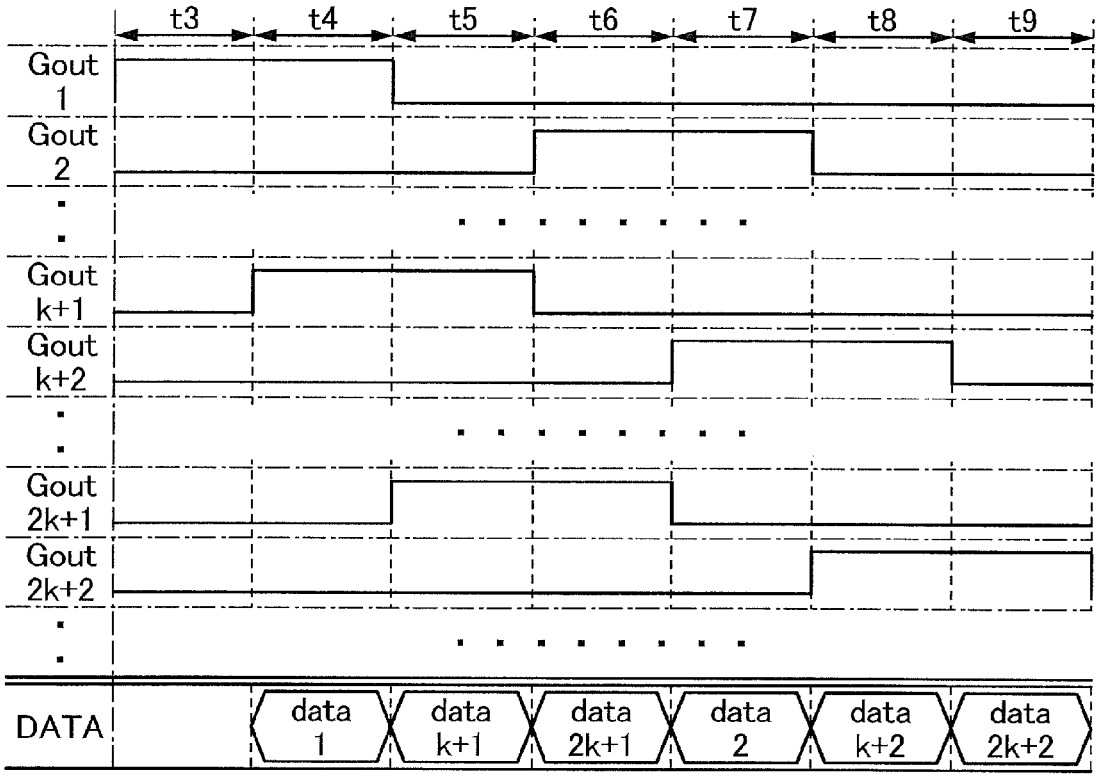
FIG. 4B illustrates an operation example of the signal line driver circuit.

FIG. 4B illustrates an example of a timing of an image signal supplied by the wiring which supplies an image signal (DATA). As illustrated in FIG. 4B, the wiring for supplying the image signal (DATA) supplies a pixel image signal for the first row (data 1) in the period t4, a pixel image signal for the (k+1)-th row (data k+1) in the period t5, a pixel image signal for the (2k+1)-th row (data 2k+1) in the period t6, and a pixel image signal for the second row (data 2) in the period t7. In this manner, the wiring for supplying the image signal (DATA) supplies pixel image signals for respective rows sequentially. Specifically, image signals are supplied in the following order: the pixel image signal for the s-th row (s is a natural number less than k)→the pixel image signal for the (k+s)-th row→the pixel image signal for the (2k+s)-th row→the pixel image signal for the (s+1)-th row. According to the above-described operation of the scan line driver circuit and the signal line driver circuit, image signals can be input to the pixels in three rows in the pixel portion every shift period of the pulse output circuit in the scan line driver circuit.

<Structural Example of Backlight and Driver Circuit of Backlight>

Figure 5A:
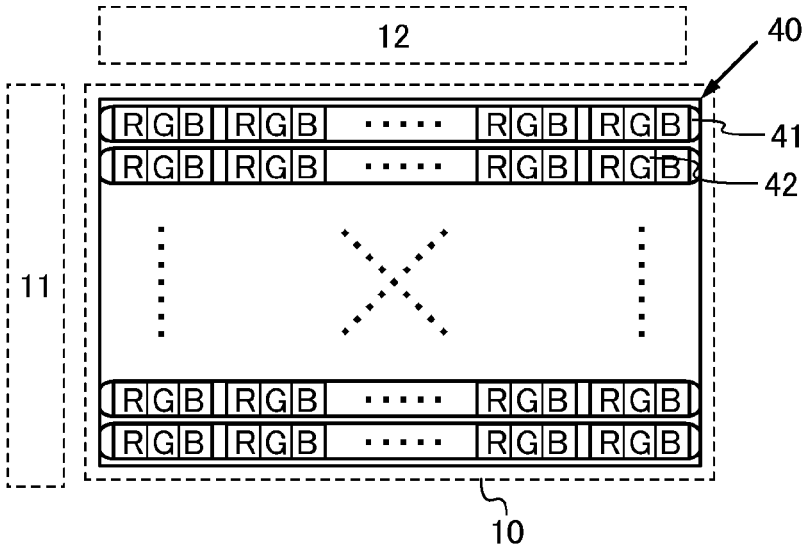
FIGS. 5A and 5B illustrate a structural example of a backlight.
Figure 5B:
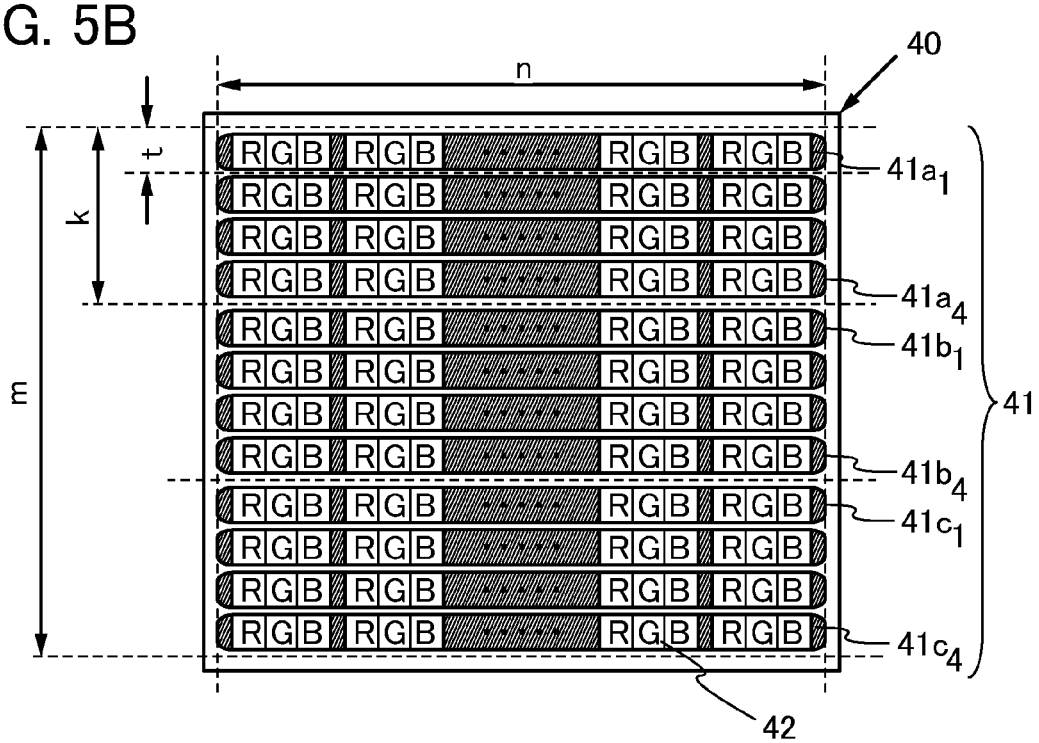

FIGS. 5A and 5B illustrate a configuration example of a backlight panel 40 provided behind the pixel portion 10 in the liquid crystal display device illustrated in FIG. 1A. The backlight panel 40 illustrated in FIG. 5A includes a plurality of backlight arrays 41 arranged in the column direction, and in each backlight array 41, a plurality of backlight units 42 each including light sources emitting light of three colors of red (R), green (G), and blue (B) are arranged. Note that the plurality of backlight units 42 may be arranged in matrix, for example, behind the pixel portion 10 as long as lighting of the backlight units 42 can be controlled every given region.

As the light source used in the backlight unit 42, a light-emitting element with high emission efficiency such as a light-emitting diode (LED), or an organic light-emitting diode is preferably used.

FIG. 5B illustrates a positional relation of the plurality of pixels 15 which are arranged in m rows by n columns but not illustrated and the backlight panel 40 provided behind the pixels. In the backlight panel, at least one backlight array 41 is provided for each group of t rows (here, t is k/4). Each backlight array 41 is used for substantially uniform irradiation of the pixels 15 in every region of t rows by n columns. Note that there is no limitation in arranging the backlight units 42 included in the backlight array 41 as long as substantially uniform irradiation of the plurality of pixels 15 can be performed in every region of t rows by n columns.

The backlight arrays 41 can emit light independently. In other words, the backlight panel 40 includes a plurality of backlight arrays 41, here, e.g., backlight arrays 41*a* (including a backlight array 41$a_1$ to a backlight array 41$a_4$), backlight arrays 41*b* (including a backlight array 41$b_1$ to a backlight array 41$b_4$), and backlight arrays 41*c* (including a backlight array 41$c_1$ to a backlight array 41$c_4$). For example, the backlight array 41$a_1$ is extended for the first to t-th rows, and the backlight array 41$c_4$ is extended for the (2k+3t+1)-th to m-th rows. Each backlight array can emit light independently. Moreover, in each backlight array, light sources for emitting light of colors of red (R), green (G), and blue (B) can independently emit light. That is, in any one of the backlight arrays 41, one light source emitting light of any one of colors of red (R), green (G), and blue (B) emits light, whereby a given region in the pixel portion 10 can be irradiated with the light of any one of red (R), green (G), and blue (B).

Note that the pixel portion 10 may have the following structure: the pixel portion 10 can be irradiated with light of chromatic color which is formed by mixture of two kinds of color of light by emission of light sources which emit light of two colors of red (R), green (G), and blue (B), and the pixel portion 10 can be irradiated with light of white (W) which is formed by mixture of three kinds of colors of light by emission of all light sources which emit light of colors of red (R), green (G), and blue (B).

In the case where a light-emitting element such as an LED or an OLED is used as a light source for the backlight unit 42, emission efficiency of the light-emitting element changes depending on applied power. In this embodiment, power for making a light-emitting element such as an LED or an OLED emit light with high efficiency is supplied in a pulsed manner, and the duty ratio is controlled, so that emission intensity is controlled. As a result, driving with optimal condition can be achieved without loss of emission efficiency of the light-emitting element such as an LED or an OLED, and power consumption can be reduced.

Further, the backlight unit 42 is driven with pulsed power, whereby an increase in temperature of the light-emitting element can be suppressed. Thus, a problem of increase in temperature of the light-emitting element such as an LED or an OLED, which is caused by supplying power continuously and results in a decrease in emission efficiency, can be avoided.

Figure 16:
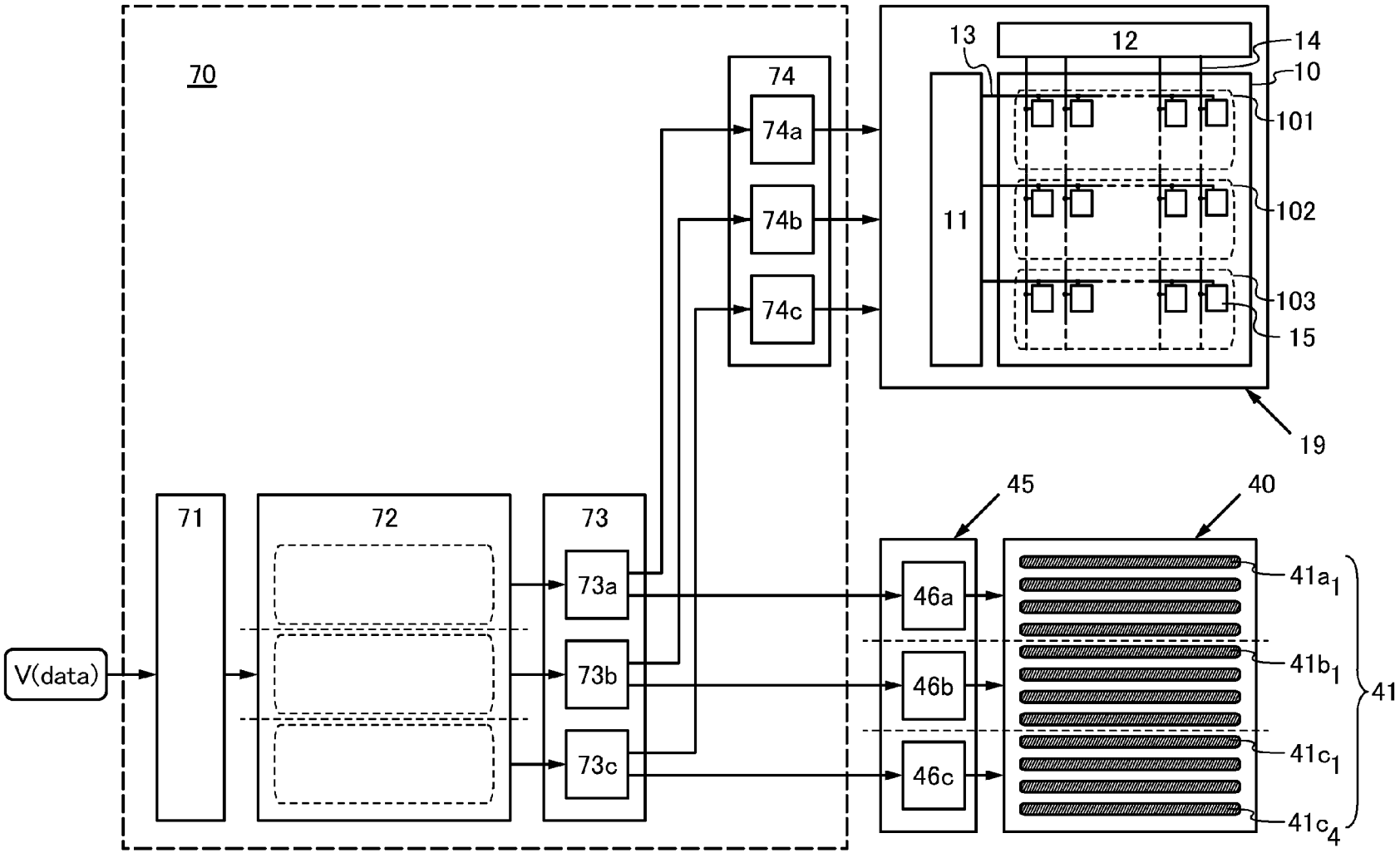
FIG. 16 illustrates a structure of a liquid crystal display device.

FIG. 16 illustrates an example of a structure in which the backlight panel 40 is driven with use of a pulse width modulation (PWM) circuit. A backlight driver circuit 45 includes three pulse width modulation circuits (46*a*, 46*b*, and 46*c*), and the pulse width modulation circuits supply power to respective four backlight arrays 41, so that an emission color and emission intensity are controlled. By using the pulse width modulation circuit, power with which the light-emitting element emits light with high efficiency can be supplied in a pulsed manner to the backlight panel 40. Note that the emission intensity may be controlled by change of the duty ratio. For example, an LED can be driven with an ultra high frequency (e.g., 1 GHz) because of high-speed response to an input signal. For example, an LED can be driven with a supply of 10 pulses during a period of a one-pulse signal for driving a liquid crystal element.

Note that a method for controlling emission intensity can be employed as appropriate, depending on a type of a light source used in the backlight unit 42.

<Structural Example of Image Processing Circuit>

An example of a structure in which an image signal V (data) input to the liquid crystal display device is output to a liquid crystal panel 19 and the backlight panel 40 via an image processing circuit 70 is described with reference to FIG. 16.

The image processing circuit 70 includes an AD converter 71 which converts the image signal V (data) into a digital signal, a frame memory 72 which stores at least an image for one screen included in the image signal, a maximum value detection circuit 73, and a gamma correction circuit 74. The maximum value detection circuit 73 analyzes brightness of given colors in respective regions in display image and detects the maximum values of the color tones. The gamma correction circuit 74 performs gamma correction so that the liquid crystal element can have the highest transmittance in accordance with the detected maximum value of the color tone and transmittance of pixels can be decreased in accordance with lowering of the color tone. Brightness of the backlight is controlled in accordance with the maximum value of the color tone detected by the maximum value detection circuit 73, and such a backlight is used for the liquid crystal element subjected to gamma correction, so that display corresponding to the image data can be performed. The pixels 15 provided in the liquid crystal panel 19 are driven with use of the image data corrected for every region by the gamma correction circuit 74.

The image processing circuit 70 is connected to the backlight panel 40 via the backlight driver circuit 45.

Operation of the image processing circuit 70 is described. In the operation, the image processing circuit 70 divides the image signal V (data) into signals for a first region (in first to k-th rows), a second region (in (k+1)-th to 2k-th rows), and a third region (in (2k+1)-th to m-th rows) of the liquid crystal panel 19, outputs the image data into the regions, and outputs a control signal to the backlight panel 40. Note that the divided position of the image signal V (data) is denoted by the row number of the pixel provided in parentheses for each region, where the image signal V (data) is displayed.

The maximum value detection circuit 73 includes a first maximum value detection circuit 73*a* which detects the maximum values of color tones in the image data displayed in the first region (in first to k-th rows), a second maximum value detection circuit 73*b* which detects the maximum values of color tones in the image data displayed in the second region (in (k+1)-th to 2k-th rows), and a third maximum value detection circuit 73*c* which detects the maximum values of color tones in the image data displayed in the third region (in (2k+1)-th to m-th rows). The gamma correction circuit 74 includes a first gamma correction circuit 74*a* which performs gamma correction on the image data displayed in the first region (in first to k-th rows), a second gamma correction circuit 74*b* which performs gamma correction on the image data displayed in the second region (in (k+1)-th to 2k rows), and a third gamma correction circuit 74*c* which performs gamma correction on the image data displayed in the third region (in (2k+1)-th to m-th rows).

The input image signal V (data) is converted into digital image data by the AD converter 71 and stored in the frame memory 72. Next, the first maximum value detection circuit 73*a*, the second maximum value detection circuit 73*b*, and the third maximum value detection circuit 73*c* detect the maximum values of color tones of the image data displayed in the respective regions. Then, the maximum value detection circuits output the detected maximum values of color tones to the gamma correction circuits and the pulse width modulation circuits corresponding to the respective regions.

For example, in the case where the first maximum value detection circuit 73*a* detects that the level of color tone which has the highest brightness is 128 among 256 tone scale, from the red (R) image data displayed on the pixels in first to t-th rows in the first region (in first to k-th rows), the first maximum value detection circuit 73*a* outputs the tone level 128 to the first gamma correction circuit 74*a* and the first pulse width modulation circuit 46*a*.

By the first gamma correction circuit 74*a*, the image data for the first to t-th rows in the first region (in first to k-th rows) is subjected to gamma correction and output so that the transmittance of the liquid crystal element provided in the pixel where the tone level 128 is detected can be the highest value, and transmittance of the other pixels is decreased in accordance with lowering of the color tone.

The first pulse width modulation circuit 46*a* in the backlight driver circuit 45 modulates the pulse width and make the red light source in the backlight array $\mathbf{41}a_1$ emit light so that the pixel including the liquid crystal element with the highest transmittance can be lit with light expressing the tone level 128 of red (R). Thus, the light is incident on the pixels of the first to t-th rows in the first region (in first to k-th rows) of the liquid crystal panel 19.

In such a manner, the pixels of the first to t-th rows in the first region (in first to k-th rows) can display red (R) color with the tone level 128. Since the liquid crystal element in the pixel with red (R) color with the tone level 128 has the highest transmittance, waste in energy emitted by the backlight array $\mathbf{41}a_1$ can be suppressed. Further, the first maximum value detection circuit 73*a* detects the highest luminance from the restricted range of the first to t-th rows in the first region (in first to k-th rows). Thus, even if a color tone level higher than the tone level 128 is detected in another region in the whole screen, emission intensity of the backlight array $\mathbf{41}a_1$ can be suppressed: accordingly, power consumption can be reduced.

Note that in a manner similar to the above method, the second maximum value detection circuit 73*b* analyzes a blue (B) color image data displayed on the pixels of the (k+1)-th to (k+t)-th rows in the second region (in (k+1)-th to 2k-th rows), and the third maximum value detection circuit 73*c* analyzes a green (G) image data displayed on the pixels of the (2k+1)-th to (2k+t)-th rows in the third region (in (2k+1)-th to m-th rows). Then, the second maximum value detection circuit 73*b* and the third maximum value detection circuit 73*c* output the analysis results to the gamma correction circuit 74*b* and the gamma correction circuit 74*c* respectively, and the pulse width modulation circuit 46*b* and the pulse width modulation circuit 46*c* respectively. As a result, emission intensity of the backlight arrays can be optimized in respective regions, and accordingly power consumption can be reduced.

<Operation Example of Liquid Crystal Display Device>

Figure 6:
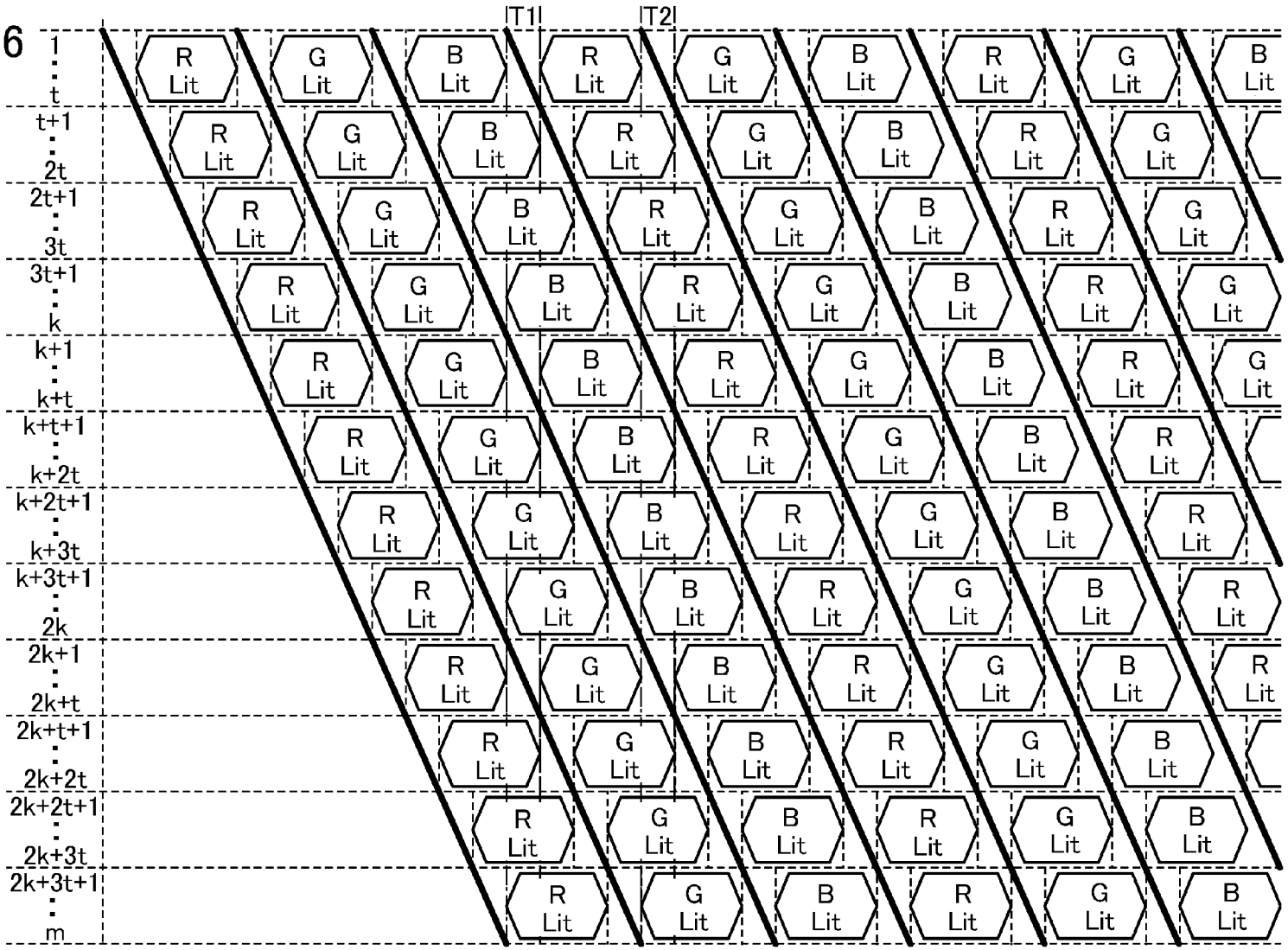
FIG. 6 illustrates an operation example of a liquid crystal display device.

FIG. 6 is a diagram for showing scan of a selection signal and the lighting timing of the backlight array $\mathbf{41}a_1$ for the first to t-th rows to the backlight array $\mathbf{41}c_4$ for the (2k+3t+1)-th to m-th rows in the backlight, in the above liquid crystal display device. Note that in FIG. 6, the vertical axis represents rows (first to m-th rows) in the pixel portion, and the horizontal axis represents time. As shown in FIG. 6, in the liquid crystal display device, selection signals can be supplied to the scan lines in the first to the m-th rows sequentially not in the row order but every (k+1) rows (e.g., in the following order: the scan line in the first row→the scan line in the (k+1)-th row→the scan line in the (2k+1)-th row→the scan line in the second row). Therefore, in a period T1, the n pixels in the first row to the n pixels in the t-th row are sequentially selected, the n pixels in the (k+1)-th row to the n pixels in the (k+t)-th row are sequentially selected, and the n pixels in the (2k+1)-th row to the n pixels in the (2k+t)-th row are sequentially selected, so that image signals can be input to the pixels. Note that here, an image signal for controlling red (R) light transmission is input to the n pixels provided in the first row to the n pixels provided in the t-th row, an image signal for controlling blue (B) light transmission is input to the n pixels provided in the (k+1)-th row to the n pixels provided in the (k+t)-th row, and an image signal for controlling green (G) light transmission is input to the n pixels provided in the (2k+1)-th row to the n pixels provided in the (2k+t)-th row.

In the liquid crystal display device as illustrated in FIG. 6, lighting of the backlight arrays is performed in a period which is provided between periods in which an image signal is written in a given area. Specifically, in a period provided between the period T1 and a period T2, the red (R) light source in the backlight array 41$a_1$ for the first to t-th rows is lit, the blue (B) light source in the backlight array 41$b_1$ for the (k+1)-th to (k+t)-th rows is lit, and the green (G) light source in the backlight array 41$c_1$ for the (2k+1)-th to (2k+t)-th rows is lit. Note that in the liquid crystal display device, as illustrated in FIG. 6, one image is formed in the pixel portion by a series of operations which starts by input of an image signal for controlling red (R) light transmission and ends by lighting of the blue (B) light source in the backlight array.

As a method for lighting the red (R) light source of the backlight array 41$a_1$ for the first to t-th rows in a period provided between the period T1 and the period T2, description in the above <Structural Example of Image Processing Circuit> can be referred to; thus, the description thereof is omitted here.

Next, the detail of a method in which the pulse width modulation circuit drives the plurality of backlight arrays is described by taking operation of the first pulse width modulation circuit 46*a* in the period T1 as an example, with reference to FIGS. 5A and 5B, FIG. 6, and FIG. 16. The first pulse width modulation circuit 46*a* is connected to four backlight arrays, the backlight arrays 41$a_1$ to 41$a_4$. In this embodiment, the first region (in first to k-th rows) is divided into four. The backlight array 41$a_1$ is used for irradiation of the first to t-th rows, the backlight array 41$a_2$ is used for irradiation of the (t+1)-th to 2t-th rows, the backlight array 41$a_3$ is used for irradiation of the (2t+1)-th to 3t-th rows, and the backlight array 41$a_4$ is used for irradiation of the (3t+1)-th to k-th TOWS.

In the period T1, the backlight array 41$a_1$ is turned off, and an image data is written to the pixels in the first to t-th rows. The backlight array 41$a_2$ emits light to the pixels in the (t+1)-th to 2t-th rows, the backlight array 41$a_3$ emits light to the pixels in the (2t+1)-th to 3t-th rows, and the backlight array 41$a_4$ emits light to the pixels in the (3t+1)-th to k-th rows. In the period T1, the first pulse width modulation circuit 46*a* drives the backlight arrays so that three backlight arrays operate. That is, the highest duty ratio for lighting of each backlight array is ⅓.

By the above driving method, the number of pulse width modulation circuits in the liquid crystal display device exemplified in this embodiment can be reduced.

<Liquid Crystal Display Device Disclosed in this Embodiment>

In the liquid crystal display device in this embodiment, input of an image signal and lighting of the backlight can be concurrently performed. Accordingly, the frequency of input of an image signal to each pixel of the liquid crystal display device can be increased. As a result, color break generated in the field-sequential liquid crystal display device can be suppressed, and the quality of an image displayed by the liquid crystal display device can be improved.

The liquid crystal display device disclosed in this embodiment can achieve the above-described operation with a simple pixel configuration. Specifically, the pixel of the liquid crystal display device disclosed in Patent Document 1 needs a transistor which controls transfer of an electrical charge in addition to the configuration of the pixel of the liquid crystal display device disclosed in this embodiment. Further, a signal line for controlling on/off of the transistor also needs to be provided. In contrast, the pixel configuration of the liquid crystal display device of this embodiment is simple. In other words, the aperture ratio of the pixel in the liquid crystal display device of this embodiment can be increased as compared to the liquid crystal display device disclosed in Patent Document 1. Further, the liquid crystal display device of this embodiment can reduce parasitic capacitance generated between wirings by reducing the number of wirings extended to the pixel portion. In other words, it is possible to perform high-speed operation of the wirings extended to the pixel portion.

Further, in the case where backlights emit light as an operation example illustrated in FIG. 6, the adjacent backlight units never emit lights of different colors. Specifically, in the case where the backlight emits light after an image signal is written in a region in the period T1, the adjacent backlight units never emit lights of different colors. For example, in the period T1, when the backlight unit for the (k+1)-th to (k+t)-th rows emits blue (B) light after the image signal for controlling transmission of blue (B) light is input to the n pixels provided in the (k+1)-th row to the n pixels provided in the (k+t)-th row, the blue (B) light source emits light or emission itself is not performed (neither red (R) light nor green (G) light is emitted) for a backlight unit in the (3t+1)-th to k-th rows and a backlight unit for the (k+t+1)-th to (k+2t)-th rows. Thus, the probability of transmission of light of a color different from a given color through a pixel to which image data on the given color is input can be reduced.

<Modification Example>

The liquid crystal display device described in this embodiment is one embodiment of the present invention, and the present invention includes a liquid crystal display device which has some differences from the aforementioned liquid crystal display device.

For example, in the liquid crystal display device of this embodiment, the pixel portion 10 is divided into three regions and image signals are supplied in parallel to the three regions; however, the liquid crystal display device of the present invention is not limited to the above. In other words, the liquid crystal display device of the present invention can have a structure in which the pixel portion 10 is divided into a plurality of regions other than three and image signals are supplied in parallel to the plurality of regions. In the case where the number of regions is changed, it is necessary to set clock signals for a scan line driver circuit and pulse-width control signals in accordance with the number of regions.

The liquid crystal display device of this embodiment includes the capacitor for holding voltage applied to the liquid crystal element (see FIG. 1B); alternatively, it is possible to employ a structure without a capacitor. In this case, the aperture ratio of the pixel can be increased. The capacitor wiring extended to the pixel portion need not be provided; therefore, it is possible to perform high-speed operation of wirings extended to the pixel portion.

Figure 7A:
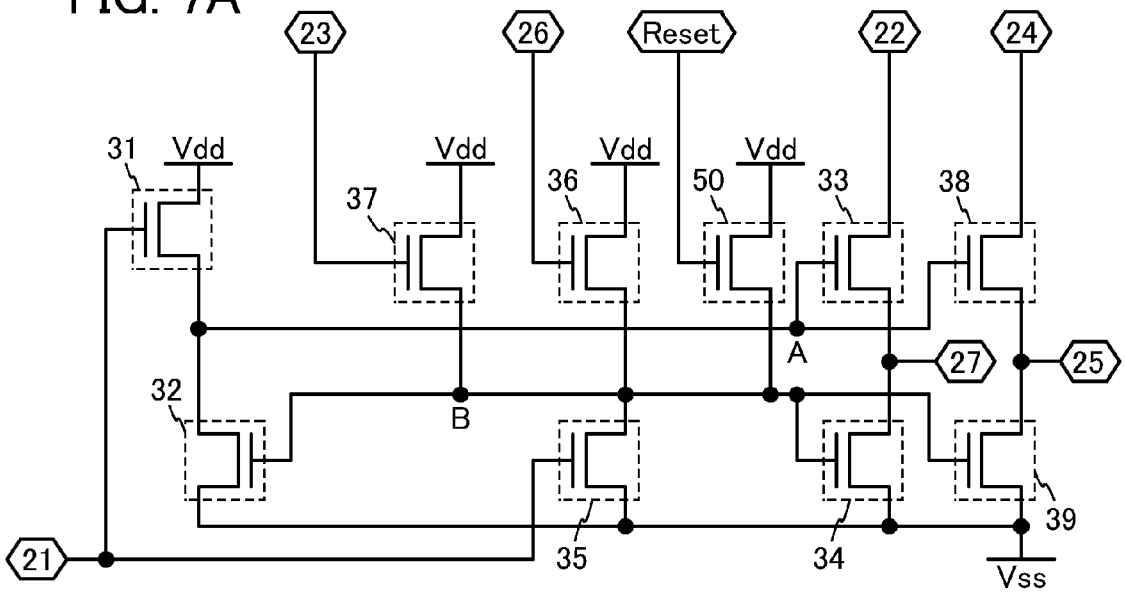
FIGS. 7A and 7B are circuit diagrams illustrating examples of a pulse output circuit.

Further, the pulse output circuit can have a structure (see FIG. 7A) in which a transistor 50 is added to the pulse output circuit illustrated in FIG. 3A. One of a source and a drain of the transistor 50 is electrically connected to the high power supply potential line; the other of the source and the drain of the transistor 50 is electrically connected to the gate of the transistor 32, the gate of the transistor 34, the other of the source and the drain of the transistor 35, the other of the source and the drain of the transistor 36, the other of the source and the drain of the transistor 37, and the gate of the transistor 39; and a gate of the transistor 50 is electrically connected to a reset terminal (Reset). To the reset terminal, a high-level potential is input in a period which follows formation of one image on the pixel portion; a low-level potential is input in the other period. Note that the transistor 50 is turned on when a high-level potential is input. Thus, the potential of each node can be initialized in that period, so that malfunction can be prevented. Note that in the case where the initialization is performed, it is necessary to provide an initialization period after the periods in which one image is formed in the pixel portion. In the case where a period in which the backlight is turned off is provided after the period in which one image is formed in the pixel portion, which will be described later with reference to FIG. 9, it is possible to perform the initialization in the period in which the backlight is turned off.

Further alternatively, the pulse output circuit can have a structure (see FIG. 7B) in which a transistor 51 is added to the pulse output circuit illustrated in FIG. 3A. One of a source and a drain of the transistor 51 is electrically connected to the other of the source and the drain of the transistor 31 and the other of the source and the drain of the transistor 32; the other of the source and the drain thereof is electrically connected to the gate of the transistor 33 and the gate of the transistor 38; and a gate of the transistor 51 is electrically connected to the high power supply potential line. The transistor 51 is turned off in a period during which the potential of the node A is at a high level (the periods t1 to t6 in FIGS. 3B to 3D). With the transistor 51, the gate of the transistor 33 and the gate of the transistor 38 can be electrically disconnected to the other of the source and the drain of the transistor 31 and the other of the source and the drain of the transistor 32 in the periods t1 to t6. Thus, a load at the time of the bootstrapping in the pulse output circuit can be reduced in the periods t1 to t6.

Figure 7B:
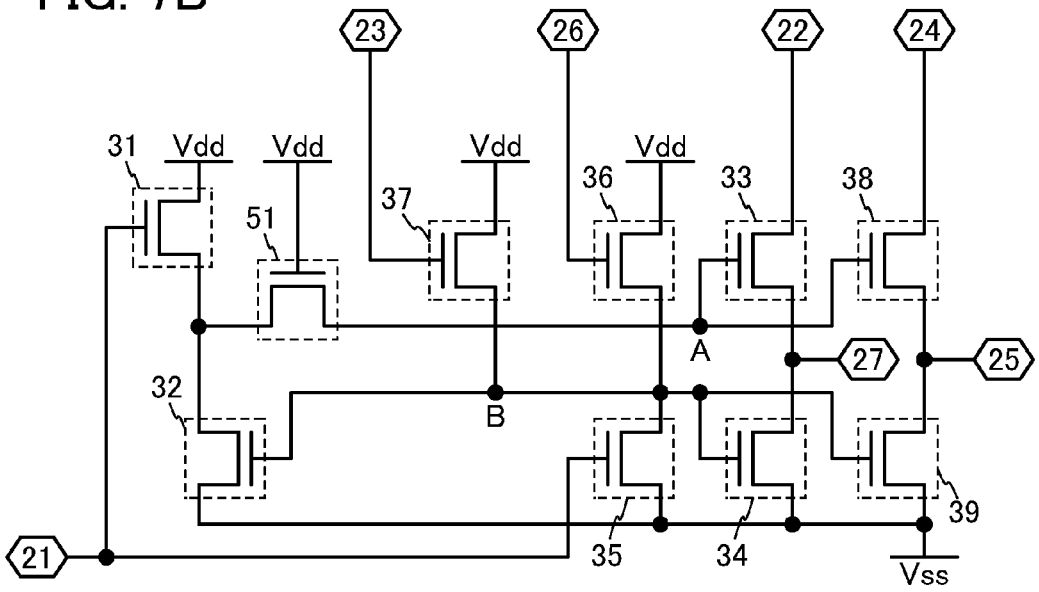

Further alternatively, the pulse output circuit can have a structure (see FIG. 8A) in which a transistor 52 is added to the pulse output circuit illustrated in FIG. 7B. One of a source and a drain of the transistor 52 is electrically connected to the gate of the transistor 33 and the other of the source and the drain of the transistor 51; the other of the source and the drain of the transistor 52 is electrically connected to the gate of the transistor 38; and a gate of the transistor 52 is electrically connected to the high power supply potential line. As described above, a load at the time of the bootstrapping in the pulse output circuit can be reduced with the transistor 52. In particular, the load-reduction effect is large in the case where the potential of the node A is increased only by the capacitive coupling of the source and the gate of the transistor 33 (see FIG. 3D).

Figure 8A:
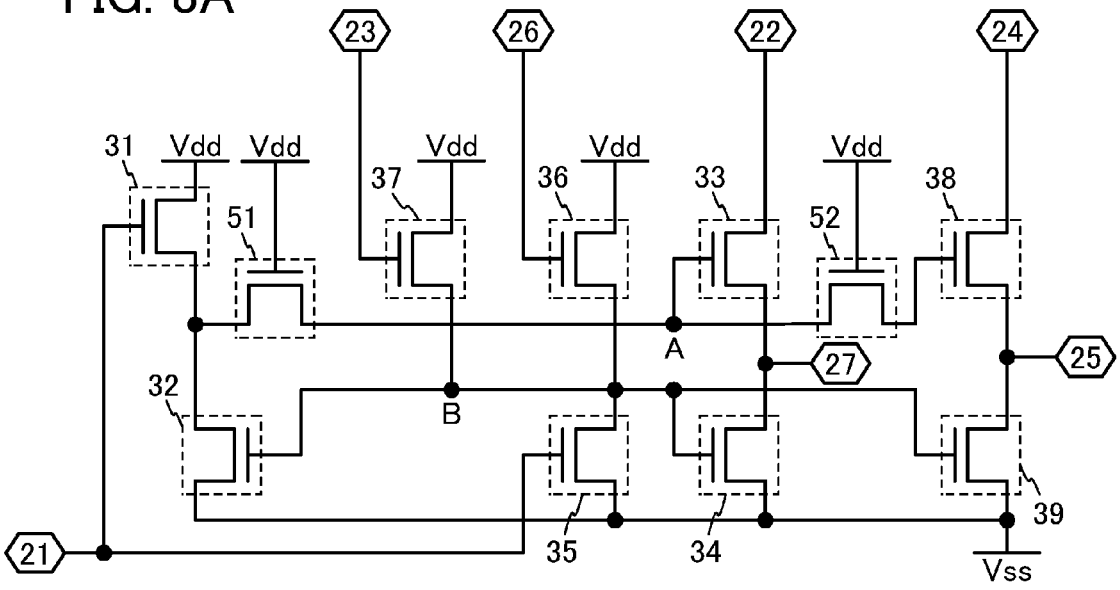
FIGS. 8A and 8B are circuit diagrams illustrating examples of a pulse output circuit.
Figure 8B:
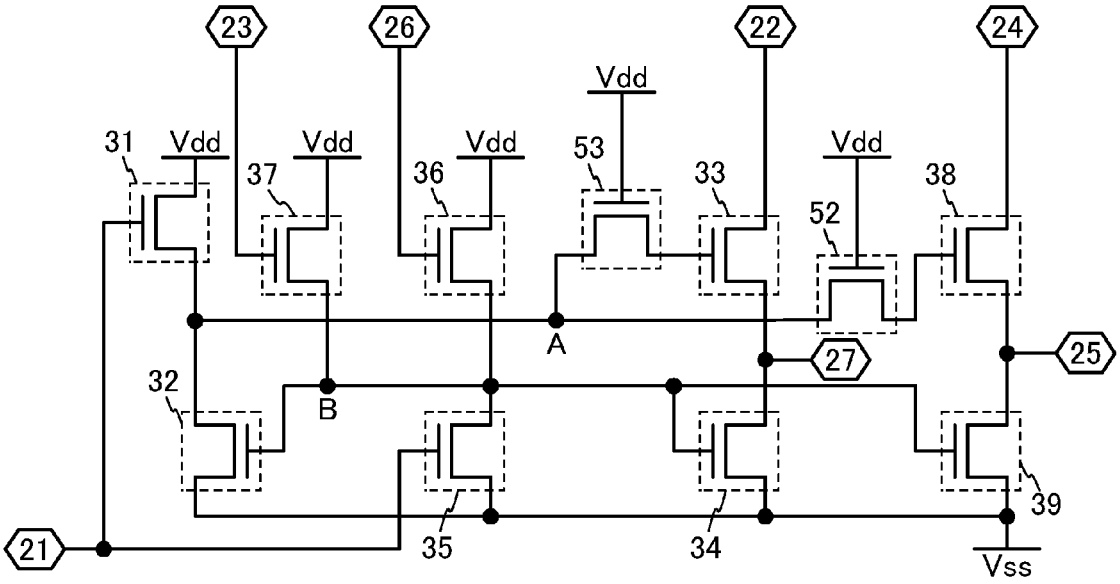

Further alternatively, the pulse output circuit can have a structure (see FIG. 8B) in which the transistor 51 is removed from the pulse output circuit shown in FIG. 8A and a transistor 53 is added to the pulse output circuit shown in FIG. 8A. One of a source and a drain of the transistor 53 is electrically connected to the other of the source and the drain of the transistor 31, the other of the source and the drain of the transistor 32, and the one of the source and the drain of the transistor 52; the other of the source and the drain of the transistor 53 is electrically connected to the gate of the transistor 33; and a gate of the transistor 53 is electrically connected to the high power supply potential line. As described above, with the transistor 53, a load at the time of the bootstrapping in the pulse output circuit can be reduced. Further, an effect of a fraud pulse generated in the pulse output circuit on the switching of the transistors 33 and 38 can be decreased.

Furthermore, the liquid crystal display device of this embodiment has a structure where light sources emitting red (R) light, green (G) light, and blue (B) light are arranged linearly and horizontally to form a backlight unit (see FIGS. 5A and 5B); however, the structure of the backlight unit is not limited to such a structure. For example, the light sources emitting light of three colors may be arranged triangularly, or linearly and longitudinally; or a red (R) backlight unit, a green (G) backlight unit, and a blue (B) backlight unit may be provided each individually. Moreover, the above-described liquid crystal display device is provided with a direct-below backlight as the backlight (see FIGS. 5A and 5B); alternatively, an edge-light backlight can be used as the backlight.

Figure 9:
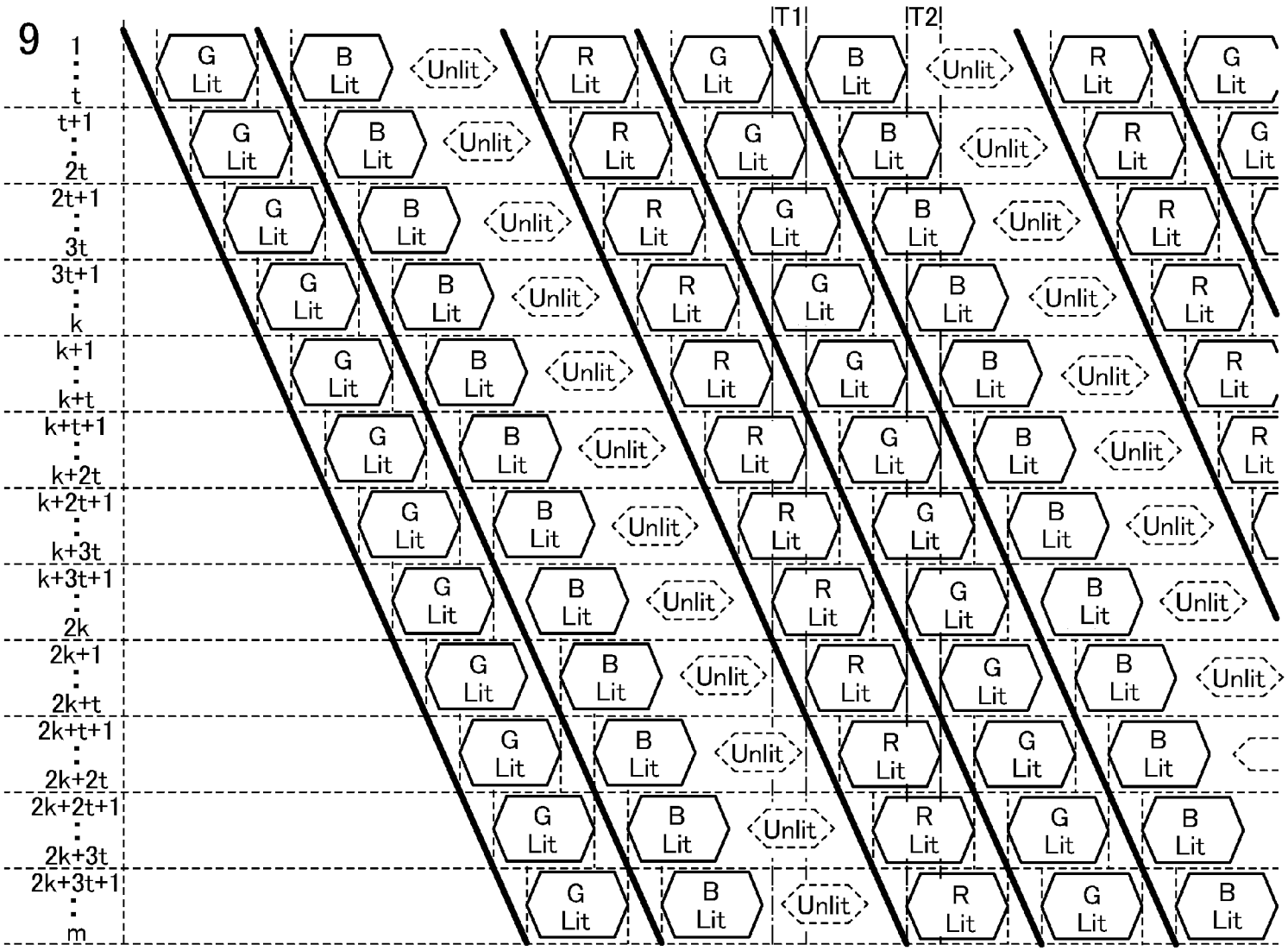
FIG. 9 illustrates an operation example of a liquid crystal display device.

In the liquid crystal display device of this embodiment, a structure is illustrated, in which the scan of the selection signal and the lighting of the backlight unit are successively performed (see FIG. 6); however, the operation of the liquid crystal display device is not limited to the structure. For example, before and after the period in which one image is formed in the pixel portion (the period which continues from the input of an image signal for controlling transmission of red (R) light to the lighting of the blue (B) light source in the backlight unit in FIG. 6), it is possible to provide a period in which the scan of the selection signal and the lighting of the backlight unit are not performed (see FIG. 9). Therefore, color break generated in the liquid crystal display device can be suppressed, and the quality of an image displayed by the liquid crystal display device can be improved. Note that FIG. 9 illustrates a structure in which neither the scan of the selection signal nor the lighting of the backlight unit is performed; however, it is possible to perform the scan of the selection signal and to input an image signal used for not transmitting light to each pixel.

Figure 10:
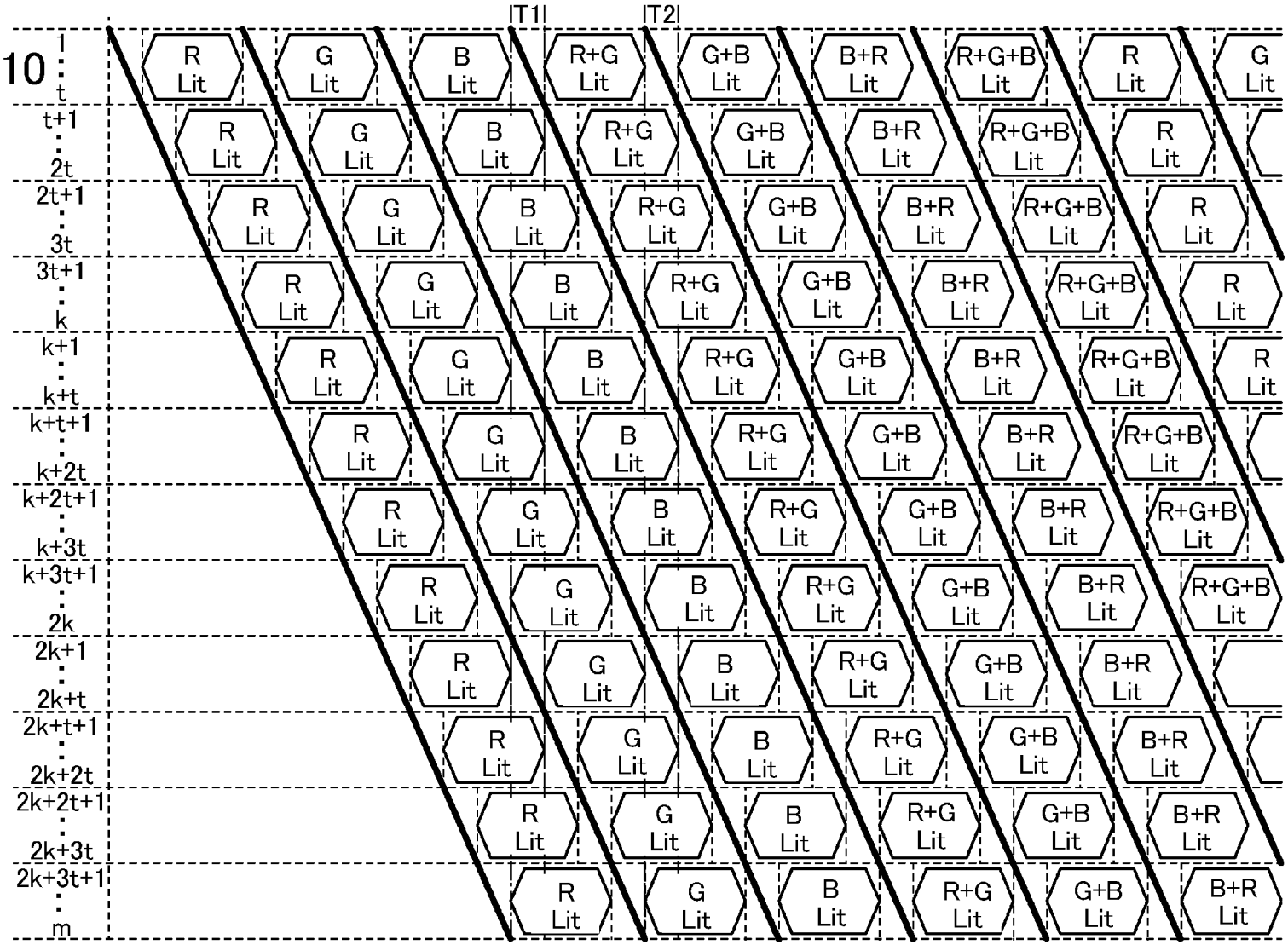
FIG. 10 illustrates an operation example of a liquid crystal display device.

Further, the described structure of the liquid crystal display device in this embodiment provides a period in which one of three light sources in the backlight unit emits light with respect to given regions in the pixel portion (see FIG. 6); however, the liquid crystal display device in this embodiment can have a structure which provides a period in which one or more light sources among three light sources in the backlight unit emit light (see FIG. 10). In this case, in the liquid crystal display device, display luminance can be further improved and display color tone can be further classified. In an operation example illustrated in FIG. 10, one image can be formed on the pixel portion by a series of operations which starts by input of an image signal for controlling transmission of red (R) light and ends by lighting of the red (R) light source, the green (G) light source, and the blue (B) light source in the backlight unit.

Figure 11:
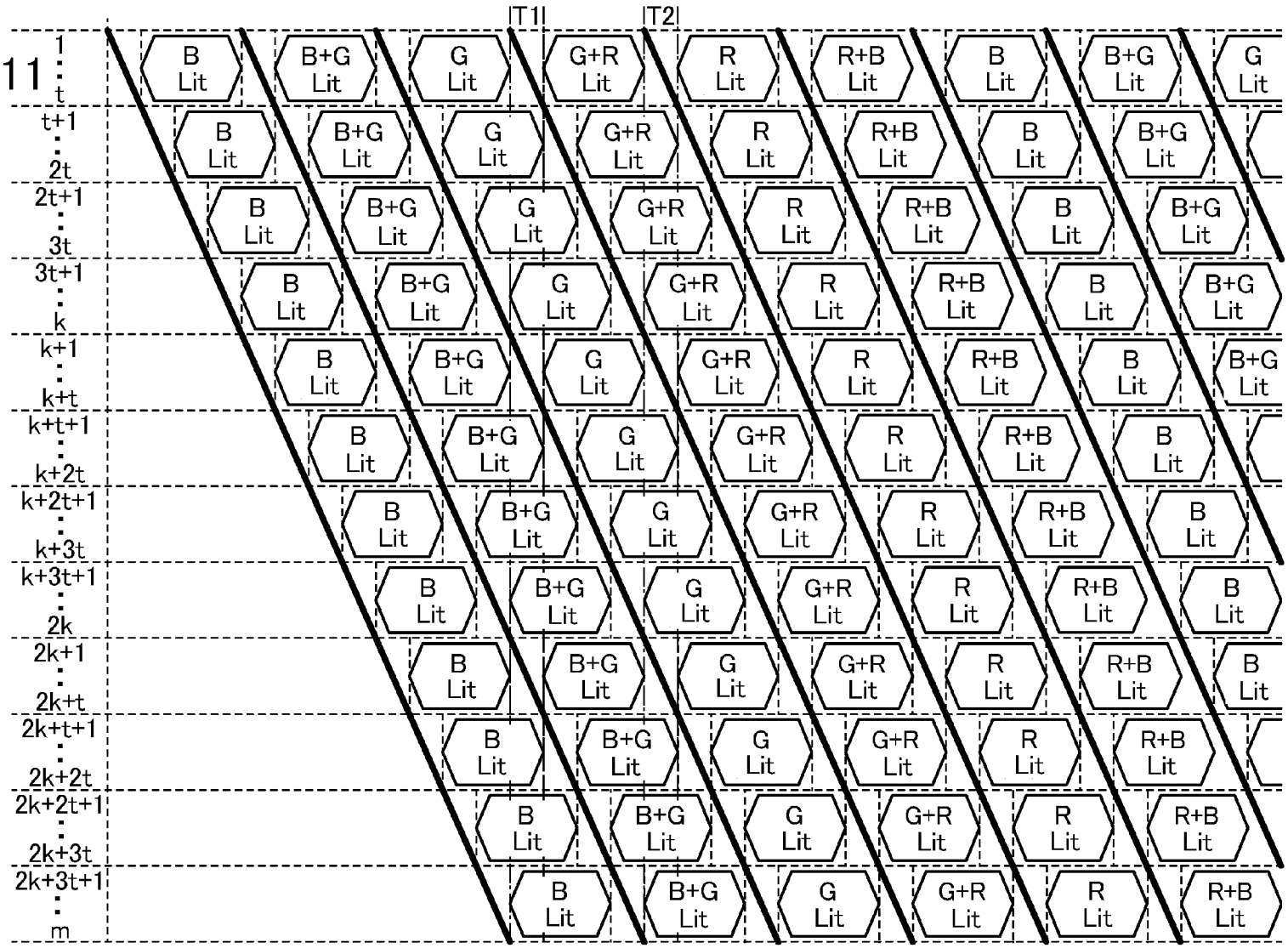
FIG. 11 illustrates an operation example of a liquid crystal display device.
Figure 12:
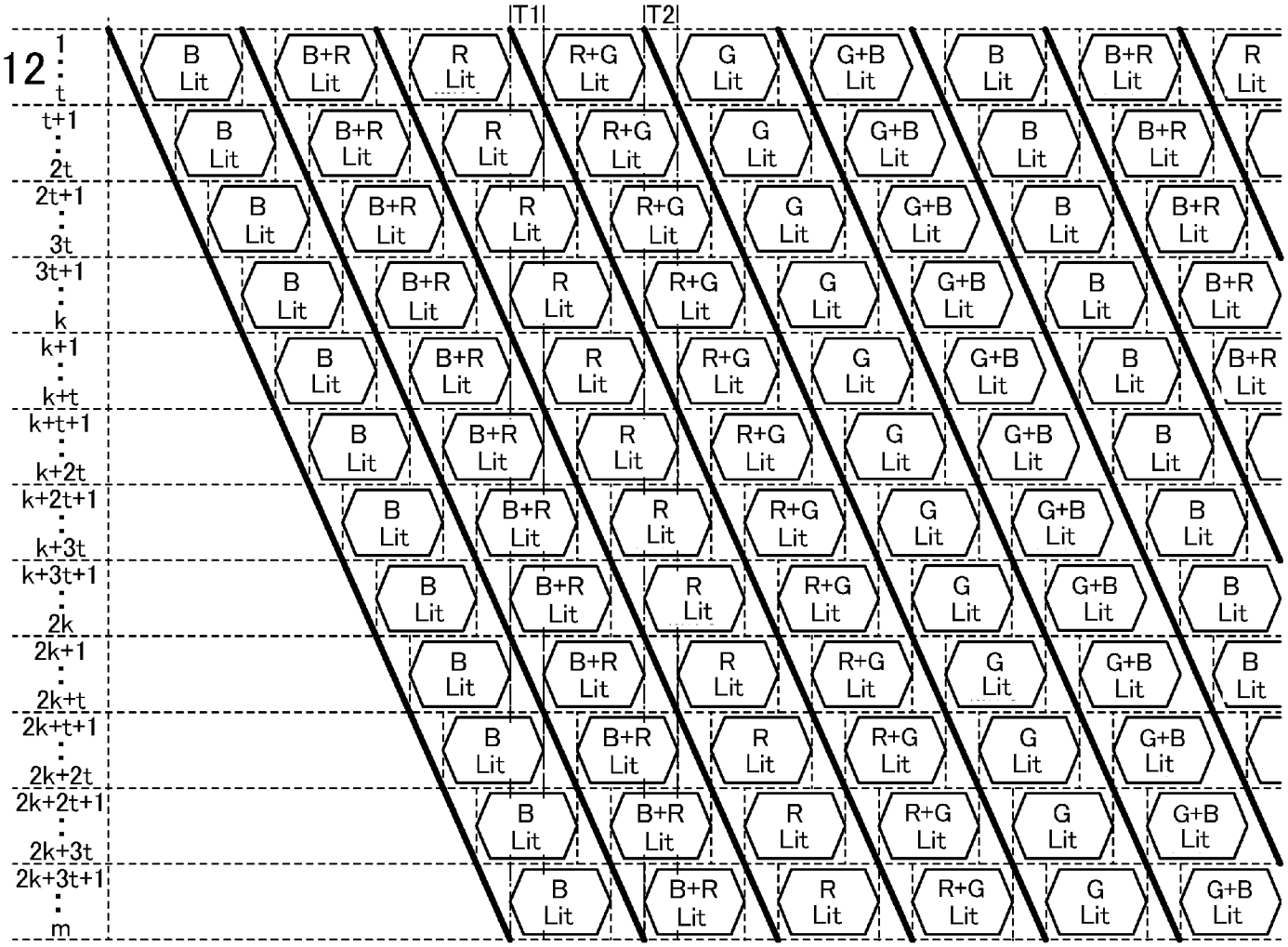
FIG. 12 illustrates an operation example of a liquid crystal display device.
Figure 13:
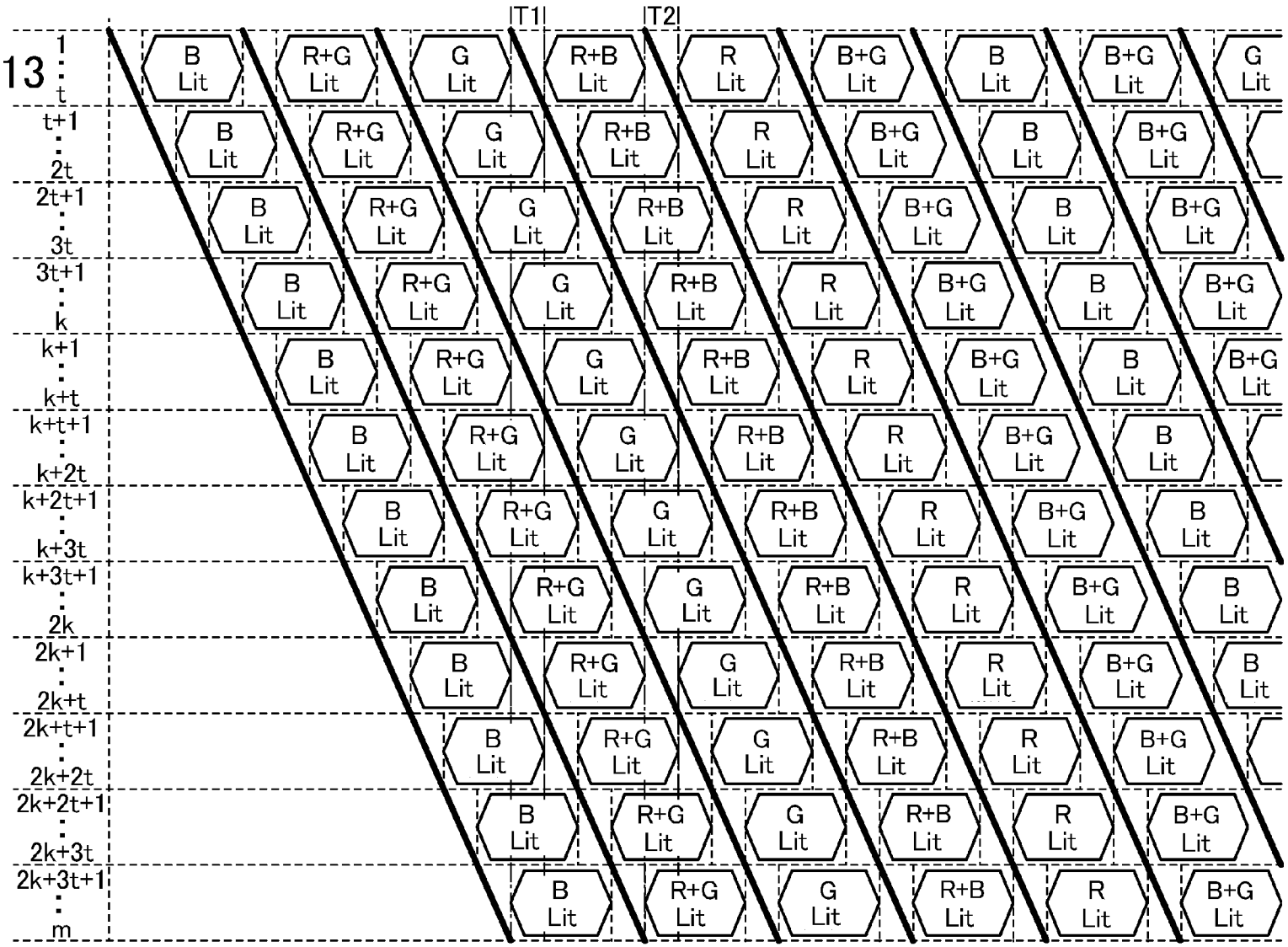
FIG. 13 illustrates an operation example of a liquid crystal display device.
Figure 14:
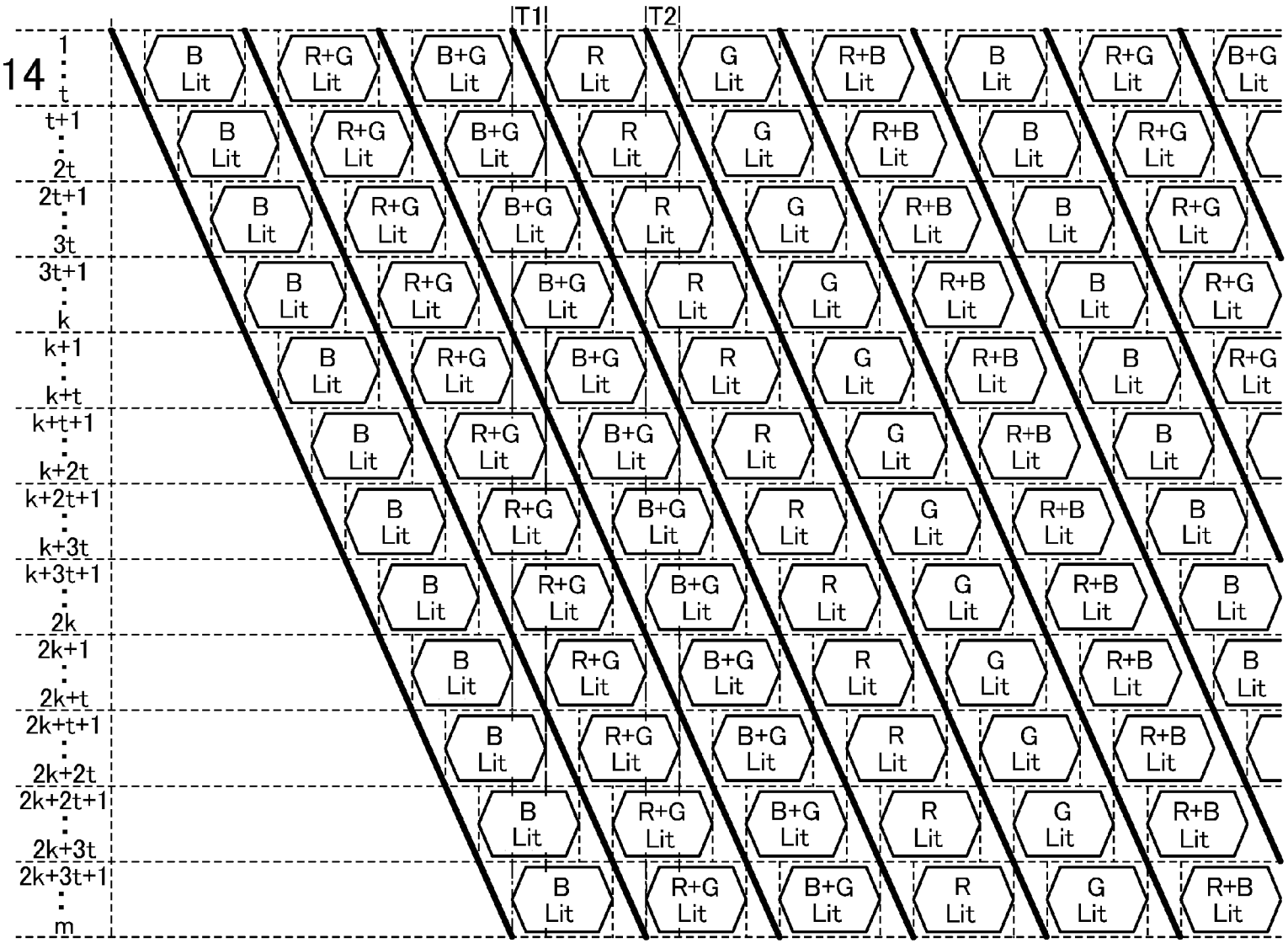
FIG. 14 illustrates an operation example of a liquid crystal display device.

Further, in the above description of the liquid crystal display device in this embodiment, one image is formed by making the light sources of the backlight unit emit light to every given region in the pixel portion in the following order: red (R)→green (G)→blue (B) (see FIG. 6). However, the light emission order of the light sources in the liquid crystal display device of this embodiment is not limited to the above. For example, the following structures can be employed. One image is formed by making the light sources emit light in the following order: blue (B) blue (B) and green (G) green (G)→green (G) and red (R)→red (R)→red (R) and blue (B) (see FIG. 11). One image is formed by making the light sources emit light in the following order: blue (B)→blue (B) and red (R)→red (R)→red (R) and green (G)→green (G)→green (G) and blue (B) (see FIG. 12). One image is formed by making the light sources emit light in the following order: blue (B)→red (R) and green (G)→green (G)→blue (B) and red (R)→red (R)→green (G) and blue (B) (see FIG. 13). One image is formed by making the light sources emit light in the following order: blue (B)→red (R) and green (G)→blue (B) and green (G)→red (R)→green (G)→red (R) and blue (B) (see FIG. 14). Note that it is needless to say that the input order of an image signal for controlling transmission of light of a given color needs to be designed as appropriate in accordance with the lighting order of the light sources.

Figure 15:
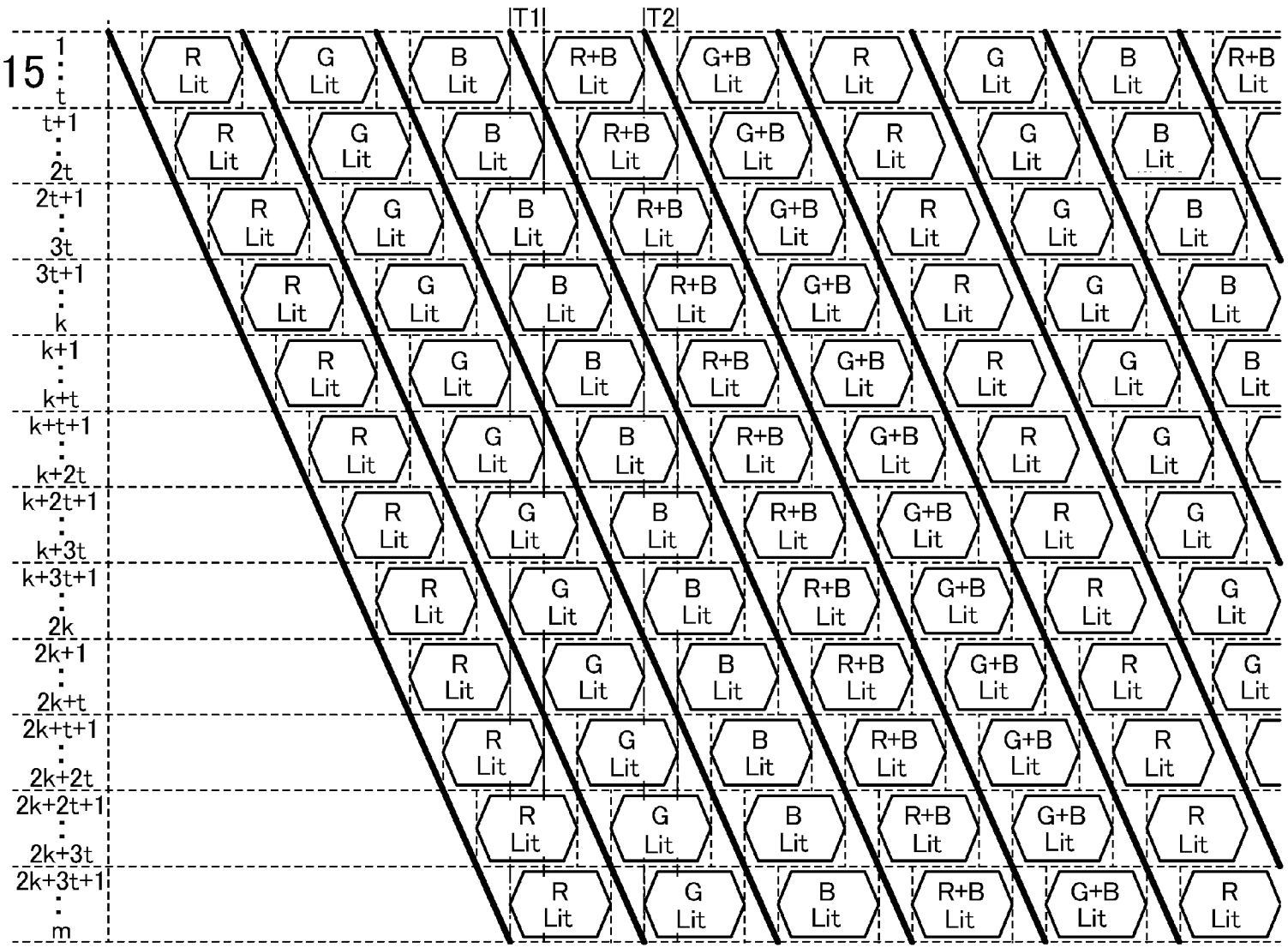
FIG. 15 illustrates an operation example of a liquid crystal display device.

Further, in the above description of the liquid crystal display device in this embodiment, one image is formed by making each of the light sources of red (R), green (G), and blue (B) in the backlight units emit light once (see FIG. 6). However, the number of light emission can be different among the light sources in the liquid crystal display device in this embodiment. For example, the following structure can be employed. One image is formed by making the backlight units emit light under the condition that red (R) light and green (G) light each of which has a high luminosity factor are emitted twice and blue (B) light which has a low luminosity factor is emitted three times (see FIG. 15). Note that in the operation example illustrated in FIG. 15, one image is formed on the pixel portion by a series of operation which starts by input of an image signal for controlling transmission of red (R) light and ends by lighting of the green (G) light source and the blue (B) light source in the backlight unit.

In the liquid crystal display device of this embodiment, light sources emitting light of three colors of red (R), green (G), and blue (B) are used in combination for the backlight; however, the liquid crystal display device of the present invention is not limited to the above structure. That is, in the liquid crystal display device of the present invention, light sources that emit lights of given colors can be used in combination. For example, it is possible to use a combination of four colors of light sources of red (R), green (G), blue (B), and white (W); a combination of four colors of light sources of red (R), green (G), blue (B), and yellow (Y); or a combination of three colors of light sources of cyan (C), magenta (M), and yellow (Y). Note that in the case where the backlight unit includes a light source which emits white (W) light, white (W) light is produced not by color mixture but by using the light source of a white (W) color. The light source has high emission efficiency; therefore, the backlight is formed using the light source, whereby power consumption can be reduced. In the case where the backlight unit includes light sources for two colors which are colors complementary to each other (for example, in the case where light sources for two colors of blue (B) and yellow (Y) are included), the two colors are mixed, whereby white (W) light can be emitted. Further, light sources that emit lights of six colors of pale red (R), pale green (G), pale blue (B), deep red (R), deep green (G), and deep blue (B) can be used in combination or light sources that emit lights of six colors of red (R), green (G), blue (B), cyan (C), magenta (M), and yellow (Y) can be used in combination. In such a manner, with a combination of light sources of a wider variety of colors, the color gamut of the liquid crystal display device can be enlarged, and the image quality can be improved.

In the liquid crystal display device described in this embodiment, input of an image signal and lighting of a backlight are not performed sequentially in the whole pixel portion but are performed sequentially in every given region in the pixel portion. Thus, the frequency of input of an image signal to each pixel of the liquid crystal display device can be increased. As a result, display degradation caused in the liquid crystal display device such as color break can be suppressed, and the quality of an image can be improved. In addition, an image signal of a color tone having the highest brightness included in the image signals is detected for every given region in the pixel portion, whereby the intensity of light from the light source of the backlight can be controlled precisely. As a result, power consumption of the liquid crystal display device can be reduced, effectively.

Note that it is possible to use a plurality of structures described as modification examples of this embodiment for the liquid crystal display device of this embodiment.

This embodiment or part of this embodiment can be freely combined with the other embodiments or part of the other embodiments.

(Embodiment 2)

In this embodiment, a specific structure of the liquid crystal display device described in Embodiment 1 will be described.

<Specific Example of Transistor>

First, specific examples of transistors used in a pixel portion or circuits used in the above liquid crystal display device are described with reference to FIGS. 17A to 17D. Note that in the liquid crystal display device, transistors provided in the pixel portion and the circuits may have the same structure or structures different from each other.

Figure 17A:
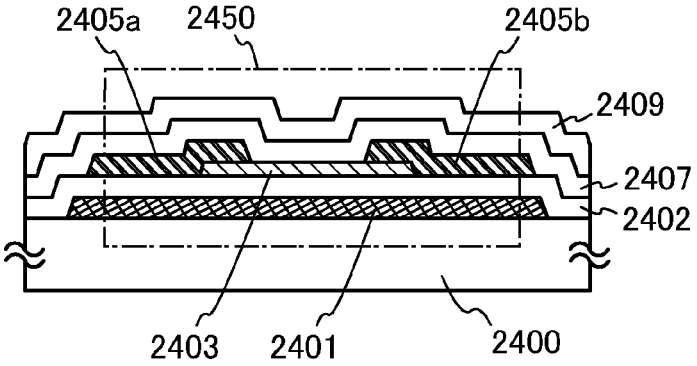
FIGS. 17A to 17D each illustrates a specific example of a transistor.

A transistor 2450 illustrated in FIG. 17A includes a gate layer 2401 over a substrate 2400, a gate insulating layer 2402 over the gate layer 2401, a semiconductor layer 2403 over the gate insulating layer 2402, and a source layer 2405*a* and a drain layer 2405*b* over the oxide semiconductor layer 2403. An insulating layer 2407 is formed over the semiconductor layer 2403, the source layer 2405*a*, and the drain layer 2405*b*. A protective insulating layer 2409 may be formed over the insulating layer 2407. The transistor 2450 is a bottom-gate transistor, and is also an inverted staggered transistor.

Figure 17B:
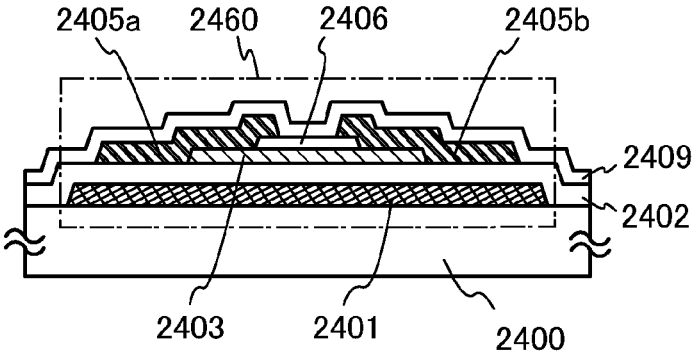

A transistor 2460 illustrated in FIG. 17B includes the gate layer 2401 over the substrate 2400, the gate insulating layer 2402 over the gate layer 2401, the semiconductor layer 2403 over the gate insulating layer 2402, a channel protective layer 2406 over the oxide semiconductor layer 2403, and the source layer 2405*a* and the drain layer 2405*b* over the channel protective layer 2406 and the semiconductor layer 2403. The protective insulating layer 2409 may be formed over the source layer 2405*a* and the drain layer 2405*b*. The transistor 2460 is a bottom-gate transistor called a channel-protective type (also referred to as a channel-stop type) transistor and is also an inverted staggered transistor.

Figure 17C:
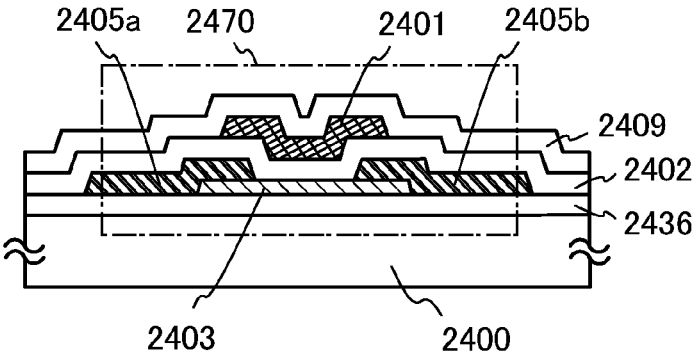

A transistor 2470 illustrated in FIG. 17C includes a base layer 2436 over the substrate 2400, the semiconductor layer 2403 over the base layer 2436, the source layer 2405*a* and the drain layer 2405*b* over the semiconductor layer 2403 and the base layer 2436, the gate insulating layer 2402 over the semiconductor layer 2403, the source layer 2405*a*, and the drain layer 2405*b*, and the gate layer 2401 over the gate insulating layer 2402. The protective insulating layer 2409 may be formed over the gate layer 2401. The transistor 2470 is a top-gate transistor.

Figure 17D:
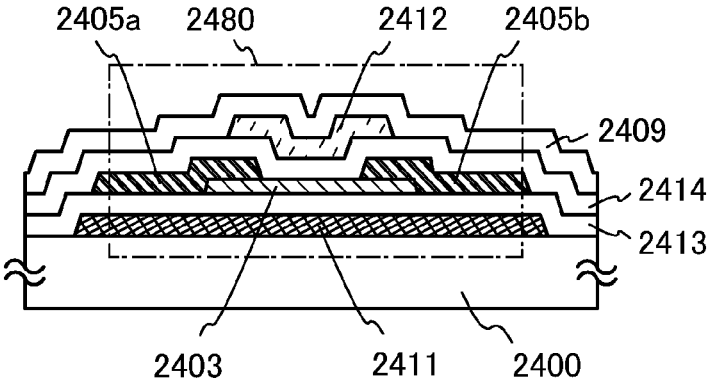

A transistor 2480 illustrated in FIG. 17D includes a first gate layer 2411 over the substrate 2400, a first gate insulating layer 2413 over the first gate layer 2411, the semiconductor layer 2403 over the first gate insulating layer 2413, and the source layer 2405*a* and the drain layer 2405*b* over the semiconductor layer 2403 and the first gate insulating layer 2413. A second gate insulating layer 2414 is formed over the semiconductor layer 2403, the source layer 2405*a*, and the drain layer 2405*b*, and a second gate layer 2412 is formed over the second gate insulating layer 2414. The protective insulating layer 2409 may be formed over the second back gate layer 2412.

The transistor 2480 has a structure combining the transistor 2450 and the transistor 2470. The first gate layer 2411 and the second gate layer 2412 can be electrically connected to function as one gate layer. One of the first gate layer 2411 and the second gate layer 2412 is referred to as a "gate" simply, and the other one is referred to as a "back gate" in some cases. In the transistor 2480, potential of the back gate is changed, so that the threshold voltage of the transistor 2480 of when switching is controlled with the gate potential can be changed.

Note that examples of the substrate 2400 include a semiconductor substrate (e.g., a single crystal substrate or a silicon substrate), an SOI substrate, a glass substrate, a quartz substrate, a conductive substrate whose top surface is provided with an insulating layer, flexible substrates such as a plastic substrate, a bonding film, paper containing a fibrous material, and a base film. As an example of a glass substrate, a barium borosilicate glass substrate, an aluminoborosilicate glass substrate, a soda lime glass substrate, or the like can be given. For a flexible substrate, a flexible synthetic resin such as plastics typified by polyethylene terephthalate (PET), polyethylene naphthalate (PEN), and polyether sulfone (PES), or acrylic can be used, for example.

For the gate layer 2401 and the first gate layer 2411, an element selected from aluminum (Al), copper (Cu), titanium (Ti), tantalum (Ta), tungsten (W), molybdenum (Mo), chromium (Cr), neodymium (Nd), or scandium (Sc); an alloy containing any of these elements; or a nitride containing any of these elements can be used. A stacked structure of these materials can also be used.

For each of the gate insulating layer 2402, the first gate insulating layer 2413, and the second gate insulating layer 2414, an insulator such as silicon oxide, silicon nitride, silicon oxynitride, silicon nitride oxide, aluminum oxide, tantalum oxide, or gallium oxide can be used. A stacked structure of these materials can also be used. Note that silicon oxynitride refers to a substance which contains more oxygen than nitrogen and contains oxygen, nitrogen, silicon, and hydrogen at given concentrations ranging from 55 atomic % to 65 atomic %, 1 atomic % to 20 atomic %, 25 atomic % to 35 atomic %, and 0.1 atomic % to 10 atomic %, respectively, where the total percentage of atoms is 100 atomic %. Further, the silicon nitride oxide film refers to a film which contains more nitrogen than oxygen and contains oxygen, nitrogen, silicon, and hydrogen at given concentrations ranging from 15 atomic % to 30 atomic %, 20 atomic % to 35 atomic %, 25 atomic % to 35 atomic %, and 15 atomic % to 25 atomic %, respectively, where the total percentage of atoms is 100 atomic %.

The semiconductor layer 2403 can be formed using any of the following semiconductor materials, for example: a material containing an element belonging to Group 14 of the periodic table, such as silicon (Si) or germanium (Ge), as its main component; a compound such as silicon germanium (SiGe) or gallium arsenide (GaAs); oxide such as zinc oxide (ZnO) or zinc oxide containing indium (In) and gallium (Ga); or an organic compound having semiconductor characteristics can be used. A stacked structure of layers formed using these semiconductor materials can also be used.

Further, in the case where silicon (Si) is used for the semiconductor layer 2403, there is no limitation on the crystal structure of the semiconductor layer 2403. That is, any of amorphous silicon, microcrystalline silicon, polycrystalline silicon, and single crystalline silicon can be used for the semiconductor layer 2403. A Raman spectrum of microcrystalline silicon is located in lower wavenumber than 520 $cm^{-1}$ which represents single crystalline silicon. That is, the peak of the Raman spectrum of the microcrystalline silicon exists between 520 $cm^{-1}$ which represents single crystalline silicon and 480 $cm^{-1}$ which represents amorphous silicon. The microcrystalline semiconductor contains hydrogen or halogen at least 1 atomic % or more to terminate a dangling bond. Moreover, the microcrystalline semiconductor may contain a rare gas element such as helium, argon, krypton, or neon to further promote lattice distortion, so that stability is increased and a favorable microcrystalline semiconductor can be obtained.

Moreover, in the case where an oxide (an oxide semiconductor) is used for the semiconductor layer 2403, at least one of the following elements is contained: In, Ga, Sn, Zn, Al, Mg, Hf, and lanthanoid. For example, any of the following metal semiconductors can be used: an In—Sn—Ga—Zn—O-based metal oxide which is an oxide of four metal elements; an In—Ga—Zn—O-based metal oxide, an In—Sn—Zn—O-based metal oxide, an In—Al—Zn—O-based metal oxide, a Sn—Ga—Zn—O-based metal oxide, an Al—Ga—Zn—O-based metal oxide, and a Sn—Al—Zn—O-based metal oxide, an In—Hf—Zn—O-based metal oxide, an In—La—Zn—O-based metal oxide, an In—Ce—Zn—O-based metal oxide, an In—Pr—Zn—O-based metal oxide, an In—Nd—Zn—O-based metal oxide, In—Pm—Zn—O-based metal oxide, an In—Sm—Zn—O-based metal oxide, an In—Eu—Zn—O-based metal oxide, In—Gd—Zn—O-based metal oxide, an In—Tb—Zn—O-based metal oxide, In—Dy—Zn—O-based metal oxide, an In—Ho—Zn—O-based metal oxide, an In—Er—Zn—O-based metal oxide, an In—Tm—Zn—O-based metal oxide, an In—Yb—Zn—O-based metal oxide, and In—Lu—Zn—O-based metal oxide which are oxides of three metal elements; an In—Ga—O-based oxide, an In—Zn—O-based metal oxide, a Sn—Zn—O-based metal oxide, an Al—Zn—O-based metal oxide, a Zn—Mg—O-based metal oxide, a Sn—Mg—O-based metal oxide, and an In—Mg—O-based metal oxide which are oxides of two metal elements; and an In—O-based metal oxide, a Sn—O-based metal oxide, and a Zn—O-based metal oxide which are oxides of one metal element. The above oxide semiconductors may include silicon oxide. Here, for example, the In—Ga—Zn—O-based metal oxide means an oxide containing at least In, Ga, and Zn, and the composition ratio of the elements is not particularly limited. The In—Ga—Zn—O-based oxide semiconductor may contain an element other than In, Ga, and Zn.

As the oxide semiconductor, a thin film represented by the chemical formula, $InMO_3(ZnO)_m$ (m>0) can be used. Here, M represents one or more metal elements selected from Ga, Al, Mn, or Co. For example, M may be Ga, Ga and Al, Ga and Mn, Ga and Co, or the like.

For the source layer 2405*a*, the drain layer 2405*b*, and the second gate layer 2412, an element selected from aluminum (Al), copper (Cu), titanium (Ti), tantalum (Ta), tungsten (W), molybdenum (Mo), chromium (Cr), neodymium (Nd), or scandium (Sc); an alloy containing any of these elements; or a nitride containing any of these elements can be used. A stacked structure of these materials can also be used.

A conductive film to be the source layer 2405*a* and the drain layer 2405*b* (including a wiring layer formed using the same layer as the source and drain layers) may be formed using a conductive metal oxide. As conductive metal oxide, indium oxide ($In_2O_3$), tin oxide ($SnO_2$), zinc oxide (ZnO), indium oxide-tin oxide alloy ($In_2O_3$—$SnO_2$; abbreviated to ITO), indium oxide-zinc oxide alloy ($In_2O_3$—ZnO), or any of these metal oxide materials in which silicon oxide is contained can be used.

As the channel protective layer 2406, an insulator such as silicon oxide, silicon nitride, silicon oxynitride, silicon nitride oxide, aluminum oxide, tantalum oxide, or gallium oxide can be used. A stacked structure of these materials can also be used.

For the insulating layer 2407, an insulator such as silicon oxide, silicon oxynitride, aluminum oxide, aluminum oxynitride, or gallium oxide can be used. A stacked structure of these materials can also be used.

For the protective insulating layer 2409, an insulator such as silicon nitride, aluminum nitride, silicon nitride oxide, or aluminum nitride oxide can be used. A stacked structure of these materials can also be used.

For the base layer 2436, an insulator such as silicon oxide, silicon nitride, silicon oxynitride, silicon nitride oxide, aluminum oxide, tantalum oxide, or gallium oxide can be used. A stacked structure of these materials can also be used.

In the case where an oxide semiconductor is used for the semiconductor layer 2403, an insulating material containing oxygen and an element belonging to Group 13 is preferably used for an insulating layer (here, corresponding to the gate insulating layer 2402, the insulating layer 2407, the channel protective layer 2406, the base layer 2436, the first gate insulating layer 2413, and the second gate insulating layer 2414) in contact with the oxide semiconductor. Many oxide semiconductor materials contain an element belonging to Group 13, and an insulating material containing an element belonging to Group 13 works well with an oxide semiconductor. By using such an insulating material for an insulating layer in contact with the oxide semiconductor, an interface with the oxide semiconductor can keep a favorable state.

An insulating material containing an element belonging to Group 13 refers to an insulating material containing one or more elements belonging to Group 13. As the insulating material containing an element belonging to Group 13, a metal oxide such as gallium oxide, aluminum oxide, aluminum gallium oxide, and gallium aluminum oxide can be given for example. Here, aluminum gallium oxide refers to a material in which the amount of aluminum (atomic %) is larger than that of gallium (atomic %), and gallium aluminum oxide refers to a material in which the amount of gallium (atomic %) is larger than or equal to that of aluminum (atomic %).

For example, in the case of forming an insulating layer in contact with an oxide semiconductor layer containing gallium, a material containing gallium oxide may be used for the insulating layer, so that favorable characteristics can be kept at the interface between the oxide semiconductor layer and the insulating layer. When the oxide semiconductor layer and the insulating layer containing gallium oxide are provided in contact with each other, pileup of hydrogen at the interface between the oxide semiconductor layer and the insulating layer can be reduced, for example. Note that a similar effect can be obtained in the case where an element in the same group as a constituent element of the oxide semiconductor is used in the insulating layer. For example, it is effective to form an insulating layer using a material containing aluminum oxide. Since water hardly penetrates aluminum oxide, it is preferable to use a material containing aluminum oxide for prevention of entrance of water to the oxide semiconductor layer.

In the case where an oxide semiconductor is used for the semiconductor layer 2403, it is preferable that an insulating layer in contact with the oxide semiconductor be subjected to heat treatment performed in an oxygen atmosphere, oxygen doping, or the like, so that an insulating material contains oxygen with a higher proportion than that in the stoichiometric composition. "Oxygen doping" refers to addition of oxygen into a bulk. Note that the term "bulk" is used in order to clarify that oxygen is added not only to a surface of a thin film but also to the inside of the thin film. In addition, "oxygen doping" includes "oxygen plasma doping" in which oxygen which is made to be plasma is added to a bulk. The oxygen doping may be performed using an ion implantation method or an ion doping method.

For example, in the case where the insulating layer is formed using gallium oxide, the composition of gallium oxide can be $Ga_2O_x$ ($x=3+\alpha$, $0<\alpha<1$) by performance of heat treatment in an oxygen atmosphere or oxygen doping.

In the case where the insulating layer is formed using aluminum oxide, the composition of aluminum oxide can be $Al_2O_x$ ($x=3+\alpha$, $0<\alpha<1$) by performance of heat treatment in an oxygen atmosphere or oxygen doping.

In the case where the insulating layer is formed using gallium aluminum oxide (aluminum gallium oxide), the composition of gallium aluminum oxide (aluminum gallium oxide) can be $Ga_xAl_{2-x}O_{3+\alpha}$ ($0<x<2$, $0<\alpha<1$) by performance of heat treatment in an oxygen atmosphere or oxygen doping.

By oxygen doping, an insulating layer which has a region containing oxygen with a higher proportion than that in the stoichiometric composition can be formed. When the insulating layer having such a region is in contact with the oxide semiconductor layer, oxygen that exists excessively in the insulating layer is supplied to the oxide semiconductor layer, and a defect of oxygen deficiency in the oxide semiconductor layer or at an interface between the oxide semiconductor layer and the insulating layer is reduced. Thus, the oxide semiconductor layer can be formed to an i-type or substantially i-type oxide semiconductor.

In the case where an oxide semiconductor is used for the semiconductor layer 2403 and sandwiched between insulating layers which are in contact with the semiconductor layer 2403, one of the insulating layer located on an upper side and the insulating layer located on a lower side can be an insulating layer which has a region containing oxygen with a higher proportion than that in the stoichiometric composition. However, it is preferable that both of the insulating layers have a region containing oxygen with a higher proportion than that in the stoichiometric composition. The above-described effect can be enhanced with a structure where the oxide semiconductor layer 2403 is sandwiched between the insulating layers each of which has a region containing oxygen with a higher proportion than that in the stoichiometric composition; i.e., the insulating layers are located on the upper side and the lower side of the oxide semiconductor layer 2403 and be in contact with the oxide semiconductor layer 2403.

Further, in the case where an oxide semiconductor is used for the semiconductor layer 2403, the insulating layers on the upper side and the lower side of the oxide semiconductor layer 2403 may include the same constituent element or different constituent elements. For example, the insulating layers on the upper side and the lower side may be both formed using gallium oxide whose composition is $Ga_2O_x$ ($x=3+\alpha$, $0<\alpha<1$). Alternatively, one of the insulating layers on the upper side and the lower side may be formed using $Ga_2O_x$ ($x=3+\alpha$, $0<\alpha<1$) and the other may be formed using aluminum oxide whose composition is $Al_2O_x$ ($x=3+\alpha$, $0<\alpha<1$).

Further, in the case where an oxide semiconductor is used for the semiconductor layer 2403, the insulating layer in contact with the semiconductor layer 2403 may be a stacked layer of insulating layers each of which has a region containing oxygen with a higher proportion than that in the stoichiometric composition. For example, the insulating layer on the upper side of the semiconductor layer 2403 may be formed as follows: gallium oxide whose composition is $Ga_2O_x$ ($x=3+\alpha$, $0<\alpha<1$) is formed and gallium aluminum oxide (aluminum gallium oxide) whose composition is $Ga_xAl_{2-x}O_{3+\alpha}$ ($0<x<2$, $0<\alpha<1$) may be formed thereover. Note that the insulating layer on the lower side of the semiconductor layer 2403 may be formed by stacking insulating layers each of which has a region containing oxygen with a higher proportion than that in the stoichiometric composition. Alternatively, both of the insulating layers on the upper side and the lower side of the semiconductor layer 2403 may be formed by stacking insulating layers each of which has a region containing oxygen with a higher proportion than that in the stoichiometric composition.

<Specific Example of Pixel Layout>

Figure 18:
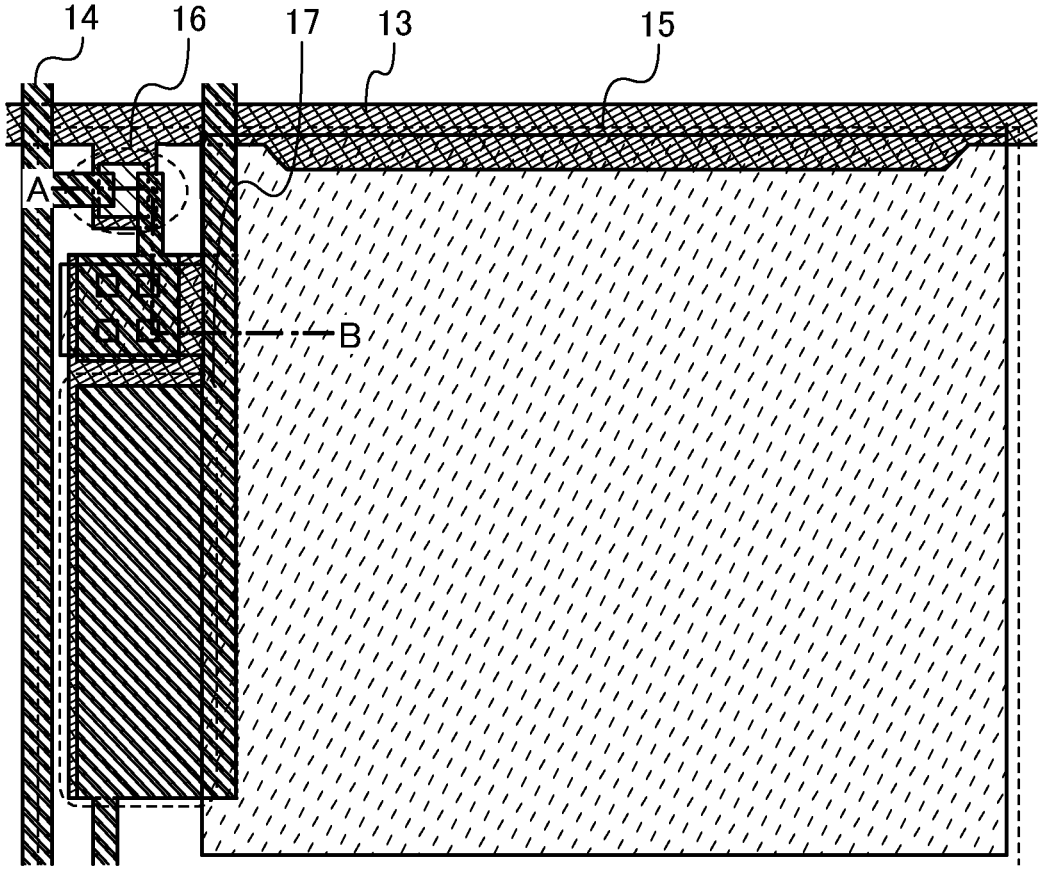
FIG. 18 is a top view illustrating a specific example of a layout of a pixel.
Figure 19:
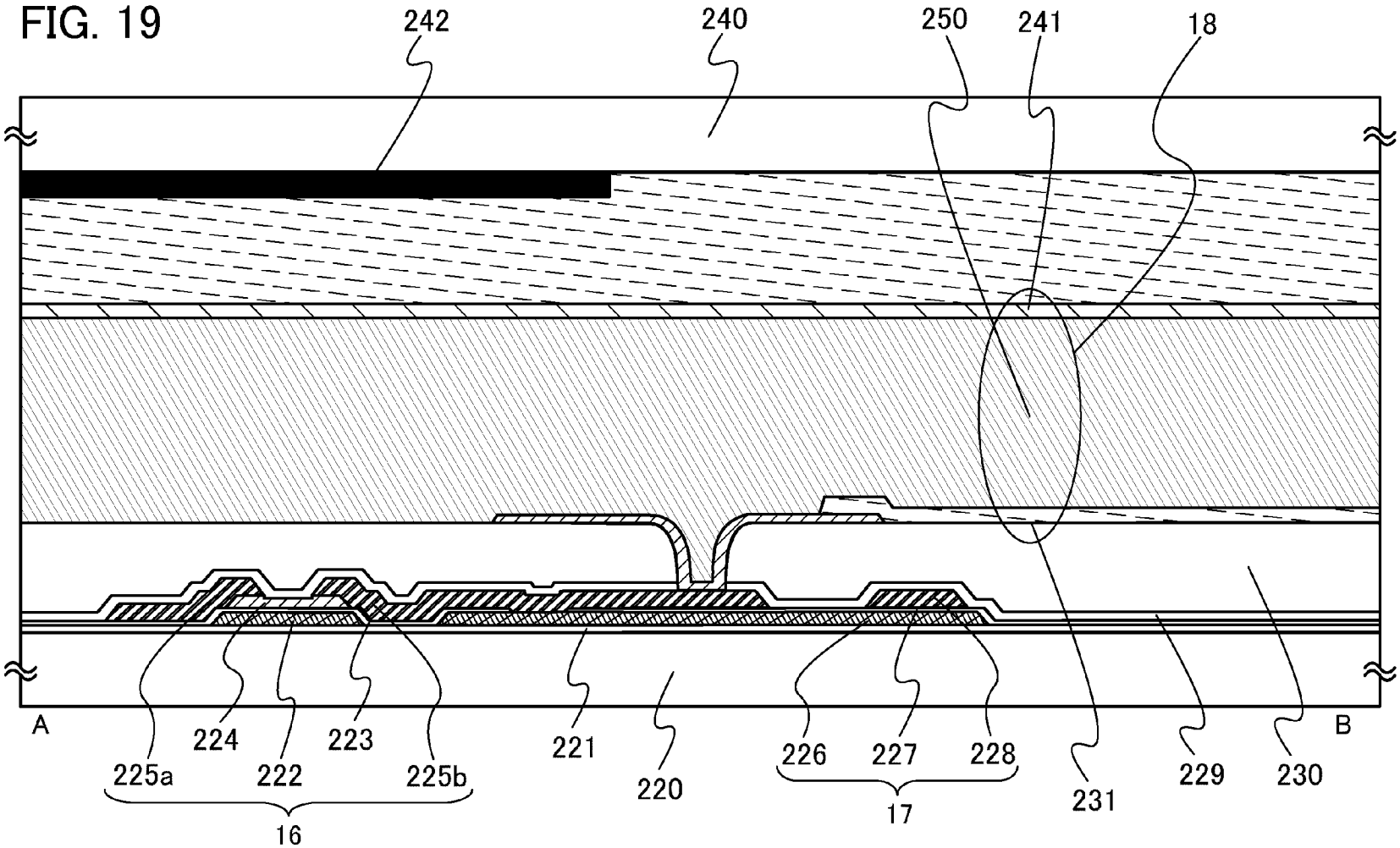
FIG. 19 is a cross-sectional view illustrating the specific example of a layout of a pixel.

Next, a specific example of a layout of the pixel in the above liquid crystal display device is described with reference to FIG. 18 and FIG. 19. FIG. 18 is a top view of a layout of the pixel illustrated in FIG. 1B, and FIG. 19 is a cross-sectional view along line A-B in FIG. 18. Note that, in FIG. 18, some components such as a liquid crystal layer and a counter electrode are not illustrated. A specific structure is described with reference to FIG. 19.

The transistor 16 includes a conductive layer 222 provided over a substrate 220 with an insulating layer 221 interposed therebetween, an insulating layer 223 provided over the conductive layer 222, a semiconductor layer 224 provided over the conductive layer 222 with the insulating layer 223 interposed therebetween, a conductive layer 225*a* provided over one of ends of the semiconductor layer 224, and a conductive layer 225*b* provided over the other end of the semiconductor layer 224. The conductive layer 222 functions as a gate layer, and the insulating layer 223 functions as a gate insulating layer. One of the conductive layer 225*a* and the conductive layer 225*b* functions as a source layer and the other functions as a drain layer.

The capacitor 17 includes a conductive layer 226 provided over the substrate 220 with the insulating layer 221 interposed therebetween, an insulating layer 227 provided over the conductive layer 226, and a conductive layer 228 provided over the conductive layer 226 with the insulating layer 227 interposed therebetween. Note that the conductive layer 226 functions as one of electrodes of the capacitor 17, the insulating layer 227 functions as a dielectric of the capacitor 17, and the conductive layer 228 functions as the other electrode of the capacitor 17. The conductive layer 226 is formed using a material same as that of the conductive layer 222, the insulating layer 227 is formed using a material same as that of the insulating layer 223, and the conductive layer 228 is formed using a material same as that of the conductive layer 225*a* and the conductive layer 225*b*. The conductive layer 226 is electrically connected to the conductive layer 225*b*.

Over the transistor 16 and the capacitor 17, an insulating layer 229 and a planarization insulating layer 230 are provided.

The liquid crystal element 18 includes a transparent conductive layer 231 provided over the planarization insulating layer 230, a transparent conductive layer 241 provided for a counter substrate 240, and a liquid crystal layer 250 sandwiched between the transparent conductive layer 231 and the transparent conductive layer 241. Note that the transparent conductive layer 231 functions as a pixel electrode of the liquid crystal element 18 and the transparent conductive layer 241 functions as a counter electrode of the liquid crystal element 18. The transparent conductive layer 231 is electrically connected to the conductive layer 225*b* and the conductive layer 226.

An alignment film may be provided as appropriate between the transparent conductive layer 231 and the liquid crystal layer 250 or between the transparent conductive layer 241 and the liquid crystal layer 250. The alignment film can be formed using an organic resin such as polyimide or polyvinyl alcohol. The surface is subjected to alignment treatment such as rubbing in order to align liquid crystal molecules in a certain direction. Rubbing can be performed by rolling a roller wrapped with cloth of nylon or the like while being in contact with the alignment film, and the surface of the alignment film is rubbed in a certain direction. Note that it is also possible to form the alignment film that has alignment characteristics by evaporation or the like with use of inorganic materials such as silicon oxide, without alignment treatment.

Injection of liquid crystal for formation of the liquid crystal layer 205 may be performed by a dispenser method (dripping method) or a dipping method (pumping method).

Note that a blocking layer 242 which can block light is provided over the counter substrate 240 in order to prevent disclination caused by disorder of the orientation of the liquid crystal between pixels or prevent incidence of diffused light on a plurality of pixels concurrently. An organic resin containing black colorant such as carbon black or low order titanium oxide having an oxidation number smaller than that of titanium dioxide can be used for the blocking layer 242. Alternatively, a film formed using chromium can be used for the blocking layer 242.

The transparent conductive layer 231 and the transparent conductive layer 241 can be formed using a light-transmitting conductive material such as indium tin oxide including silicon oxide (ITSO), indium tin oxide (ITO), zinc oxide (ZnO), indium zinc oxide (IZO), or zinc oxide to which gallium is added (GZO), for example.

Although the liquid crystal element in FIG. 19 in which the liquid crystal layer 250 is sandwiched between the transparent conductive layer 231 and the transparent conductive layer 241 is described as an example, the liquid crystal display device according to one embodiment of the present invention is not limited to the above structure. A pair of electrodes may be formed over one substrate as in an IPS liquid crystal element or a liquid crystal element using a blue phase.

<Specific Example of Liquid Crystal Display Device>

Figure 20A:
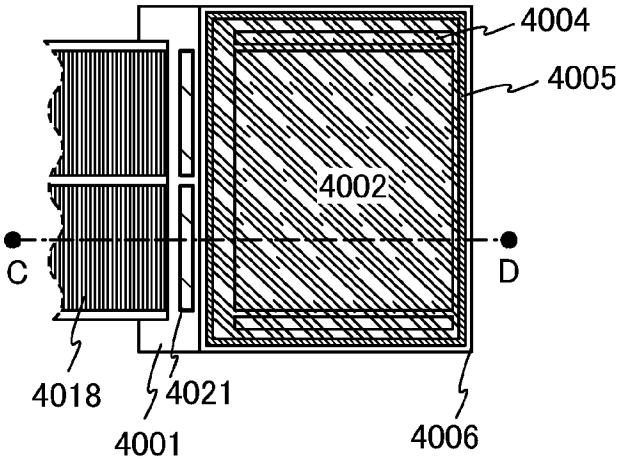
FIG. 20A is a top view illustrating a specific example of a liquid crystal display device.
Figure 20B:
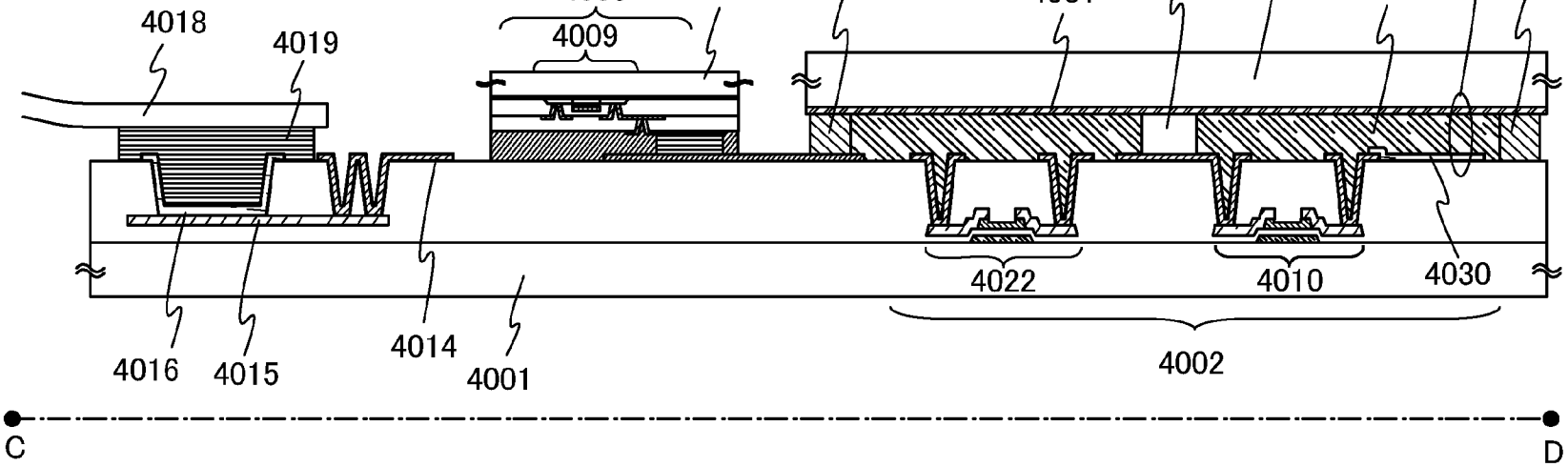
FIG. 20B is a cross-sectional view thereof.

Next, the appearance of a panel in the liquid crystal display device is described with reference to FIGS. 20A and 20B. FIG. 20A is a top view of the panel in which a substrate 4001 and a counter substrate 4006 are bonded to each other with a sealant 4005. FIG. 20B is a cross-sectional view along dashed line C-D in FIG. 20A.

The sealant 4005 is provided so as to surround a pixel portion 4002 and a scan line driver circuit 4004 provided over the substrate 4001. In addition, the counter substrate 4006 is provided over the pixel portion 4002 and the scan line driver circuit 4004. Thus, the pixel portion 4002 and the scan line driver circuit 4004 are sealed together with liquid crystal 4007 by the substrate 4001, the sealant 4005, and the counter substrate 4006.

A substrate 4021 provided with a signal line driver circuit 4003 is mounted in a region over the substrate 4001, which is different from a region surrounded by the sealant 4005. FIG. 20B illustrates a transistor 4009 included in the signal line driver circuit 4003, as an example.

A plurality of transistors are included in the pixel portion 4002 and the scan line driver circuit 4004 which are provided over the substrate 4001. FIG. 20B illustrates a transistor 4010 and a transistor 4022 that are included in the pixel portion 4002.

A pixel electrode 4030 included in a liquid crystal element 4011 is electrically connected to the transistor 4010. A counter electrode 4031 of the liquid crystal element 4011 is formed on the counter substrate 4006. A portion where the pixel electrode 4030, the counter electrode 4031, and the liquid crystal 4007 overlap with one another corresponds to the liquid crystal element 4011.

A spacer 4035 is provided to control a distance (cell gap) between the pixel electrode 4030 and the counter electrode 4031. FIG. 20B shows the case where the spacer 4035 is formed by patterning of an insulating film; alternatively, a spherical spacer may be used.

A variety of signals and potentials that are applied to the signal line driver circuit 4003, the scan line driver circuit 4004, and the pixel portion 4002 are supplied from a connection terminal 4016 through leading wirings 4014 and 4015. The connection terminal 4016 is electrically connected to a FPC 4018 with an anisotropic conductive film 4019.

Note that as the substrate 4001, the counter substrate 4006, and the substrate 4021, glass, ceramics, or plastics can be used. Plastics include, in its category, a fiberglass-reinforced plastic (FRP) plate, a polyvinyl fluoride (PVF) film, a polyester film, an acrylic resin film, and the like.

Note that a substrate placed in a direction in which light is extracted through the liquid crystal element 4011 is formed using a light-transmitting material such as a glass plate, plastic, a polyester film, or an acrylic film.

Figure 21:
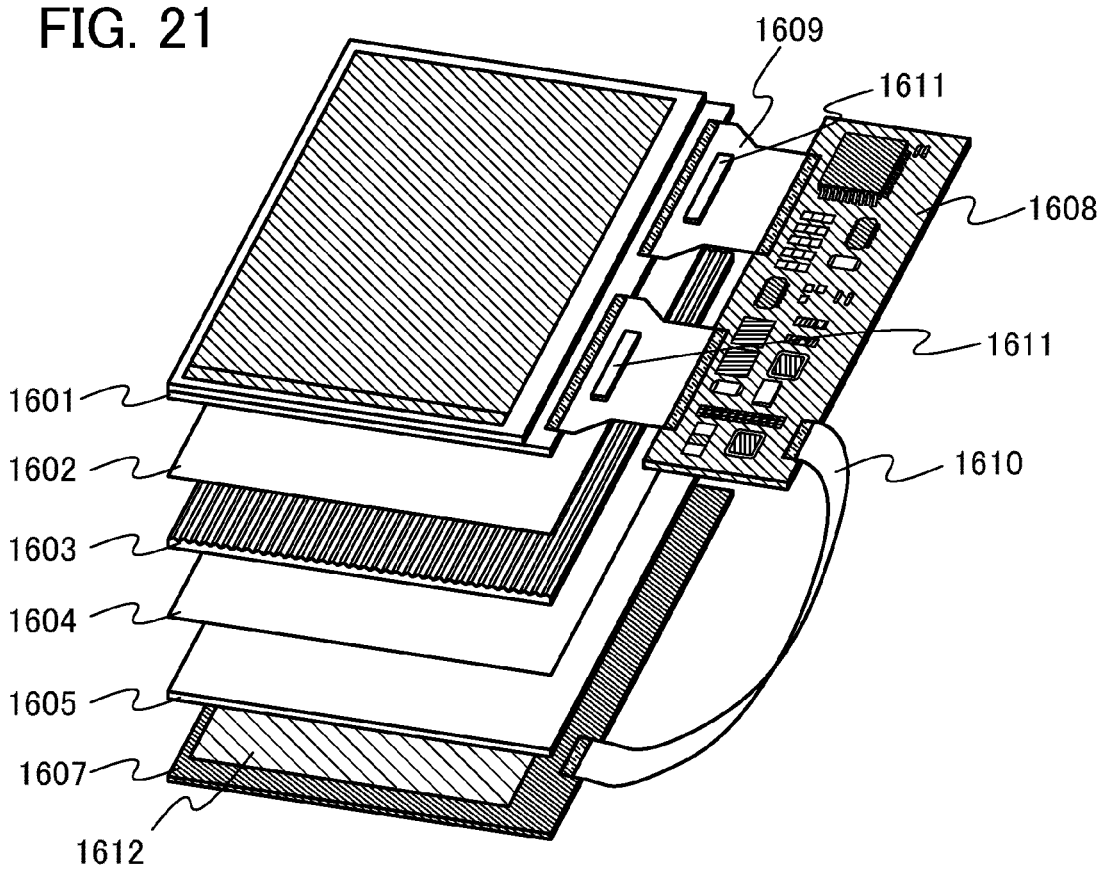
FIG. 21 is a perspective view illustrating a specific example of a liquid crystal display device.

FIG. 21 shows an example of a perspective view illustrating the structure of the liquid crystal display device according to one embodiment of the present invention. The liquid crystal display device in FIG. 21 includes a panel 1601 including a pixel portion, a first diffusion plate 1602, a prism sheet 1603, a second diffusion plate 1604, a light guide plate 1605, a backlight panel 1607, a circuit board 1608, and a substrate 1611 provided with a signal line driver circuit.

The panel 1601, the first diffusion plate 1602, the prism sheet 1603, the second diffusion plate 1604, the light guide plate 1605, and the backlight panel 1607 are sequentially stacked. The backlight panel 1607 includes a backlight 1612 including a plurality of backlight units. Light from the backlight 1612 that is diffused in the light guide plate 1605 is delivered to the panel 1601 through the first diffusion plate 1602, the prism sheet 1603, and the second diffusion plate 1604.

Although the first diffusion plate 1602 and the second diffusion plate 1604 are used here, the number of diffusion plates is not limited to two. One diffusion plate or three or more diffusion plates may be provided. The diffusion plate may be provided between the light guide plate 1605 and the panel 1601. Therefore, the diffusion plate may be provided only on the side closer to the panel 1601 than the prism sheet 1603, or may be provided only on the side closer to the light guide plate 1605 than the prism sheet 1603.

The prism sheet 1603 is not limited to having a sawtooth shape in section as illustrated in FIG. 21 and can have a shape with which light from the light guide plate 1605 can be concentrated on the panel 1601 side.

The circuit board 1608 is provided with a circuit which generates various signals input to the panel 1601, a circuit which processes the signals, or the like. In FIG. 21, the circuit board 1608 and the panel 1601 are connected to each other via a COF (chip on film) tape 1609. Further, the substrate 1611 provided with the signal line driver circuits are connected to the COF tape 1609 by a chip on film (COF) method.

FIG. 21 illustrates the example in which the circuit board 1608 is provided with a controller circuit that controls driving of the backlight 1612 and the controller circuit and the backlight panel 1607 are connected to each other via an FPC 1610. Note that the control circuit may be formed over the panel 1601. In that case, the panel 1601 and the backlight panel 1607 are connected to each other through an FPC or the like.

<Electronic Devices Including Liquid Crystal Display Device>

Examples of electronic devices each including the liquid crystal display device disclosed in this specification are described below with reference to FIGS. 22A to 22F.

Figure 22A:
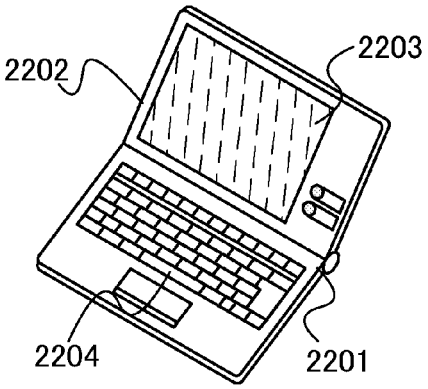
FIGS. 22A to 22F illustrate examples of electronic devices.

FIG. 22A illustrates a laptop personal computer, which includes a main body 2201, a housing 2202, a display portion 2203, a keyboard 2204, and the like.

Figure 22B:
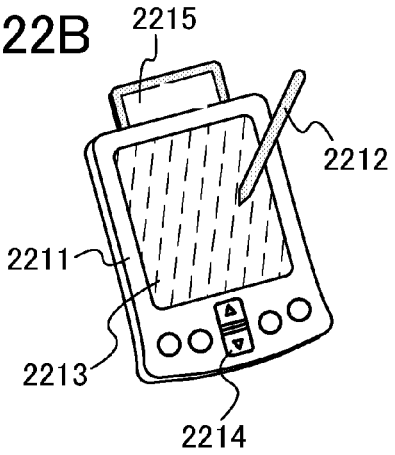

FIG. 22B illustrates a portable information terminal (PDA), which includes a main body 2211 provided with a display portion 2213, an external interface 2215, operation buttons 2214, and the like. A stylus 2212 for operation is included as an accessory.

Figure 22C:
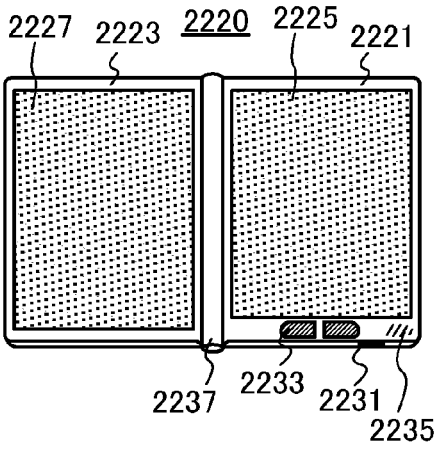

FIG. 22C illustrates an e-book reader 2220. The e-book reader 2220 includes two housings, a housing 2221 and a housing 2223. The housings 2221 and 2223 are bound with each other by an axis portion 2237 along which the e-book reader 2220 can be opened and closed. With such a structure, the e-book reader 2220 can be used as paper books.

A display portion 2225 is incorporated in the housing 2221, and a display portion 2227 is incorporated in the housing 2223. The display portion 2225 and the display portion 2227 may display one image or different images. In the case where the display portions 2225 and 2227 display different images, for example, a display portion on the right side (the display portion 2225 in FIG. 22C) can display text and a display portion on the left side (the display portion 2227 in FIG. 22C) can display images.

Further, in FIG. 22C, the housing 2221 includes an operation portion and the like. For example, the housing 2221 is provided with a power supply 2231, an operation key 2233, a speaker 2235, and the like. With the operation key 2233, pages can be turned. Note that a keyboard, a pointing device, or the like may also be provided on the surface of the housing, on which the display portion is provided. Furthermore, an external connection terminal (an earphone terminal, a USB terminal, a terminal that can be connected to an AC adapter or various cables such as a USB cable, or the like), a recording medium insertion portion, and the like may be provided on the back surface or the side surface of the housing. Further, the e-book reader 2220 may have a function of an electronic dictionary.

The e-book reader 2220 may be configured to transmit and receive data wirelessly. Through wireless communication, desired book data or the like can be purchased and downloaded from an electronic book server.

Figure 22D:
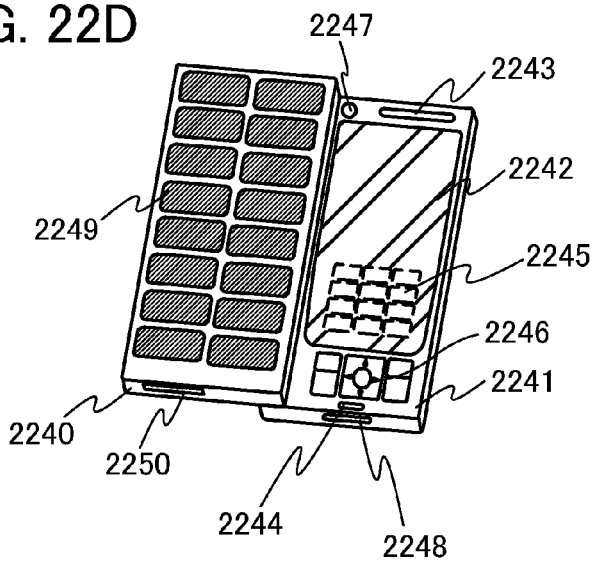

FIG. 22D illustrates a mobile phone. The mobile phone includes two housings: housings 2240 and 2241. The housing 2241 is provided with a display panel 2242, a speaker 2243, a microphone 2244, a pointing device 2246, a camera lens 2247, an external connection terminal 2248, and the like. The housing 2240 is provided with a solar cell 2249 charging of the mobile phone, an external memory slot 2250, and the like. An antenna is incorporated in the housing 2241.

The display panel 2242 has a touch panel function. A plurality of operation keys 2245 which are displayed as images are indicated by dashed lines in FIG. 22D. Note that the mobile phone includes a booster circuit for increasing a voltage output from the solar cell 2249 to a voltage needed for each circuit. Moreover, the mobile phone can include a contactless IC chip, a small recording device, or the like in addition to the above structure.

The display orientation of the display panel 2242 changes as appropriate in accordance with the application mode. Further, the camera lens 2247 is provided on the same surface as the display panel 2242, and thus it can be used as a video phone. The speaker 2243 and the microphone 2244 can be used for videophone calls, recording, and playing sound, etc. as well as voice calls. Furthermore, the housings 2240 and 2241 which are developed as illustrated in FIG. 22D can overlap with each other by sliding; thus, the size of the mobile phone can be decreased, which makes the mobile phone suitable for being carried.

The external connection terminal 2248 can be connected to an AC adapter or a variety of cables such as a USB cable, which enables charging of the mobile phone and data communication. Moreover, a larger amount of data can be saved and transferred by inserting a recording medium to the external memory slot 2250. Further, in addition to the above functions, an infrared communication function, a television reception function, or the like may be provided.

Figure 22E:
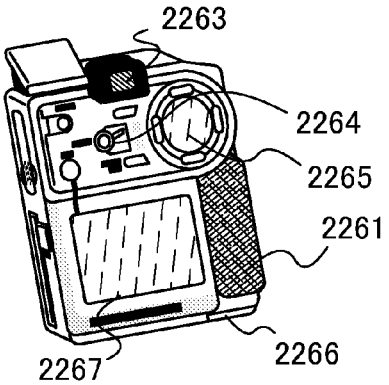

FIG. 22E illustrates a digital camera. The digital camera includes a main body 2261, a display portion (A) 2267, an eyepiece 2263, an operation switch 2264, a display portion (B) 2265, a battery 2266, and the like.

Figure 22F:
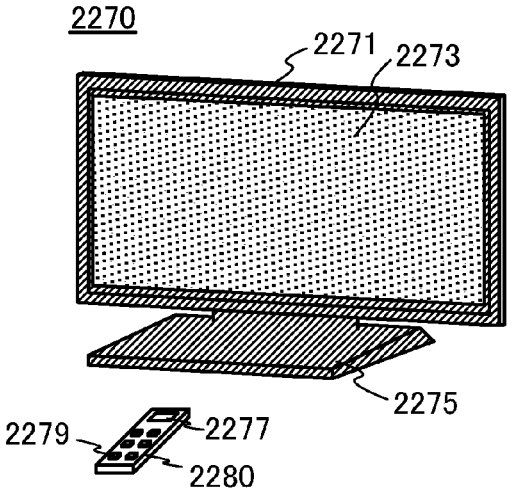

FIG. 22F illustrates a television set. In a television set 2270, a display portion 2273 is incorporated in a housing 2271. The display portion 2273 can display images. Here, the housing 2271 is supported by a stand 2275.

The television set 2270 can be operated by an operation switch of the housing 2271 or a separate remote controller 2280. Channels and volume can be controlled with an operation key 2279 of the remote controller 2280 so that an image displayed on the display portion 2273 can be controlled. Moreover, the remote controller 2280 may have a display portion 2277 in which the information outgoing from the remote controller 2280 is displayed.

Note that the television set 2270 is preferably provided with a receiver, a modem, and the like. A general television broadcast can be received with the receiver. Moreover, when the television set is connected to a communication network with or without wires via the modem, one-way (from a sender to a receiver) or two-way (between a sender and a receiver or between receivers) data communication can be performed.

(Embodiment 3)

In this embodiment, one mode of a substrate used in the liquid crystal display device according to one embodiment of the present invention will be described with reference to FIGS. 23A to 23E and 23C' to 23E' and FIGS. 24A to 24C.

First, over a manufacturing substrate 6200, a layer 6116 to be separated from the manufacturing substrate 6200 and including components necessary for an element substrate, such as a transistor, an interlayer insulating film, a wiring, and a pixel electrode, is formed with a separation layer 6201 separating the layer 6116 from the manufacturing substrate 6200.

The manufacturing substrate 6200 may be a quartz substrate, a sapphire substrate, a ceramic substrate, a glass substrate, a metal substrate, or the like. Note that the substrate has a thickness sufficient for not exhibiting excessive flexibility, whereby an element such as a transistor can be formed with high accuracy. The description "the substrate has a thickness sufficient for not exhibiting excessive flexibility" means that the substrate has elasticity which is substantially the same as or higher than elasticity of a glass substrate generally used in manufacture of a liquid crystal display.

The separation layer 6201 is formed to have a single-layer structure or a stacked structure including a layer formed of an element selected from tungsten (W), molybdenum (Mo), titanium (Ti), tantalum (Ta), niobium (Nb), nickel (Ni), cobalt (Co), zirconium (Zr), zinc (Zn), ruthenium (Ru), rhodium (Rh), palladium (Pd), osmium (Os), iridium (Ir), or silicon (Si); or an alloy or compound material containing any of the elements as its main component by a sputtering method, a plasma CVD method, a coating method, a printing method, or the like.

If the case where the separation layer 6201 has a single-layer structure, it is preferable to form a tungsten layer, a molybdenum layer, or a layer containing a mixture of tungsten and molybdenum. Alternatively, the separation layer 6201 can be formed using a layer containing an oxide of tungsten, a layer containing an oxynitride of tungsten, a layer containing an oxide of molybdenum, a layer containing an oxynitride of molybdenum, or a layer containing an oxide or an oxynitride of a mixture of tungsten and molybdenum. Note that the mixture of tungsten and molybdenum corresponds to, for example, an alloy of tungsten and molybdenum.

In the case where the separation layer 6201 has a stacked structure, it is preferable that a metal layer be formed as a first layer and a metal nitride oxide layer be formed as a second layer. Typically, a tungsten layer, a molybdenum layer, or a layer containing a mixture of tungsten and molybdenum is preferably formed as the first layer. An oxide of tungsten, molybdenum, or a mixture of tungsten and molybdenum; a nitride of tungsten, molybdenum, or a mixture of tungsten and molybdenum; an oxynitride of tungsten, molybdenum, or a mixture of tungsten and molybdenum; or a nitride oxide of tungsten, molybdenum, or a mixture of tungsten and molybdenum is preferably formed as the second layer. The metal oxide layer of the second layer may be formed as follows: an oxide layer (for example, a layer which can be used as an insulating layer such as a silicon oxide layer) is formed over the metal layer of the first layer, so that an oxide of the metal is formed over a surface of the metal layer.

Figure 23A:
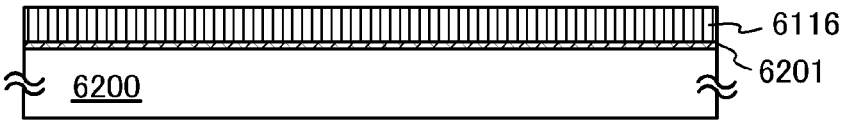
FIGS. 23A to 23E and 23C' to 23E' illustrate one mode of a substrate used in a liquid crystal display device.

Then, the layer 6116 to be separated is formed over the separation layer 6201 (see FIG. 23A). The layer 6116 to be separated includes component necessary for an element substrate, such as a transistor, an interlayer insulating film, a wiring, and a pixel electrode. Such components can be formed by a photolithography step.

Figure 23B:
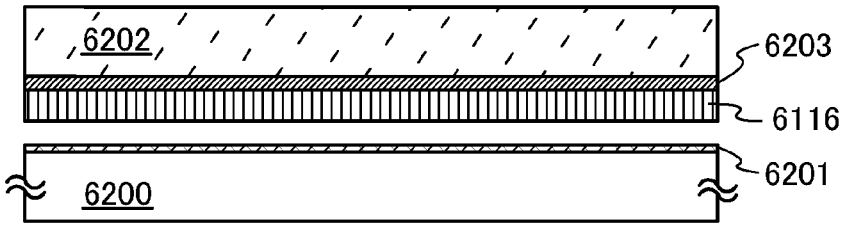

Then, the layer 6116 to be separated is bonded to a temporary supporting substrate 6202 with an adhesive 6203 for separation, and the layer 6116 to be separated is separated from the separation layer 6201 which is formed over the manufacturing substrate 6200 and transferred (see FIG. 23B). By this process, the layer 6116 is placed on the temporary supporting substrate side. In this specification, a step in which the layer to be separated is transferred from the manufacturing substrate side to the temporary supporting substrate side is referred to as a transfer step.

As the temporary supporting substrate 6202, a glass substrate, a quartz substrate, a sapphire substrate, a ceramic substrate, a metal substrate, or the like can be used. Alternatively, a plastic substrate which can withstand the process temperature performed later may be used.

As the adhesive 6203 for separation which is used here, an adhesive which is soluble in water or a solvent, an adhesive which is capable of being plasticized upon irradiation of UV light, and the like are used so that the temporary supporting substrate 6202 and the layer 6116 to be separated can be separated when necessary.

A variety of methods can be given as a method as the step for transferring the layer to be separated to the temporary supporting substrate 6202. For example, when a layer including a metal oxide film is formed as the separation layer 6201 on the side in contact with the layer 6116 to be separated, the metal oxide film is embrittled by crystallization, whereby the layer 6116 to be separated can be separated from the manufacturing substrate 6200. In the case where an amorphous silicon film containing hydrogen is formed as the separation layer 6201 between the manufacturing substrate 6200 and the layer 6116 to be separated, the amorphous silicon film containing hydrogen is removed by irradiation with laser light or etching, whereby the layer 6116 to be separated can be separated from the manufacturing substrate 6200. Alternatively, in the case where a film containing nitrogen, oxygen, hydrogen, or the like (e.g., an amorphous silicon film containing hydrogen, a film of an alloy containing hydrogen, or a film of an alloy containing oxygen) is used as the separation layer 6201, the separation layer 6201 is irradiated with layer light so that nitrogen, oxygen, or hydrogen contained in the separation layer 6201 is released as a gas to promote separation between the layer 6116 to be separated and the manufacturing substrate 6200. As another method for separation, an interface between the separation layer 6201 and the layer 6116 to be separated is soaked with liquid, whereby the layer 6116 is separated from the manufacturing substrate 6200. Further, as another separation method, when the separation layer 6201 is formed using tungsten, the separation may be performed while the separation layer 6201 is etched with use of a mixed solution of ammonia water and a hydrogen peroxide solution.

When a plurality of the above-described separation methods is combined, a separation step can be conducted easily. The separation step using combined methods is performed as follows. Laser light irradiation, etching with a gas, a solution, or the like, mechanical removing with a sharp knife or scalpel is partially applied to the separation layer 6201, so that the separation layer 6201 and the layer 6116 to be separated can be in a state where separation is easily conducted; and after that, separation is performed with physical force (by a machine or the like). In the case where the separation layer 6201 is formed to have a stacked structure of a metal and a metal oxide, a groove formed by laser irradiation or a scratch formed with a sharp knife or scalpel are used as a trigger, so that physical separation of the separation layer 6201 can be easily formed.

Further alternatively, the separation may be performed while pouring a liquid such as water during the separation.

As an alternative method for separating the layer 6116 to be separated from the manufacturing substrate 6200, a method in which the manufacturing substrate 6200 provided with the layer 6116 to be separated is removed by mechanical polishing or the like, a method in which the manufacturing substrate 6200 is removed by etching with use of a solution or a halogen fluoride gas such as $NF_3$, $BrF_3$, or $ClF_3$, or the like can be used. In this case, the separation layer 6201 is not necessarily provided.

Figure 23C:
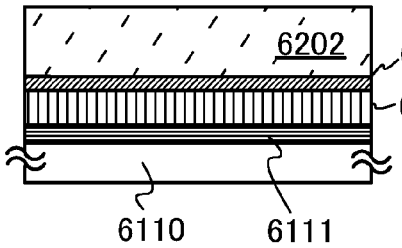
Figure 23C:
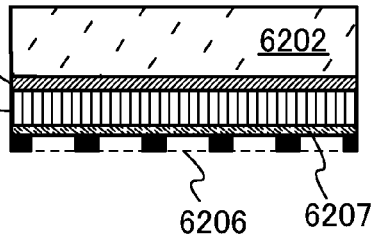

Next, the exposed separation layer 6201 separated from the manufacturing substrate 6200 or a surface of separated the layer 6116 are bonded to a transfer substrate 6110 with a first adhesive layer 6111 different from the adhesive 6203 for separation (see FIG. 23C).

As a material of the first adhesive layer 6111, any kind of curable adhesives, e.g., a light curable adhesive such as a UV curable adhesive, a reactive curable adhesive, a thermal curable adhesive, and an anaerobic adhesive can be used.

As the transfer substrate 6110, a substrate with high toughness is used. For example, an organic resin film, a metal substrate, or the like can be preferably used. The substrate with high toughness is excellent in impact resistance and hardly damaged. When the organic resin film or the metal substrate are employed, significant reduction in weight can be achieved as compared to the case where a general glass substrate is used, because the organic resin film and the thin metal substrate are lightweight. With such a substrate, a display device which is light and hardly damaged can be manufactured.

As a material included in such a substrate, for example, a polyester resin such as polyethylene terephthalate (PET) or polyethylene naphthalate (PEN), an acrylic resin, a polyacrylonitrile resin, a polyimide resin, a polymethyl methacrylate resin, a polycarbonate (PC) resin, a polyethersulfone (PES) resin, a polyamide resin, a cycloolefin resin, a polystyrene resin, a polyamide imide resin, a polyvinylchloride resin, or the like can be used. The substrate including any of the above organic resins has high toughness and thus is excellent in impact resistance and hardly damaged. Further, since the organic resin film is light, a display device which can be highly lightweight, as compared to the case of using a general glass substrate, can be manufactured. In this case, it is preferable that the transfer substrate 6110 be provided with a metal plate 6206 which has openings at portions overlapping with at least regions through which light of pixels is transmitted. With such a structure, the transfer substrate 6110 in which a change in size is suppressed can have high toughness and be excellent in impact resistance and hardly damaged. Further, when the thickness of the metal plate 6206 is reduced, the weight of the transfer substrate 6110 can be smaller than that of the conventional glass substrate. With such a substrate, a display device which is lightweight and hardly damaged can be manufactured (see FIG. 23D).

Figure 24A:
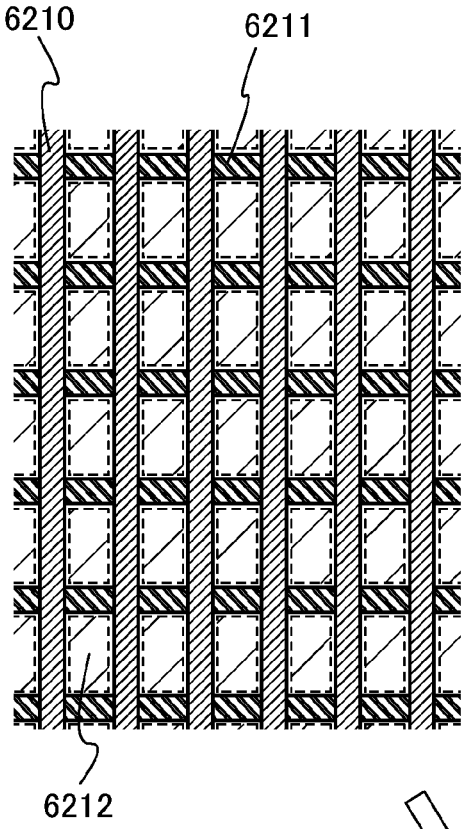
FIGS. 24A to 24C illustrate an example of a liquid crystal display device.
Figure 24B:
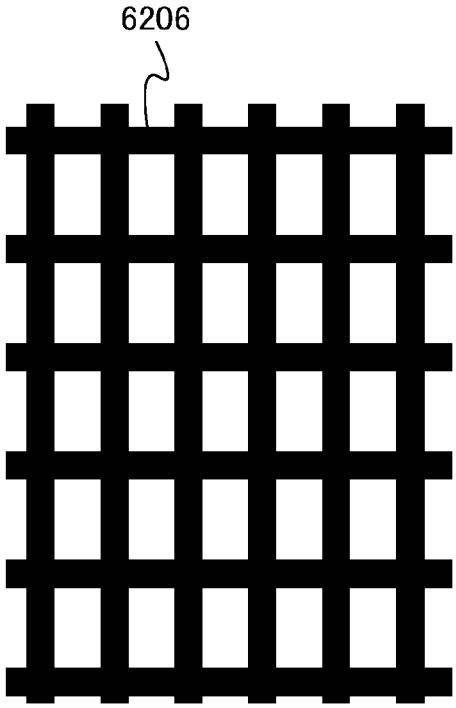
Figure 24C:
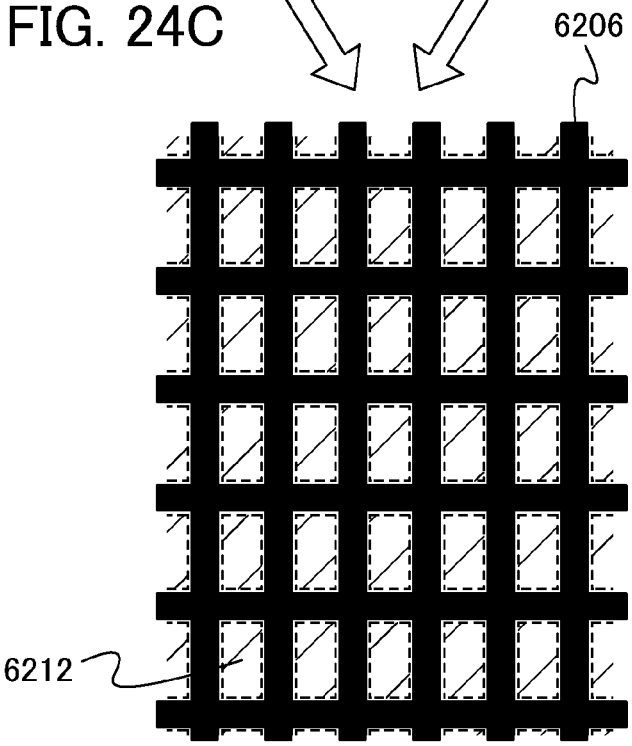

FIG. 24A illustrates an example of a top view of a liquid crystal display device. In FIG. 24A, a first wiring layer 6210 and a second wiring layer 6211 intersect with each other, and a region surrounded by the first wiring layer 6210 and the second wiring layer 6211 is a region 6212 through which light is transmitted. In the liquid crystal display device illustrated in FIG. 24A, the portion overlapping with the first wiring layer 6210 and the second wiring layer 6211 is left as illustrated in FIG. 24B; thus, the metal plate 6206 having openings designed in a grid is preferably used. When such a metal plate 6206 is attached to the liquid crystal display device, degradation in alignment accuracy due to use of the organic resin substrate or a change in size due to extension of the substrate can be suppressed (see FIG. 24C). Further, in the case where a polarization plate (not illustrated) is needed, the polarization plate may be provided between the transfer substrate 6110 and the metal plate 6206 or on an outer side of the metal plate 6206. The polarization plate may be attached to the metal plate 6206 in advance. In consideration of lightweight, it is preferable to employ a substrate whose thickness is reduced to the extent that the metal plate 6206 gives the effect of the dimension stabilization.

After that, the temporary supporting substrate 6202 is separated from the layer 6116. The adhesive 6203 for separation is formed using a material which allows separation between the temporary supporting substrate 6202 and the layer 6116 when needed; thus, the temporary supporting substrate 6202 may be separated by a method appropriate for the material. Note that light from the backlight is emitted in the direction of arrows (see FIG. 23E).

As described above, the layer 6116 where a transistor and a pixel electrode are formed can be formed over the transfer substrate 6110, and an element substrate which is lightweight and excellent in impact resistance can be manufactured.

<Modification Example>

A display device having the aforementioned structure is one embodiment of the present invention, and the present invention includes a display device described below, which has some differences from the aforementioned display device. After the transfer step (see FIG. 23B) and before bonding of the transfer substrate 6110, the metal plate 6206 may be bonded to a surface of the exposed separation layer 6201 or the surface of the separated layer 6116 (see FIG. 23C'). In this case, a barrier layer 6207 is preferably provided between the metal plate 6206 and the layer 6116 in order to prevent contaminants in the metal plate 6206 from giving an adverse effect on characteristics of the transistor provided for the layer 6116. In the case of providing the barrier layer 6207, the barrier layer 6207 may be provided on the surface of the exposed separation layer 6201 or the surface of the layer 6116, and then the metal plate 6206 may be bonded. The barrier layer 6207 is preferably formed using an inorganic material or an organic material, e.g., silicon nitride; however, a material of the barrier layer 6207 is not limited thereto as long as contamination of the transistor can be prevented. The barrier layer 6207 is formed so as to have a light-transmitting property at least with respect to visible light; for example, the barrier layer 6207 is formed using a light-transmitting material or formed with a small thickness enough to have a light-transmitting property. Note that for the bond of the metal plate 6206, a second adhesive layer (not illustrated) which is formed using a different adhesive from the adhesive 6203 for separation may be used.

Figure 23D:
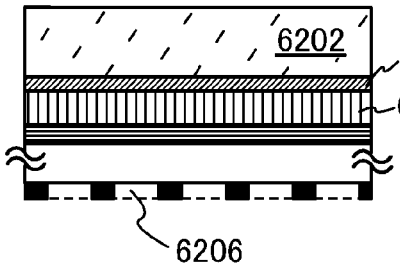
Figure 23D:
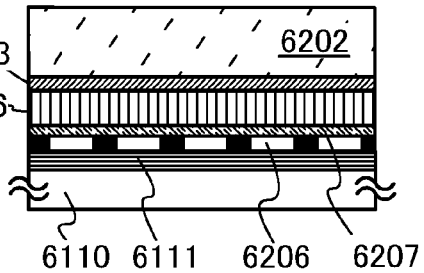
Figure 23E:
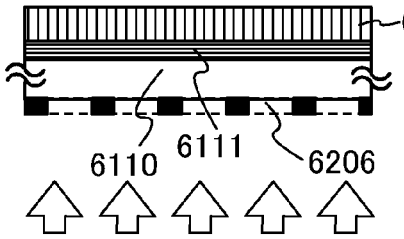
Figure 23E:
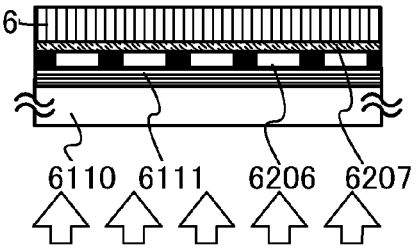

Next, the first adhesive layer 6111 is formed on the surface of the metal plate 6206 and the transfer substrate 6110 is bonded thereto (see FIG. 23D'). Then, the temporary supporting substrate 6202 is separated from the layer 6116 (see FIG. 23E'). Thus, an element substrate which is lightweight and excellent in impact resistance can be manufactured. Note that light from the backlight is emitted in the direction of arrows.

When the thus manufactured element substrate which is lightweight and excellent in impact resistance and the counter substrate are fixed to each other with a sealant with the liquid crystal layer interposed therebetween, a liquid crystal display device which is lightweight and excellent in impact resistance can be manufactured. As the counter substrate, a substrate with high toughness and a light-transmitting property with respect to visible light (which is similar to a plastic substrate that can be used for the transfer substrate 6110) can be used. If necessary, a polarization plate, a black matrix, and an alignment film may be further provided. As a formation method of the liquid crystal layer, a dispenser method, an injection method, or the like can be used.

In the above described liquid crystal display device which is lightweight and excellent in impact resistance, a minute element such as a transistor can be formed over a glass substrate whose dimension stability is relatively favorable. In addition, the conventional manufacturing method can be applied to such a liquid crystal display device. Thus, a minute element can be formed with high accuracy. Therefore, a lightweight liquid crystal display device which can provide images having higher definition and high quality and has impact resistance, can be provided.

In addition, the above manufactured liquid crystal display device can have flexibility.

EXPLANATION OF REFERENCES

10: pixel portion, 11: scan line driver circuit, 12: signal line driver circuit, 13: scan line, 14: signal line, 15: pixel, 16: transistor, 17: capacitor, 18: liquid crystal element, 19: liquid crystal panel, 20: pulse output circuit, 21: terminal, 22: terminal, 23: terminal, 24: terminal, 25: terminal, 26: terminal, 27: terminal, 31: transistor, 32: transistor, 33: transistor, 34: transistor, 35: transistor, 36: transistor, 37: transistor, 38: transistor, 39: transistor, 40: backlight panel, 41: backlight array, 41$a_1$: backlight array, 41$a_2$: backlight array, 41$a_3$: backlight array, 41$a_4$: backlight array, 41$b_1$: backlight array, 41$c_1$: backlight array, 41$c_4$: backlight array, 42: backlight unit, 45: backlight driver circuit, 46*a*: pulse width modulation circuit, 50: transistor, 51: transistor, 52: transistor, 53: transistor, 70: image processing circuit, 71: AD converter, 72: frame memory, 73: maximum value detection circuit, 73*a*: maximum value detection circuit, 73*b*: maximum value detection circuit, 73*c*: maximum value detection circuit, 74: gamma correction circuit, 74*a*: gamma correction circuit, 74*b*: gamma correction circuit, 74*c*: gamma correction circuit, 101: region, 102: region, 103: region, 120: shift register, 121: transistor, 220: substrate, 221: insulating layer, 222: conductive layer, 223: insulating layer, 224: semiconductor layer, 225*a*: conductive layer, 225*b*: conductive layer, 226: conductive layer, 227: insulating layer, 228: conductive layer, 229: insulating layer, 230: planarization insulating layer, 231: transparent conductive layer, 240: counter substrate, 241: transparent conductive layer, 242: blocking layer, 250: liquid crystal layer, 265: transparent conductive layer, 1601: panel, 1602: diffusion plate, 1603: prism sheet, 1604: diffusion plate, 1605: light guide plate, 1607: backlight panel, 1608: circuit board, 1609: COF tape, 1610: FPC, 1611: substrate, 1612: backlight, 2201: main body, 2202: housing, 2203: display portion, 2204: keyboard, 2211: main body, 2212: stylus, 2213: display portion, 2214: operation button, 2215: external interface, 2220: e-book reader, 2221: housing, 2223: housing, 2225: display portion, 2227: display portion, 2231: power supply, 2233: operation key, 2235: speaker, 2237: axis portion, 2240: housing, 2241: housing, 2242: display panel, 2243: speaker, 2244: microphone, 2245: operation key, 2246: pointing device, 2247: camera lens, 2248: external connection terminal, 2249: solar cell, 2250: external memory slot, 2261: main body, 2263: eyepiece, 2264: operation switch, 2265: display portion (B), 2266: battery, 2267: display portion (A), 2270: television set, 2271: housing, 2273: display portion, 2275: stand, 2277: display portion, 2279: operation key, 2280: separate remote controller, 2400: substrate, 2401: gate layer, 2402: gate insulating layer, 2403: semiconductor layer, 2405*a*: source layer, 2405*b*: drain layer, 2406: channel protective layer, 2407: insulating layer, 2409: protective insulating layer, 2411: gate layer, 2412: gate layer, 2413: gate insulating layer, 2414: gate insulating layer, 2436: base layer, 2450: transistor, 2460: transistor, 2470: transistor, 2480: transistor, 4001: substrate, 4002: pixel portion, 4003: signal line driver circuit, 4004: scan line driver circuit, 4005: sealant, 4006: counter substrate, 4007: liquid crystal, 4009: transistor, 4010: transistor, 4011: liquid crystal element, 4014: wiring, 4015: wiring, 4016: connection terminal, 4018: FPC, 4019: anisotropic conductive film, 4021: substrate, 4022: transistor, 4030: pixel electrode, 4031: counter electrode, 4035: spacer, 6110: transfer substrate, 6111: adhesive layer, 6116: layer, 6200: manufacturing substrate, 6201: separation layer, 6202: temporary supporting substrate, 6203: adhesive for separation, 6206: metal layer, 6207: barrier layer, 6210: wiring layer, 6211: wiring layer, 6212: region This application is based on Japanese Patent Application serial no. 2010-152411 filed with Japan Patent Office on Jul. 2, 2010, the entire contents of which are hereby incorporated by reference.

The invention claimed is:

1. A liquid crystal display device comprising a liquid crystal panel and an image processing circuit, the image processing circuit comprising:

a frame memory configured to store at least data of an image to be displayed by the liquid crystal panel; and a maximum value detection circuit functionally connected to the frame memory, and comprising:

a first maximum value detection sub-circuit configured to detect a highest brightness of a first color tone in a first region of the image; and a second maximum value detection sub-circuit configured to detect a highest brightness of a second color tone in a second region of the image, wherein the liquid crystal display device is configured to:

input in a same period a first color image signal for the first color tone in rows of pixels of the first region and a second color image signal for the second color tone in rows of pixels of the second region, write image data for the first color tone in a second row of pixels of the first region while emitting light of the first color tone in a first row of pixels of the first region, the first row immediately preceding the second row, and emit simultaneously light of the first color tone in the first row and in the second row, wherein the first region and the second region are respectively formed of first consecutive rows of pixels and second consecutive rows of pixels distinct from the first consecutive rows of pixels, each pixel being able to emit light of the first color tone and light of the second color tone, wherein the first row of pixels belongs to a first group of consecutive rows of pixels of the first region to which image data for the first color tone are written in a first period, wherein the second row of pixels belongs to a second group of consecutive rows of pixels of the first region emitting light of a color tone different from the first color tone during the first period, and wherein emission of different color tones does not occur simultaneously in the first group of consecutive rows of pixels and in the second group of consecutive rows of pixels.

2. A liquid crystal display device according to claim 1, the image processing circuit further comprising a gamma correction circuit, the gamma correction circuit comprising:

a first gamma correction sub-circuit electrically connected to the first maximum value detection sub-circuit and to the liquid crystal panel, and configured to perform gamma correction on data of the first region of the image in accordance with the highest brightness of the first color tone detected in the first region of the image; and a second gamma correction sub-circuit electrically connected to the second maximum value detection sub-circuit and to the liquid crystal panel, and configured to perform gamma correction on data of the second region of the image in accordance with the highest brightness of the second color tone detected in the second region of the image.

3. A liquid crystal display device according to claim 2, wherein the first gamma correction sub-circuit and the second gamma correction sub-circuit are electrically connected to the liquid crystal panel;

wherein the first gamma correction sub-circuit is configured so that a transmittance of a pixel of the liquid crystal panel to have the highest brightness of the first color tone in the first region is maximal among the transmittance of the pixels of the first region; and wherein the second gamma correction sub-circuit is configured so that a transmittance of a pixel of the liquid crystal panel to have the highest brightness of the second color tone in the second region is maximal among the transmittance of the pixels of the second region.

4. A liquid crystal display device according to claim 1, further comprising a backlight panel and a backlight driver circuit, the backlight driver circuit comprising:

a first pulse modulation circuit electrically connected to the first maximum value detection sub-circuit and to the backlight panel; and a second pulse modulation circuit electrically connected to the second maximum value detection sub-circuit and to the backlight panel.

5. A liquid crystal display device according to claim 4, wherein the backlight panel comprises a first backlight array electrically connected to the first pulse modulation circuit and a second backlight array electrically connected to the second pulse modulation circuit.

6. A liquid crystal display device according to claim 4, wherein the backlight panel includes an LED used as light source.

7. An electronic device comprising the liquid crystal display device according to claim 1.

8. A method for driving a liquid crystal display device comprising pixels arranged in a matrix of m rows by n columns, m and n being natural numbers greater than or equal to 4, a maximum value detection circuit, and a backlight panel to emit light through the pixels, the method for driving including steps of:

inputting, into the maximum value detection circuit, a first color image signal for controlling light transmittances of pixels provided in the first to A-th rows of the matrix and corresponding to emission of light of a first color tone, A being a natural number less than or equal to m/2;

inputting, into the maximum value detection circuit, a second color image signal for controlling light transmittances of pixels provided in the (A+1)-th to 2A-th rows of the matrix and corresponding to emission of light of a second color tone;

inputting in a same period the first color image signal in a first row and the second color image signal in the (A+1)-th row;

writing image data for the first color tone in the t-th row while emitting light of the first color tone in the (t+1)-th row, t being a natural number less than or equal to m/4;

emitting simultaneously, using the backlight panel, light of the first color tone in the t-th row and in the (t+1)-th row;

detecting, in the first color image signal, a first color maximal image signal corresponding to the highest brightness of the first color tone to be displayed in a pixel of a first region, the first region being one of p regions into which the pixels of the first to A-th rows are divided, p being a natural number greater than or equal to 2;

detecting, in the second color image signal, a second color maximal image signal corresponding to the highest brightness of the second color tone to be displayed in a pixel of a second region, the second region being one of q regions into which the pixels of the (A+1)-th to 2A-th rows are divided, q being a natural number greater than or equal to 2;

applying gamma correction to the first color image signal so that transmittance of a first pixel for emitting light corresponding to the first color maximal image signal is set to maximum;

applying gamma correction to the second color image signal so that transmittance of a second pixel for emitting light corresponding to the second color maximal image signal is set to maximum;

emitting, using the backlight panel, light of the first color tone in pixels of the p regions so that light emitted by the first pixel is of the highest brightness in the first color image signal for the first color tone to be displayed in the first region; and emitting, using the backlight panel, light of a second color tone in pixels of q regions so that light emitted by the second pixel is of the highest brightness in the second color image signal for the second color tone to be displayed in the second region, wherein the p regions and the q regions are respectively formed of first consecutive rows of pixels and second consecutive rows of pixels distinct from the first consecutive rows of pixels, each pixel being able to emit light of the first color tone and light of the second color tone, wherein the t-th row of pixels belongs to a first group of a first to the t-th consecutive rows of pixels of the p regions to which image data for the first color tone are written in a first period, wherein the (t+1)-th row of pixels belongs to a second group of the (t+1)-th to a 2t-th consecutive rows of pixels of the p regions emitting light of a color tone different from the first color tone during the first period, and wherein emission of different color tones does not occur simultaneously in the first group of the first to the t-th consecutive rows of pixels and in the second group of the (t+1)-th to a 2t-th consecutive rows of pixels.

9. A method for driving a liquid crystal display device according to claim 8, wherein light emission of the first color tone in pixels of the p regions is controlled by using a first pulse width modulation circuit connected separately to each of the p regions and at a duty ratio lower than or equal to 1/(p−1); and wherein light emission of the second color tone in pixels of the q regions is controlled by using a second pulse width modulation circuit connected separately to each of the q regions and at a duty ratio lower than or equal to 1/(q−1).

10. A method for driving a liquid crystal display device according to claim 8, wherein the backlight panel includes an LED used as light source.

11. A method for driving a liquid crystal display device according to claim 8, wherein the backlight panel emits light with a frequency higher than or equal to 100 Hz and lower than or equal to 10 GHz.

12. A method for driving a liquid crystal display device comprising pixels arranged in a matrix of m rows by n columns, m and n being natural numbers greater than or equal to 4, a maximum value detection circuit, and a backlight panel to emit light through the pixels, the method for driving including steps of:

inputting, into the maximum value detection circuit, a first color image signal for controlling light transmittances of pixels provided in the first to A-th rows of the matrix and corresponding to emission of light of a first color tone, A being a natural number less than or equal to m/2;

inputting, into the maximum value detection circuit, a second color image signal for controlling light transmittances of pixels provided in the (A+1)-th to 2A-th rows of the matrix and corresponding to emission of light of a second color tone;

detecting, in the first color image signal, a first color maximal image signal corresponding to the highest brightness of the first color tone;

detecting, in the second color image signal, a second color maximal image signal corresponding to the highest brightness of the second color tone;

applying gamma correction to the first color image signal so that transmittance of a first pixel for emitting light corresponding to the first color maximal image signal is set to maximum;

applying gamma correction to the second color image signal so that transmittance of a second pixel for emitting light corresponding to the second color maximal image signal is set to maximum;

inputting in a same period the first color image signal in the first to A-th rows and the second color image signal in the (A+1)-th to 2A-th rows;

writing image data for the first color tone in the (B+1)-th to 2B-th rows while emitting light of the first color tone in the first to B-th rows, B being a natural number less than or equal to A/2;

emitting simultaneously light of the first color tone in the first to B-th rows and in the (B+1)-th to 2B-th rows;

emitting, using the backlight panel, light of the first color tone in pixels of the first to A-th rows so that light emitted by the first pixel is of the highest brightness in the first color image signal for the first color tone; and emitting, using the backlight panel, light of a second color in pixels of the (A+1)-th to 2A-th rows so that light emitted by the second pixel is of the highest brightness in the second color image signal for the second color tone, wherein the first to the A-th rows are consecutive rows of pixels able to emit light of the first color tone and light of the second color tone, wherein the (A+1)-th to the 2A-th rows are consecutive rows of pixels able to emit light of the first color tone and light of the second color tone, wherein the first to the B-th rows of pixels are consecutive rows of pixels to which image data for the first color tone are written in a first period, wherein the (B+1)-th to the 2B-th rows of pixels are consecutive rows of pixels emitting light of a color tone different from the first color tone during the first period, and wherein emission of different color tones does not occur simultaneously in the first to the B-th rows of pixels and in (B+1)-th to the 2B-th rows of pixels.

13. A method for driving a liquid crystal display device according to claim 12, wherein the detection in the first color image signal is the detection of the highest brightness of the first color tone to be displayed in a pixel of the first to B-th rows;

wherein the detection in the second color image signal is the detection of the highest brightness of the second color tone to be displayed in a pixel of the (A+1)-th to (A+B)-th rows;

wherein light of the first color tone is emitted in the first to B-th rows so that light emitted by the first pixel is of the highest brightness for the first color tone to be displayed in pixels of the first to B-th rows; and wherein light of the second color tone is emitted in the (A+1)-th to (A+B)-th rows so that light emitted by the second pixel is of the highest brightness for the second color tone to be displayed in pixels of the (A+1)-th to (A+B)-th rows.

14. A method for driving a liquid crystal display device according to claim 12, wherein the backlight panel includes an LED used as light source.

15. A method for driving a liquid crystal display device according to claim 12, wherein the backlight panel emits light with a frequency higher than or equal to 100 Hz and lower than or equal to 10 GHz.

* * * * *